US011543114B2

(12) United States Patent
Wang et al.

(10) Patent No.: US 11,543,114 B2
(45) Date of Patent: Jan. 3, 2023

(54) LED LIGHTING DEVICE

(71) Applicant: JIAXING SUPER LIGHTING ELECTRIC APPLIANCE CO., LTD, Jiaxing (CN)

(72) Inventors: Mingbin Wang, Jiaxing (CN); Tao Jiang, Jiaxing (CN)

(73) Assignee: JIAXING SUPER LIGHTING ELECTRIC APPLIANCE CO., LTD, Jiaxing (CN)

( * ) Notice: Subject to any disclaimer, the term of this patent is extended or adjusted under 35 U.S.C. 154(b) by 0 days.

(21) Appl. No.: 17/460,369

(22) Filed: Aug. 30, 2021

(65) Prior Publication Data

US 2022/0049844 A1 Feb. 17, 2022

Related U.S. Application Data

(63) Continuation of application No. 16/982,579, filed as application No. PCT/CN2020/089136 on May 8, 2020, now Pat. No. 11,262,062.

(30) Foreign Application Priority Data

May 10, 2019 (CN) ..... 201910389791.4
Sep. 2, 2019 (CN) ..... 201910823909.X
(Continued)

(51) Int. Cl.
*F21V 29/76* (2015.01)
*F21K 9/23* (2016.01)
(Continued)

(52) U.S. Cl.
CPC ..... *F21V 29/763* (2015.01); *F21K 9/23* (2016.08); *F21V 23/009* (2013.01); *F21Y 2115/10* (2016.08)

(58) Field of Classification Search
CPC ..... F21V 29/763; F21V 23/009; F21K 9/23; F21L 15/14
See application file for complete search history.

(56) References Cited

U.S. PATENT DOCUMENTS 7,637,637 B2 12/2009 Liu et al.
D695,938 S 12/2013 Galvan
(Continued)

FOREIGN PATENT DOCUMENTS

CN 201318602 Y 9/2009
CN 201396646 Y 2/2010
(Continued)

*Primary Examiner* — Bryon T Gyllstrom
*Assistant Examiner* — Christopher E Dunay
(74) *Attorney, Agent, or Firm* — Simon Kuang Lu

(57) ABSTRACT

An LED lighting device comprise a lamp cap; a case connected to the lamp cap and forming a cavity; a power supply disposed in the cavity; a light emission unit electrically connected to the power supply; and a heat exchange unit connected to the case, the light emission unit and the heat exchange unit are connected to form a thermal conduction path. The heat exchange unit comprises a fixing unit and a base, the light emission unit comprises an illuminator and a substrate, and the illuminator is mounted on the substrate. The fixing unit comprises a first fixing unit and a second fixing unit, the first fixing unit, the second fixing unit and the base are in an integrated structure, the first fixing unit and the second fixing unit are respectively matched with both ends of the substrate in a longitudinal direction of the substrate.

14 Claims, 26 Drawing Sheets

(30) Foreign Application Priority Data

| | | |
|---|---|---|
| Sep. 2, 2019 | (CN) | 201910824645.X |
| Sep. 4, 2019 | (CN) | 201910829903.3 |
| Sep. 29, 2019 | (CN) | 201910933782.7 |
| Dec. 3, 2019 | (CN) | 201911222383.6 |
| Dec. 3, 2019 | (CN) | 201911223302.4 |
| Dec. 16, 2019 | (CN) | 201911292035.6 |
| Mar. 5, 2020 | (CN) | 202010147591.0 |

(51) Int. Cl.
*F21V 23/00* (2015.01)
*F21Y 115/10* (2016.01)

(56) References Cited

U.S. PATENT DOCUMENTS

| | | | | |
|---|---|---|---|---|
| 8,783,917 | B2 | 7/2014 | Mrakovich | |
| 8,814,396 | B2 | 8/2014 | Ishida et al. | |
| 9,010,970 | B2 | 4/2015 | Guercio et al. | |
| 9,039,223 | B2 | 5/2015 | Rudd et al. | |
| 9,518,716 | B1 * | 12/2016 | Householder | F21S 8/00 |
| 10,655,834 | B1 | 5/2020 | Kotovsky | |
| 2009/0109625 | A1 | 4/2009 | Booth et al. | |
| 2010/0079984 | A1 | 4/2010 | Liu | |
| 2010/0080004 | A1 | 4/2010 | Zhang | |
| 2010/0135011 | A1 | 6/2010 | Richardson | |
| 2010/0314985 | A1 | 12/2010 | Premysler | |
| 2012/0080994 | A1 | 4/2012 | Chin et al. | |
| 2012/0314414 | A1 * | 12/2012 | Flaherty | H05B 45/357 362/249.02 |
| 2013/0148340 | A1 | 6/2013 | Shen | |
| 2013/0322096 | A1 * | 12/2013 | Liu | F21V 21/088 362/382 |
| 2015/0354794 | A1 | 12/2015 | Guercio et al. | |
| 2016/0245462 | A1 * | 8/2016 | Demuynck | F21K 9/237 |
| 2016/0320006 | A1 | 11/2016 | Ip | |
| 2016/0320046 | A1 | 11/2016 | Duckworth et al. | |
| 2017/0352605 | A1 * | 12/2017 | Bilan | H01L 21/4871 |
| 2018/0100637 | A1 | 4/2018 | Lan | |
| 2019/0003697 | A1 | 1/2019 | Lan | |
| 2019/0032911 | A1 | 1/2019 | Lan | |
| 2019/0145611 | A1 * | 5/2019 | May | F21S 4/28 362/147 |
| 2019/0264903 | A1 * | 8/2019 | Van Rensburg | F21V 29/70 |
| 2020/0072454 | A1 | 3/2020 | Li et al. | |
| 2020/0191369 | A1 | 6/2020 | Chami et al. | |
| 2020/0240621 | A1 * | 7/2020 | Lan | F21K 9/23 |

FOREIGN PATENT DOCUMENTS

| | | | |
|---|---|---|---|
| CN | 201615396 | U | 10/2010 |
| CN | 201983034 | U | 9/2011 |
| CN | 102322595 | A | 1/2012 |
| CN | 102927476 | A | 2/2013 |
| CN | 202747296 | U | 2/2013 |
| CN | 203099736 | U | 7/2013 |
| CN | 203162729 | U | 8/2013 |
| CN | 302553554 | S | 8/2013 |
| CN | 104566309 | A | 4/2015 |
| CN | 204437799 | U | 7/2015 |
| CN | 303341270 | S | 8/2015 |
| CN | 204678291 | U | 9/2015 |
| CN | 204717441 | U | 10/2015 |
| CN | 205716515 | U | 11/2016 |
| CN | 106247187 | A | 12/2016 |
| CN | 303990307 | S | 12/2016 |
| CN | 106287269 | A | 1/2017 |
| CN | 205877783 | U | 1/2017 |
| CN | 206207076 | U | 5/2017 |
| CN | 207486493 | U | 6/2018 |
| CN | 208186068 | U | 12/2018 |
| CN | 208222100 | U | 12/2018 |
| CN | 208418308 | U | 1/2019 |
| CN | 109416153 | A | 3/2019 |
| CN | 208817121 | U | 5/2019 |
| WO | 2018134906 | A1 | 7/2018 |

* cited by examiner

LED LIGHTING DEVICE

CROSS-REFERENCE TO RELATED APPLICATIONS

This application is a continuation application of U.S. application Ser. No. 16/982,579 filed on 2020 Sep. 20, which claims priority to the following Chinese Patent Application Nos. CN 201910389791.4 filed on 2019 May 10, CN 201910823909.X filed on 2019 Sep. 2, CN 201910824645.X filed on 2019 Sep. 2, CN 201910829903.3 filed on 2019 Sep. 4, CN 201910933782.7 filed on 2019 Sep. 29, CN 201911223302.4 filed on 2019 Dec. 3, CN 201911222383.6 filed on 2019 Dec. 3, CN 201911292035.6 filed on 2019 Dec. 16, CN 202010147591.0 filed on 2020 Mar. 5, the disclosures of which are incorporated herein in their entirety by reference.

BACKGROUND

Technical Field

The present disclosure relates to lighting field, and more particularly, to an LED lighting device.

Related Art

LED lighting is widely used because its benefits of far less energy consumption and longevity. The LED lighting equipment in the prior art usually includes a light board, a heat sink, and a power supply. The light board is in contact with the radiator to form a heat conduction path, so that the heat generated by the LED on the light board is quickly transferred to the radiator. The light board and the heat sink of the LED lighting equipment in the prior art are usually fixed by bolts, rivets or other fixed structures, which have the following disadvantages: it has the problems of inconvenient installation and low installation efficiency; after the two ends of the light board are fixed, the light board and heat sink may have different shrinkage rates due to different materials; after a long time of alternating hot and cold, the light board may be squeezed by the fixed structure in the length direction, causing the light board to bulge relative to the heat sink, resulting in reduced heat transfer efficiency.

In summary, in view of the shortcomings and defects of the existing LED lighting device, how to design an LED lighting device to solve a technical problem of the installation is expected to be solved by those skilled in the art.

SUMMARY

A number of embodiments of the present disclosure are described herein in summary. However, the vocabulary expression of the present disclosure is only used to describe some embodiments (whether or not already in the claims) disclosed in this specification, rather than a complete description of all possible embodiments. Some embodiments described above as various features or aspects of the present disclosure may be combined in different ways to form an LED lighting device or a portion thereof.

The present disclosure is directed to an LED lighting device and features in various aspects to solve the above problems. The LED lighting device comprises a lamp cap; a case connected to the lamp cap and forming a cavity; a power supply disposed in the cavity; a light emission unit electrically connected to the power supply; and a heat exchange unit connected to the case, the light emission unit and the heat exchange unit are connected to form a thermal conduction path. The heat exchange unit comprises a fixing unit and a base, the light emission unit comprises an illuminator and a substrate, and the illuminator is mounted on the substrate. The fixing unit comprises a first fixing unit and a second fixing unit, the first fixing unit, the second fixing unit and the base are in an integrated structure, the first fixing unit and the second fixing unit are respectively matched with both ends of the substrate in a longitudinal direction of the substrate.

In some embodiments, the first fixing unit comprises a first groove, the second fixing unit comprises a second groove, one end of the substrate is locked into the first groove, and the other end of the substrate is locked into the second groove.

In some embodiments, the first fixing unit has a first wall, and the first groove is formed between the first wall and the base; the second fixing unit has a second wall, and the second groove is formed between the second wall and the base.

In some embodiments, the first wall and the second wall respectively contact the surface of the substrate.

In some embodiments, the distance between the bottom of the first groove and the bottom of the second groove is greater than the length of the substrate.

In some embodiments, the end of one side of the substrate abuts against the bottom of the second groove.

In some embodiments, a slit is configured between one side of the substrate and the bottom of the first groove.

In some embodiments, the length from the bottom of the first groove to the end of the second wall is greater than the length of the substrate.

In some embodiments, the first wall is provided with a first mode, in the first mode, an opening formed in the first groove, and the opening is flared.

In some embodiments, the thickness of the first wall decreases in the direction toward the second wall.

In some embodiments, the thickness of the second wall decreases in the direction toward the first wall.

In some embodiments, the LED lighting device further comprising thermal adhesive coated on the substrate, wherein the thermal adhesive and the edge of the substrate are spaced.

In some embodiments, the LED lighting device further comprising thermal adhesive coated on the substrate, and the base has a receiving groove disposed thereof, the receiving groove is corresponding to the edge of the substrate and without exceeding the border of the outer end of the substrate.

In some embodiments, the LED lighting further comprising thermal adhesive coated on the substrate, the substrate has a receiving groove disposed thereof corresponding to the surface of the base, and the receiving groove is disposed on both sides of the substrate in a width direction.

In some embodiments, a through hole is disposed on the substrate, and the base of the heat exchange unit has convection opening corresponding to the through hole.

In some embodiments, the base between the cooling fins has apertures disposed thereof, and the substrate perforates with holes corresponding to the apertures.

In some embodiments, the thermal expansion coefficient of the base plate and the base are substantially the same.

In some embodiments, the lamp cap extends in a first direction, when the first direction is substantially parallel to the horizontal plane, the light emitting unit of the LED lighting device provides downward light emission.

In some embodiments, the LED lighting device is provided with less than 110 watts of power, and the light emission unit illuminates, enabling the LED lighting device to emit at least 15,000 lumens of luminous flux.

In some embodiments, the LED lighting device is provided with less than 80 watts of power, and the light emission unit illuminates, enabling the LED lighting device to emit at least 12,000 lumens of luminous flux.

DETAILED DESCRIPTION

In order to better understand the present disclosure, the present disclosure will be described more fully with reference to the accompanying drawings. The drawings show an embodiment of the disclosure. However, the present disclosure is implemented in many different forms and is not limited to the embodiments described below. Rather, these embodiments provide a thorough understanding of the present disclosure. The following directions such as "axial direction", "upper", "lower" and the like are for more clearly indicating the structural position relationship, and are not a limitation on the present invention. In the present invention, the "vertical", "horizontal", and "parallel" are defined as: including the case of ±10% based on the standard definition. For example, vertical usually refers to an angle of 90 degrees with respect to the reference line, but in the present invention, vertical refers to a condition including 80 degrees to 100 degrees. The operation circumstances and states of the LED lighting device of the present disclosure is referring to a lamp cap of the LED lighting device is disposed in a horizontal direction, as for exceptions will be further explained in the present disclosure.

Figure 1:
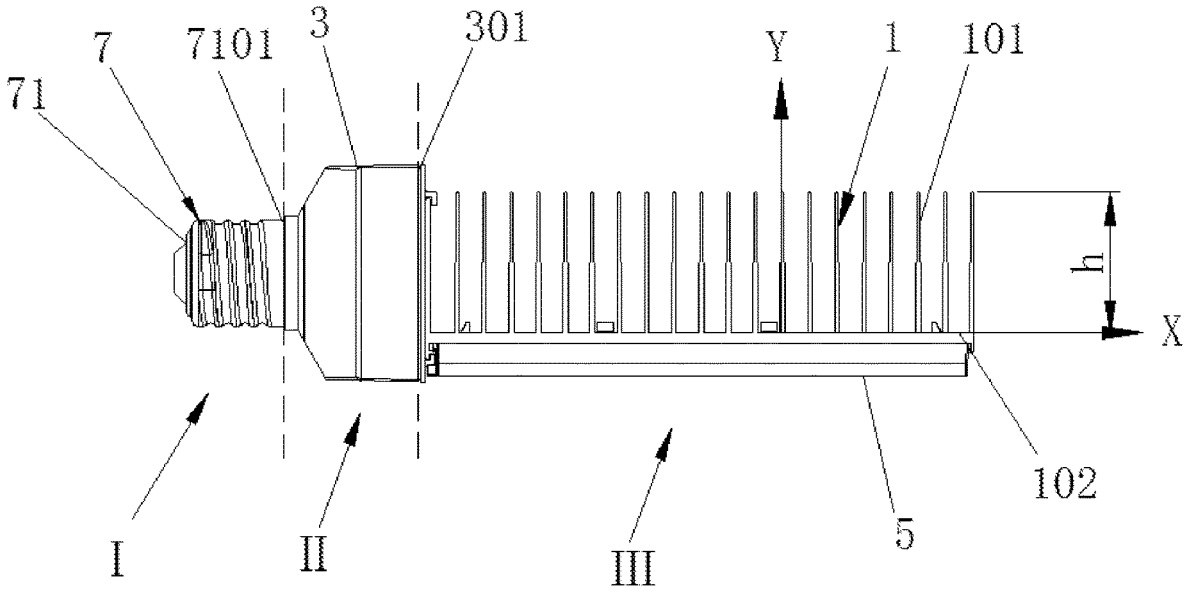
FIG. 1 illustrates a main schematic diagram showing a structure of an LED lighting device according to an embodiment of the instant disclosure.

Please refer to FIG. 1. The instant disclosure provides an embodiment of an LED lighting device comprising a first portion I, a second portion II, and a third portion III. As shown is FIG. 1, the first portion I, the second portion II and the third portion III are presented in dotted line, wherein the first portion I, the second portion II and the third portion III are arranged sequentially.

Figure 2:
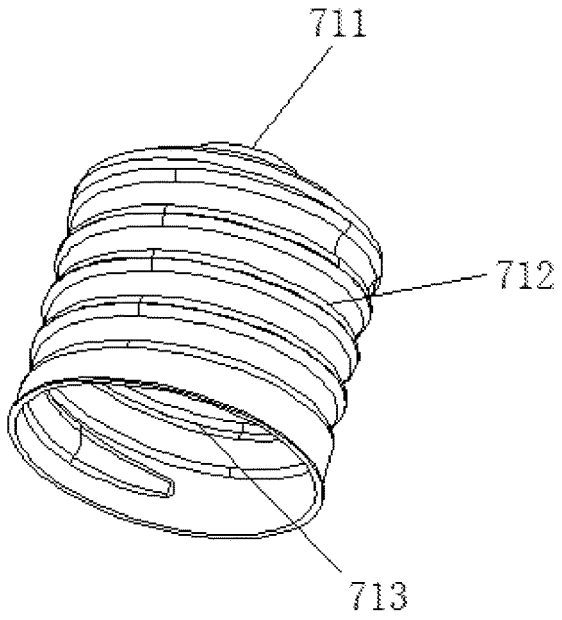
FIG. 2 illustrates a schematic diagram showing a lamp cap module according to an embodiment of the instant disclosure.

Please refer to FIG. 1 and FIG. 2. The first portion I is mainly to connect to an external power supply device (such as a lamp stand), wherein the first portion I comprises a lamp cap module 7 having a lamp cap 71 disposed thereof. The lamp cap 71 has an external thread connected to an external lamp stand. It is conceivable that the lamp cap module 7 has a lamp cap adapter 711 disposed thereof, wherein the lamp cap adapter 711 has an external thread 712 and an internal thread 713, which are adopted to connect to the external lamp stand.

Figure 4:
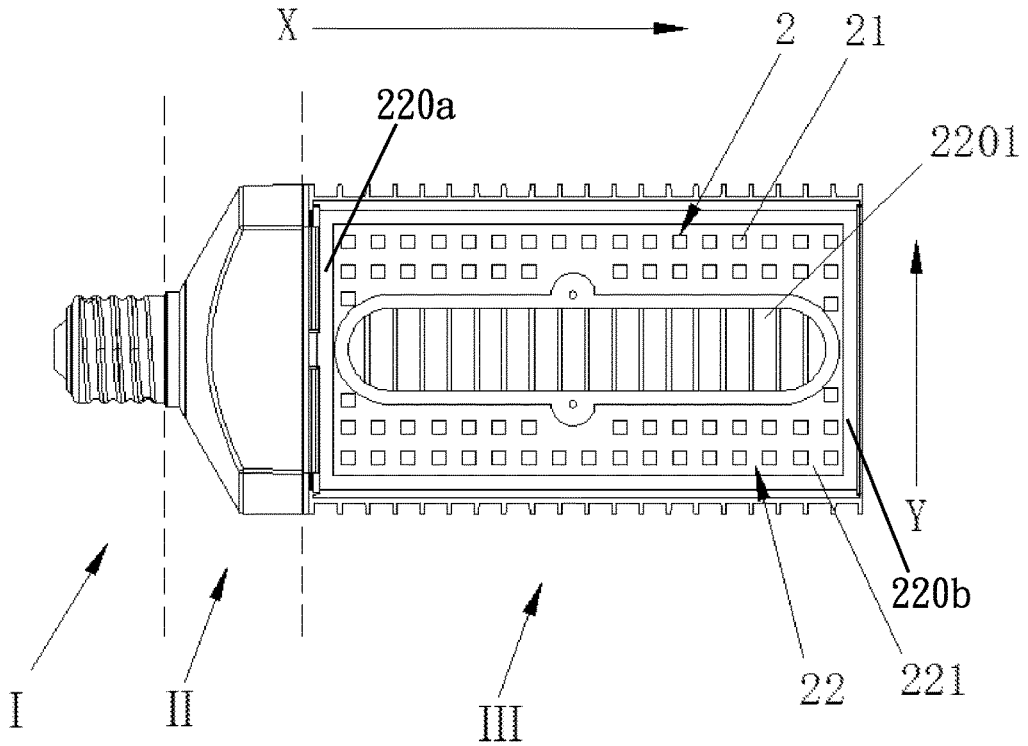
FIG. 4 illustrates a schematic diagram showing FIG. 3 without a light output unit.
Figure 5:
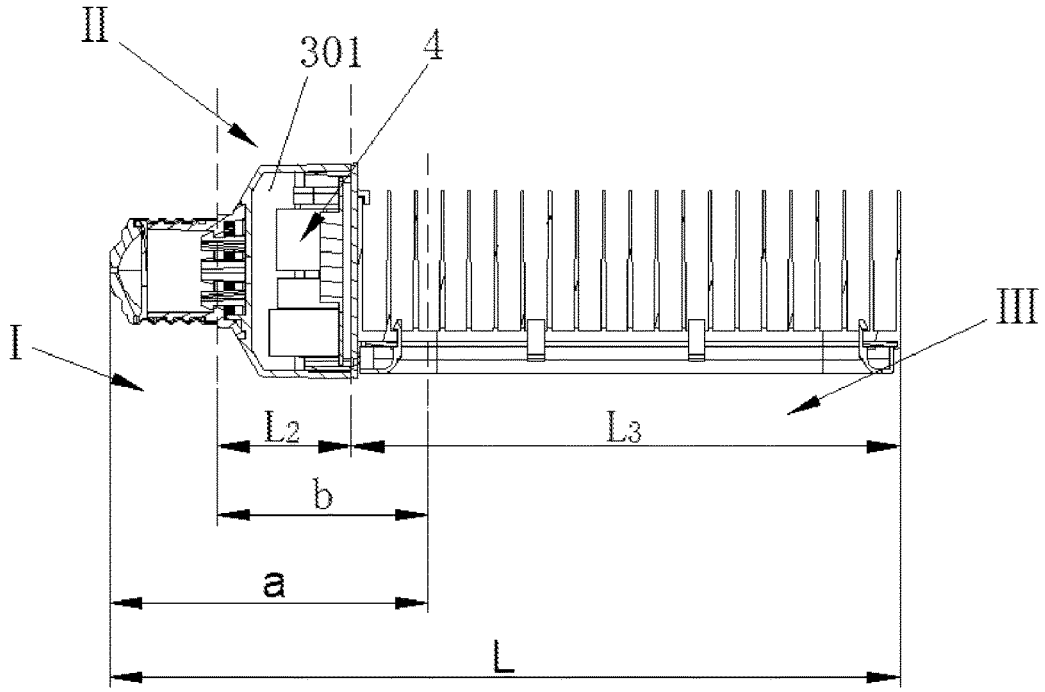
FIG. 5 illustrates a cross-section diagram showing an LED lighting device in FIG. 1.

Please refer to FIG. 1, FIG. 4 and FIG. 5. The second portion II is mainly to dispose electronic components of the LED lighting device. The second portion II comprises a case 3 and a power supply 4, wherein the case 3 defines the dimension of the first portion I to form a cavity 301, and the power supply 4 is disposed in the cavity 301. Please refer to FIG. 10. The power supply 4 includes a circuit board 41 and electronic components 42, and the electronic components 42 are disposed on the circuit board 41. The circuit board 41 is substantially vertical to the first direction X.

Please refer to FIG. 1, FIG. 3, FIG. 4 and FIG. 5. The third portion III is mainly disposed to provide thermal dissipation function for the LED lighting device (especially the thermal dissipation for a light output unit 5) and light emission functions, wherein the third portion III has a heat exchange unit 1, a light emission unit 2 and a light output unit 5 disposed thereof, wherein the light emission unit 2 and the heat exchange unit 1 are connected to form a thermal conduction path of the third portion III.

In operation of the LED lighting device, heat generated from the light emission unit 2 is conducted in form of thermal conduction to the heat exchange unit 1, wherein the heat exchange unit 1 executes thermal dissipation. The power supply 4 is electrically connected to the light emission unit 2 to provide power to the light emission unit 2. The light output unit 5 is sleeved on the exterior of the light emission unit 2, in operation of the LED lighting device, at least a part of the light generated from the light emission unit 2 injects into the light output unit 5, then emits from the light output unit 5 and reflects to the exterior of the LED lighting device. The light output unit 5 has an optical device disposed therein, and the optical device has optical elements disposed therein to provide either of an adequate combinations of reflection, refraction and/or diffusion functions. Furthermore, some elements for increasing the transmission of luminous flux of the light output unit 5 may also be disposed in the optical device.

Please refer to FIG. 1. The first portion I and the second portion II are deployed with connection portions of the lamp cap module 7 and the case 3 (the connection portions of the LED lighting device in a longitudinal direction) as limitations. A bottom portion 7101 of the lamp cap 71 in an axial direction is deployed as the connection portion, the second portion II and the third portion III are deployed with connection portions of the case 3 and the heat exchange unit 1 (the connection portions of the LED lighting device in a longitudinal direction) as limitations, and a bottom portion 301 of the case 3 in a longitudinal direction is deployed as the connection portion.

Please specifically note that in the embodiment of the instant disclosure, although the first portion I, the second portion II and the third portion III extend sequentially in the longitudinal direction of the LED lighting device, in some embodiments, according to various design demands of LED lighting devices, the first portion I, the second portion II and the third portion III are arranged in various directions in an overlapping manner, the present disclosure is not limited to such arrangement.

Please refer to FIG. 1, FIG. 4 and FIG. 5. The lamp cap 71 extends in a first direction X (the longitudinal direction of the LED lamp). The light emission unit 2 comprises an illuminator 21 and a substrate 22 having a mounting portion 221 for the illuminator 21 to be disposed thereon. The mounting portion 221 is oriented parallel to the first direction X. From the perspective of using the LED lighting device, after the LED lighting device is installed horizontally (both the first direction X and the mounting portion 221 are oriented parallel to the horizontal level), the light emission unit 2 of the LED lighting device provides downward light emission, enabling the lower area of the LED lighting device to illuminate. That is, in the embodiment of the present disclosure, the LED lighting device is installed horizontally. In addition, after the LED lighting device is installed horizontally, the first direction X or the mounting portion 221 and the horizontal level form an acute angle which is less than 45 degrees, for providing downward light emission. The LED lighting devices are applied in lighting occasions such as outdoors, streets (such as a street light), indoors (by wall mounting), warehouses, parking lots, sports fields, etc. The so called "illuminators" in the embodiments of the present disclosure can be referred to light sources mainly of LEDs (light emitting diodes), comprising but not limited to LED lamp beads, LED lamp tubes or LED filaments.

In some applications, there could be weight limitations for the LED lighting devices. For example, an LED lighting device is deployed with E39 lamp cap, the maximum weight limitation for the LED lighting device is less than 1.7 kilograms (kg).

In some embodiments, providing less than 150 watts of power to the LED lighting device while the LED lighting device is installed horizontally and each portion of the LED lighting device is limited in the weight distribution. The light emission unit 2 (in specific, the illuminator 21 of the light emission unit 2) illuminates, and emits at least 15,000 lumens of luminous flux. Furthermore, when provided with 140 watts of power, the LED lighting device emits at least 15,000 lumens, 16,000 lumens, 17,000 lumens, 18,000 lumens, 19,000 lumens, 20,000 lumens or higher lumens of luminous flux (less than 40,000 lumens). In some embodiments, the weight limitation for the heat exchange unit 1 is less than 0.9 kg, and the LED lighting device illuminates and emits at least 15,000 lumens, 16,000 lumens, 17,000 lumens, 18,000 lumens, 19,000 lumens, 20,000 lumens or higher lumens of luminous flux (less than 40,000 lumens).

That is, the heat exchange unit 1 under the weight limitation of 0.9 kg (less than 0.9 kg) dissipates heat generated from the light emission of at least 15,000 lumens of luminous flux emitted by the LED lighting device. In some embodiments, the weight limitation for the heat exchange unit 1 is 0.8 kg or less than 0.8 kg, the LED lighting device illuminates and emits at least 20,000 lumens of luminous flux. In the above embodiments, due to total weight limitations, the total light emission of the LED lighting device is less than 40,000 lumens of luminous flux.

In some embodiments, providing less than 110 watts of power to the LED lighting device while the LED lighting device is installed horizontally and each portion of the LED lighting device is limited in the weight distribution. The light emission unit 2 (in specific, the illuminator 21 of the light emission unit 2) illuminates and emits at least 15,000 lumens of luminous flux (less than 24,000 lumens). In some embodiments, providing less than 80 watts of power to the LED lighting device while the LED lighting device is installed horizontally and each portion of the LED lighting device is limited in the weight distribution. The light emission unit 2 (in specific, the illuminator 21 of the light emission unit 2) illuminates and emits at least 12,000 lumens of luminous flux (less than 20,000 lumens). In some embodiments, providing less than 60 watts of power to the LED lighting device while the LED lighting device is installed horizontally and each portion of the LED lighting device is limited in the weight distribution. The light emission unit 2 (in specific, the illuminator 21 of the light emission unit 2) illuminates and emits at least 9,000 lumens of luminous flux (less than 18,000 lumens). In some embodiments, providing less than 40 watts of power to the LED lighting device while the LED lighting device is installed horizontally and each portion of the LED lighting device is limited in the weight distribution. The light emission unit 2 (in specific, the illuminator 21 of the light emission unit 2) illuminates and emits at least 6,000 lumens of luminous flux (less than 15,000 lumens). In some embodiments, providing less than 20 watts of power to the LED lighting device while the LED lighting device is installed horizontally and each portion of the LED lighting device is limited in the weight distribution. The light emission unit 2 (in specific, the illuminator 21 of the light emission unit 2) illuminates and emits at least 3,000 lumens of luminous flux (less than 10,000 lumens). Moreover, the LED lighting devices in the above embodiments meet the conditions that the operation environment temperatures are in a range of −20 degrees to 70 degrees, and 50,000 hours of life.

Please refer to FIG. 1 and FIG. 5. To arrange the weight distribution and the length of the first portion I, the second portion II, and the third portion III, the moment of the lamp cap 71 is taken into consideration.

When the weight of the LED lighting device is fixed (the weight is a determined value or in a determined range, e.g. 1 kg~1.7 kg), the center of the LED lighting device will affect the moment that the lamp cap 71 can withstand. As shown in FIG. 1 and FIG. 5, in some embodiments, the length of an LED lighting device is L, the distance from the top of the lamp cap 71 to the plane where the center of the LED lighting device is located (the plane is vertical to the axle of the lamp cap of the LED lighting device) is a, the length L of the LED lighting device and the longitudinal distance a from the top of the lamp cap 71 to the plane where the center of the LED lighting device is located satisfies the following formula: a/L=0.2~0.45. Preferably the length L of the LED lighting device and the distance a from the top of the lamp cap 71 to the plane where the center of the LED lighting device satisfies the following formula: a/L=0.2~0.4. To satisfy the above formula, the weight of the entire LED lighting device is determined (the weight limitation of the entire LED lighting device is in a range of 1 kg~1.7 kg), lowering the moment that the lamp cap 71 withstands, ensuring the second portion II and the third portion III have enough weight to dispose elements and execute thermal dissipation.

As shown in FIG. 1 and FIG. 5, the distance b from the beginning of the second portion II to the plane where the center the LED lighting device is located (the plane is vertical to the axle of the lamp cap of the LED lighting device) satisfies the following formula:

$$(L_2+L_3)/5<b<3(L_2+L_3)/7,$$

wherein $L_2$ is the length of the second portion II, wherein $L_3$ is the length of the third portion III.

In order to arrange sufficient area for thermal dissipation of the LED lighting device and lower the effect the moment has on the connection portion (e.g. lamp cap 71) in a condition that the LED lighting device is installed horizontally, in some embodiments, the heat exchange unit 1 is arranged in an asymmetrical shapes (various designs of the heat exchange unit 1 satisfy the following formula).

Figure 6:
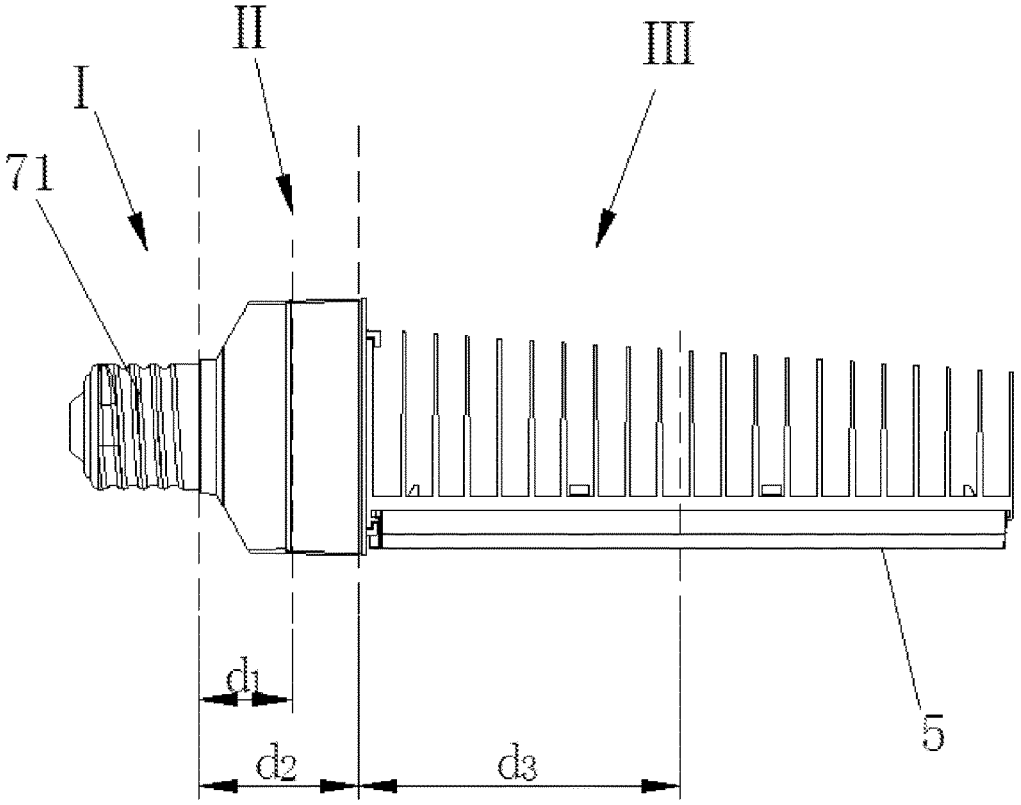
FIG. 6 illustrates a schematic diagram showing a structure of an LED lighting device accordingly to an embodiment of the instant disclosure.

Please refer to FIG. 1 and FIG. 6. The LED lighting device is installed horizontally, wherein after the lamp cap 71 is disposed, the moment is $$F=d_1*g*W_1+(d_2+d_3)*g*W_2;$$

wherein $d_1$ is the distance from the first portion I (the bottom of the lamp cap 71) to the plane where the center of the second portion II is located (the plane is vertical to the axial direction of the lamp cap);

wherein g is 9.8N/kg;

wherein $W_1$ is the weight of the second portion II;

wherein $d_2$ is the length of the second portion II;

wherein $d_3$ is the distance from the second portion II (the bottom of the second portion II) to the plane where the center of the third portion III is located (the plane is vertical to the axle of the lamp cap);

$W_2$ is the weight of the third portion III.

In the condition that the weight of the entire LED lighting device is determined (or the weight of the entire LED lighting device is limited, e.g. the weight limitation is in a range of 1 kg~1.7 kg), the moment of the lamp cap 71 satisfies the following formula:

$$1NM<d_1*g*W_{1+}(d_2+d_3)*g*W_2<2NM$$

In some embodiments, the weight of the second portion II includes the weight of the power supply elements (the power supply 4) and thermal dissipation elements for the power supply elements, and the weight of the third portion III includes the weight of the light emission unit 2 and thermal dissipation elements for the light emission unit 2. The arrangement of the length of the second portion II provides a longitudinal space to accommodate the power supply elements (the power supply 4), and the arrangement of the length of the third portion III provides a longitudinal space to accommodate the illuminator 21 and the thermal dissipation elements. The arrangements of the above is to ensure the power supply, the light emission or the thermal dissipation function of each parton the premise that the moment of the lamp 71 is not over the range that the lamp cap can withstand.

In some embodiments, the moment of the lamp cap 71 satisfies the following formula:

$$1NM<d_1*g*W_{1+}(d_2+d_3)*g*W_2<1.6NM$$

Figure 7:
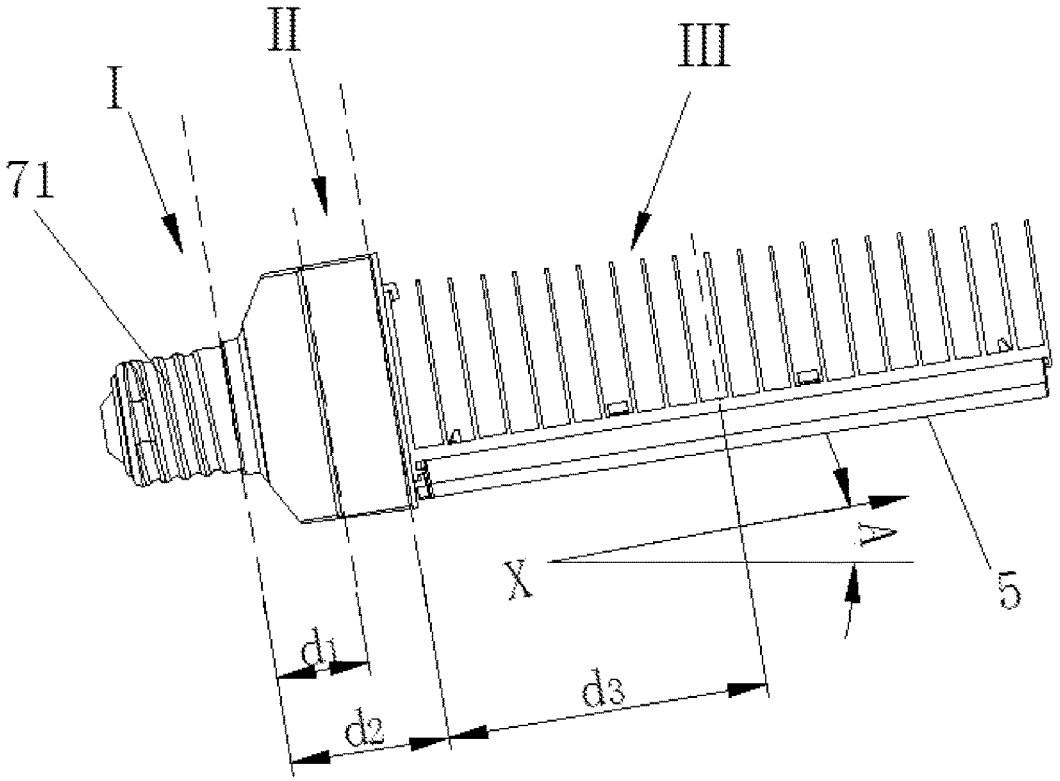
FIG. 7 illustrates a schematic diagram showing a structure of the LED lighting device and horizontal level forming a nip angle in FIG. 6.

As shown in FIG. 7, after the LED lighting device is installed and formed a nip angle with a horizontal level (the axle of the lamp cap 71 and the horizontal level form an acute angle less than 45 degrees), the moment of the lamp cap 71 is $$F=d_1*g*W_1 \cos A+(d_2d_3)*g*W_2 \cos A,$$

wherein A is the nip angle formed between the axle of the lamp cap and the horizontal level.

In the condition that the weight of the of the entire LED lighting device is determined (or the weight of the entire LED lighting device is limited, e.g. the weight limitation is in a range of 1 kg~1.7 kg), the moment of the lamp cap 71 satisfies the following formula:

$$1NM<d_1*g*W_1 \cos A+(d_2+d_3)*g*W_2 \cos A<2NM$$

In some embodiments, the moment is $$1NM<d_1*g*W_1 \cos A+(d_2+d_3)*g*W_2 \cos A<1.6NM$$

In the embodiments, wherein the moments are arranged as above, the length of the entire LED lighting device is less than 350 mm and more than 200 mm. When the lamp cap 71 is deployed with certain models, e.g. E39 lamp cap is deployed (the length of E39 lamp cap is around 40 mm), the sum of length of the second portion II and the third portion III is less than 310 mm and more than 160 mm. Specifically, the sum of the length of the second portion II and the third portion III is less than 260 mm and more than 180 mm.

Figure 10:
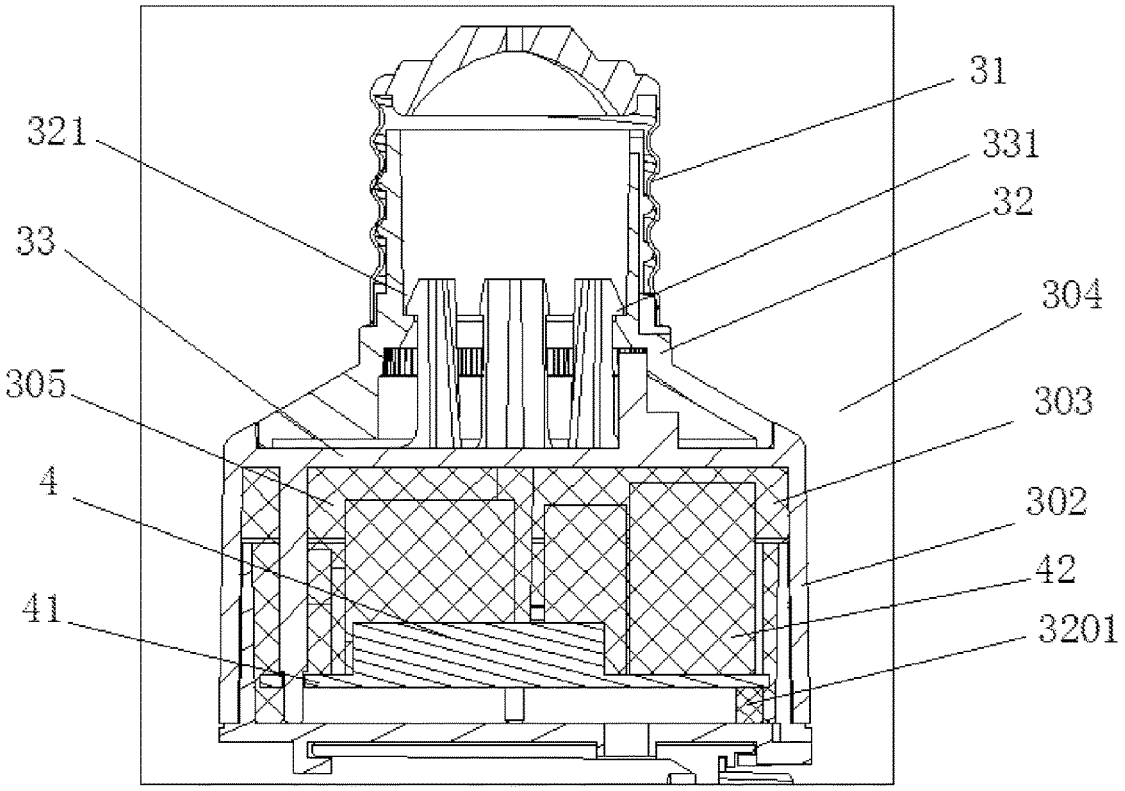
FIG. 10 illustrates a cross-section diagram showing a structure of a second portion according to an embodiment of the instant disclosure.

Please refer to FIG. 10. The power supply 4 and an end portion of a lamp case 32 (the end portion is disposed proximate an end of the third portion III) maintain a space to prevent heat generated from the operation of the third portion III (the light emission unit 2) conducting to the power supply 4, or to prevent an interaction between the heat generated from the power supply 4 and heat generated from the third portion III. Specifically, a circuit board 41 of the power supply 4 and the end portion of the lamp case 32 maintain a space with air to form a better thermal isolation. Specifically, the lamp case 32 has a block 3201 disposed therein, enabling the circuit board 41 to be supported on the block 3201, wherein the circuit board 41 and the lamp case 32 maintain a space. Besides, due to the arrangement of the space between the circuit board 41 and the lamp case, the center of the second portion II is adjusted, and the moment of the lamp cap 71 is lowered.

In some embodiments, the LED lighting device is installed horizontally, considering the loading of the lamp cap 71, when the weight of the LED lighting device is determined, the magnitude of the moment depends on the moment arm. That is the weight distribution of the entire LED lighting device. Taking a comprehensive consideration of the loading of the lamp cap 71 and the thermal dissipation of the light emission unit 2 and the power supply 4, the second portion II is the portion closer to the lamp cap 71, the weight distribution of the second portion II accounts for more than 30% of the weight of the entire LED lighting device. Specifically, the weight distribution of the second portion II accounts for more than 35% of the weight of the entire LED lighting device; more specifically, the weight distribution of the second portion II accounts for 30%~35% of the weight of the entire LED lighting device, enabling the second portion II to have more weight for thermal dissipation. The weight of the second portion II is closer to the first portion I, compared to the first portion I, the moment arm of the second portion II is shorter than the arm of the first portion I.

The weight of the third portion III accounts for less than 60% of the weight of the entire LED lighting device. Specifically, the weight of the third portion III accounts for less than 55% of the weight of the entire LED lighting device; more preferably, the weight of the third portion III accounts for 50%~55% of the weight of the entire LED lighting device, satisfying the thermal dissipation of the light emission unit 2 and limiting the weight of the third portion III wherein the moment is better controlled.

The weight distribution of the first portion I, the second portion II and the third portion III are arranged, wherein the length of the second portion II accounts for less than 25% of the length of the entire LED lighting device, the moment arm of the second portion II is controlled (while the length of the moment arm is controlled, the moment of the second portion II relatively to the lamp cap 71 is better controlled). Specifically, the length of the second portion II accounts for less than 20% of the length of the entire LED lighting device; more specifically, the length of the second portion II accounts for 15%~25% of the length of the entire LED lighting device. When the moment is controlled, the second portion II provides enough space to accommodate the power supply 4. The length of the third portion III accounts for less than 70% of the length of the entire LED lighting device; specifically, the length of the third portion III accounts for 60%~70% of the length of the entire LED lighting device, to reach the balance between the moment of the third portion III and thermal dissipation of the third portion III (the longer the length of the third portion III, the more reasonable the arrangement of the heat exchange unit 1, wherein the third portion III provides more space for thermal dissipation; the shorter the length of the third portion III, the shorter the moment of the third portion III).

The First Portion I

As shown in FIG. 1, in some embodiments, a lamp cap module 7 of the first portion I provides an external power supply and an electric connection port of the LED lighting device. The lamp cap module 7 comprises a lamp cap 71 disposed to connect with a lamp stand, and the lamp cap 71 has an external thread to connect with the external lamp stand.

The lamp cap 71 is disposed in a first direction X, e.g. extending in a longitudinal direction of the LED lighting device. The lamp cap 71 is deployed according to various occasions of the applications, the lamp cap 71 is an E model, e.g. E39 lamp cap or E40 lamp cap, wherein "E" represents Edison screw bulb with thread screwed into the lamp stand, 39/40 represents nominal diameter of the bulb thread, E39 is American standard, and E40 is European Union standard. Furthermore, the material of the lamp caps comprises copper nickel plating, aluminum alloy, etc.

Specifically, when the LED lighting devices are used in some specific occasions, the lamp cap 71 can also be deployed with other models, e.g. plug-in lamp cap GU10, etc., wherein G represents the lamp cap is a plug-in model, U represents the top of the lamp cap is in U shape, and the number 10 represents bulb holder hole centre-to-centre spacing is 10 mm.

As shown in FIG. 2, the lamp cap module 7 comprises a lamp cap adaptor 711 having an internal thread 713 and an external thread 712 for connecting with the external lamp stand. The lamp cap adaptor 711 providing a connection between the second portion II and the first portion I is designed in various shapes to match with the connection between lamp caps and lamp stands. For example, E27 lamp cap is disposed onto E40 lamp stand by the lamp cap adaptor 711.

The Second Portion II

As shown in FIG. 1 and FIG. 5, in some embodiments, the case 3 of the second portion II is provided to accommodate the power supply 4 and define the dimension of the second portion II. The case 3 connects to the lamp cap module 7 and the heat exchange unit 1 respectively. Considering the demand of creepage distance, the case 3 is usually made of insulating material. In some embodiments, the case 3 is made of metal material, in a condition that the galvanic isolation between the case 3 and the power supply 4 is well executed. The case 3 defines a cavity 301 for the power supply 4 to be disposed therein.

In operation of the LED lighting device, the power supply 4 generates heat, the second portion II has a thermal dissipation device disposed therein for dissipating heat generated by the operation of the power supply 4, preventing overheating of the power supply 4.

FIG. 10 is a partial cross-section diagram, showing the cross-section structure of the second portion II. As shown in FIG. 1 and FIG. 10, the second portion II has a first region 302, a second region 303, and a third region 304. The third region 304 is an exterior area of the case 3, the thermal conductivities of the first region 302 and the second region 303 are greater than the thermal conductivity of the third region 304. Therefore, the first region 302 and the second region 303 form a conduction path to the power supply 4, enabling heat generated from the power supply 4 in operation of the LED lighting device to conduct quickly to the exterior of LED lighting device in form of thermal conduction. Specifically, the thermal conductivity of the first region 302 is 8 times greater than the thermal conductivity of the third region 304; specifically, the thermal conductivity of the first region 302 is 9-15 times greater than the thermal conductivity of the third region 304. Specifically, the thermal conductivity of the second region 303 is 5 times greater than the thermal conductivity of the third region 304; specifically, the thermal conductivity of the second region 303 is 6-9 times greater than the thermal conductivity of the third region 304. In some embodiments, the thermal conductivity of the first region 302 is between 0.2~0.5, and the thermal conductivity of the second region 303 is between 0.1~0.3. Preferably, the thermal conductivity of the first region 302 is between 0.2~0.35, the thermal conductivity of the second region 303 is between 0.15~0.25, and the thermal conductivity of the third region 304 is between 0.02~0.05.

The thermal conductivity of each regions, as described above, should be understood as an average thermal conductivity of all the materials in each of the regions.

The present disclosure provides an embodiment, wherein the second region 303 has a thermal conduction material 305 disposed therein. The power supply 4 forms a thermal conduction path with the thermal conduction material 305 of the second region 303 and the first region 302. To illustrate, the thermal conduction material 305 is a thermal adhesive. That is the second portion II has a thermal dissipation device disposed therein, wherein the thermal dissipation device is the thermal conduction material 305 of the second region 303. In some embodiments, the thermal dissipation device appears in various forms, for example, when heat generated from the power supply 4 is dissipated by the case 3 in form of convection, the thermal dissipation device are the holes disposed on the case 3. For another example, the thermal dissipation device is a fan, accelerating thermal dissipation of the power supply 4 in form of convection. For the other example, the thermal dissipation device is a radiation layer disposed on the surface of the power supply 4 or the case 3, accelerating the thermal dissipation of the power supply 4 in form of radiation.

In some embodiments, the power supply 4 comprises thermal elements. The thermal elements are the electronic components generating relatively more heat in operation of an LED lighting device, e.g. resistances, transformers, inductances, IC (integrated circuits), transistors, etc. Based on a basic principle of thermal conduction, the factors affecting thermal conduction mainly include the thermal conductivity of the thermal conduction material 305, the cross-section area of the thermal conduction material 305, and the thickness of the thermal conduction material 305 (take the shortest distance from the heating unit to the first region 302), wherein in a condition that the thermal conduction material 305 is determined, the main factors affecting the thermal conduction are the cross-section area of the thermal conduction material 305 and the thickness of the thermal conduction material 305. Assuming the heat generated from the thermal elements is conducted to the first region 302 in the shortest path (the shorter the thermal conduction path, the better the effect of the thermal conduction), wherein the thermal conduction formula is:

$$Q=\lambda A\Delta T/d;$$

wherein Q is the heat flux of the thermal conduction material 305, λ is the thermal conductivity of the thermal conduction material 305; A is the area where the heating unit and the thermal conduction material 305 are contacted with each other; ΔT is the temperature difference in the thermal conduction path (the temperature difference between the thermal elements and the thermal conduction material 305 at the end of the thermal conduction path); and d is the shortest distance from the thermal elements to the first region 302. The thermal elements are transformers, inductances, IC (integrated circuits), transistors, resistances, etc.

In order to quickly dissipate the heat generated from the thermal elements, when disposing the thermal conduction material 305, the surface area of the thermal elements attached with the thermal conduction material 305 (the value of A) should be as large as possible. In some embodiments, to ensure the heat generated from the thermal elements is dissipated quickly by the thermal conduction material 305 in form of thermal conduction, at least 80% of the surface area exposed on the exterior of the thermal elements (excluding the contact area wherein the circuit board is installed) is attached with the thermal conduction material 305. In some embodiments, at least 90% of the surface area exposed on the exterior of the thermal elements (excluding the contact area wherein the circuit board is installed) is attached with the thermal conduction material 305. In some embodiments, at least 95% of the surface area exposed on the exterior of the thermal elements (excluding the contact area wherein the circuit board is installed) is attached with the thermal conduction material 305. In some embodiments, at least 80%, 90% or 95% of the surface area exposed on the exterior of either thermal elements (excluding the contact area wherein the circuit board is installed) is attached with the thermal conduction material 305, preventing the heat flux bottleneck in the thermal conduction path.

In order to quickly conduct the heat generated from the thermal elements to the first region 302, designing the shortest distance from the thermal elements to the first region 302 increases the efficiency of thermal conduction. Specifically, the width of the second portion II is W (wherein the cross-section shape of the second portion II is round, polygon, or other irregular shapes, the width is referring to the shortest connection distance between either two points on the outline of cross-section of the second portion II, and the connection between the two points passes through the axis of the lamp cap 71), and the shortest distance from the thermal elements in the width direction of the second portion II to the border of the second portion II (the first region 302) is d (the shortest distance from the center of the thermal elements to the border of the second portion II). To conduct heat generated from the thermal elements to the first region 302, the shortest distance d from the thermal elements to the border of the second portion II (the first region 302) and the width W of the second portion II satisfies the following formula:

$$d \leq 5/11W$$

In some embodiments, the shortest distance d from the thermal elements in the width direction of the second portion II to the border of the second portion II (the first region 302) and the width L of the second portion II satisfies the following formula:

$$d \leq 4/11W$$

Furthermore, in order to meet the demand of the creepage distance, the thermal elements are spaced on the border of the second portion II. In general, the shortest distance d from the thermal elements in the width direction of the second portion II to the border of the second portion II (the first region 302) and the width L of the second portion II satisfies the following formula:

$$1/20W \leq d \leq 4/11W$$

In some embodiments, the range of W is between 50 mm~150 mm; preferably, the range of W is between 55 mm~130 mm;

wherein the thermal elements are transformers, inductances, IC (integrated circuits), transistors, resistances, etc.

A thermal resistance is the resistance in the process of the thermal transfer, representing the temperature difference caused by a unit of the heat flux. Heat generated from the thermal elements in the width direction of the second portion II is conducted to the third region 304 in the shortest path, and is sequentially conducted to the second region 303 and the first region 302, and the sum of the thermal resistance R is the thermal resistance R1 of the first region 302 and the thermal resistance R2 the second region 303;

wherein the thermal resistance of the second region 303 is $R_2=d_2/\lambda_2A_2$; wherein $d_2$ is the shortest distance from the thermal elements in the width direction of the second portion II to the surface area of the second region 303 (the connection area of the first region 302 and the second region 303); $\lambda_2$ is the thermal conductivity of the second region 303, and $A_2$ is the contact area of the thermal elements and the second region 303 (the thermal conduction material 305);

wherein the thermal resistance of the first region 302 is $R_1=d_1/\lambda_1A_1$; wherein $d_1$ is the shortest distance from the second region 303 to the lateral portion of the first region 302 (the thickness of the first region 302); $\lambda_1$ is the thermal conductivity of the first region 302, and $A_1$ is the surface area of the first region 302.

Heat of the second region 303 is mainly conducted to the first region 302 in form of thermal conduction, and heat of the first region 302 is mainly conducted to the third region 304 in form of thermal radiation. Heat generated from the thermal elements need to be conducted to the second region 303, thus the thermal resistance $R_2$ of the second region 303 is less than the thermal resistance $R_1$ of the first region 302, that is $$d_2/\lambda_2A_2 < d_1/\lambda_1A_1$$

In some embodiments, in order to lower the thermal resistance $R_2$ of the second region 303, the shortest distance from the thermal elements in the width direction of the second portion II to the surface area of the second region 303 (the connection area of the first region 302 and the second d region 303) and the surface area of the thermal elements attached with the thermal conduction material 305, etc. are deployed with the aforementioned arrangements, that is, $d_2$ satisfies the following formula: $1/20W \leq d_2 \leq 4/11W$; wherein at least 80%, 90% or 95% of the surface area exposed on the exterior of the thermal elements (excluding the contact area wherein the circuit board is installed) is attached with the thermal conduction material.

In some embodiments, electronic components 42 of the power supply 4 comprise an electrolytic capacitor, the life of the electrolytic capacitor depends on the temperature of the disposed environment, therefore the arrangement of the electrolytic capacitor 421 affects its life. Please refer to FIG. 44A. In some embodiments, the electrolytic capacitor 421 is disposed to an outer end of the circuit board 41, wherein the electrolytic capacitor 421 is directly connected to the first region 302 by the thermal conduction material 305 in form of thermal connection. That is, there are no other electronic components in the shortest path from the electrolytic capacitor 421 to the first region 302, especially the thermal elements, ensuring a better thermal conduction of the electrolytic capacitor 421. In some embodiments, the shortest distance $d_3$ from the electrolytic capacitor 421 to the first region 302 satisfies the following formula: $d_3 \leq 5/11W$; wherein in some embodiments, the shortest distance $d_3$ from the electrolytic capacitor 421 to the first region 302 satisfies the following formula: $d_3 \leq 4/11W$;

wherein W is the width of the second portion II (wherein the cross-section shape of the second portion II is round, polygon, or other irregular shape, the width is referring to the shortest connection distance between either two points on the outline of cross-section of the second portion II, and the connection between the two points passes through the axis of the lamp cap 71), wherein $d_3$ is the shortest distance from the electrolytic capacitor 421 in the width direction of the second portion II to the first region 302 (the shortest distance from the center of the electrolytic capacitor 421 to the first region 302).

In some embodiments, to lower the distributed capacity of the electronic components and satisfy the demand of thermal dissipation, the positions of the electronic components on the circuit board 41 are arranged. Please refer to FIG. 44A. The circuit board 41 has a first surface 4101 disposed therein, wherein the first surface 4101 has electronic components disposed thereof, wherein the first surface has a first plane 4102 and a second plane 4103 disposed thereof, wherein the electronic components of the first surface 4101 are disposed in the second plane 4103, wherein the second plane 4103 is an annular zone. That is the electronic components are disposed in the annular zone, surrounding the first plane 4102, increasing the space between the electronic components (between the non-adjacent electronic components), lowering the distributed capacity.

The first plane 4102 has the thermal conduction material 305 disposed thereof, enabling a part of heat generated from the operation of the electronic components to be dissipated by the thermal conduction material 305 of the first plane 4102, accelerating the thermal dissipation. In some embodiments, the electronic components comprise thermal elements (e.g. transformers, inductances, IC (integrated circuits), transistors, resistances, etc.), to accelerate the thermal dissipation, at least a part of the thermal elements is corresponding to the first plane 4102 (at least a portion of the thermal elements is directly corresponding to the thermal conduction material 305 of the first plane 4102).

A transistor 422 is one of the electronic components generating more heat, for this reason, the transistor 422 is disposed on the second plane 4103 corresponding to the area of the first plane 4102, enabling heat generated from the operation of the transistor 422 to be dissipated by the thermal conduction material 305 of the first plane 4102. In some embodiments, the transistor 422 is disposed on the periphery of the second plane 4103, enabling the transistor 422 to be provided with a shorter thermal dissipation path (to the exterior of the case). A plurality of transistors 422 (at least two), wherein some of the transistors 422 are disposed on the second plane 4103 corresponding to the area of the first plane 4102 while others of the transistors 422 are disposed on the periphery of the second plane 4103, wherein a reasonable arrangement of a plurality of the transistors ensures that the thermal dissipation is well executed. In some embodiments, some elements are disposed between the transistor 422 and the first plane 4102, wherein less than half of a side area of the transistor 422 corresponding to a side of the first plane 4102 is blocked by the elements, it is still considered that the transistor 422 are corresponding to the first plane 4102.

Figure 44A:
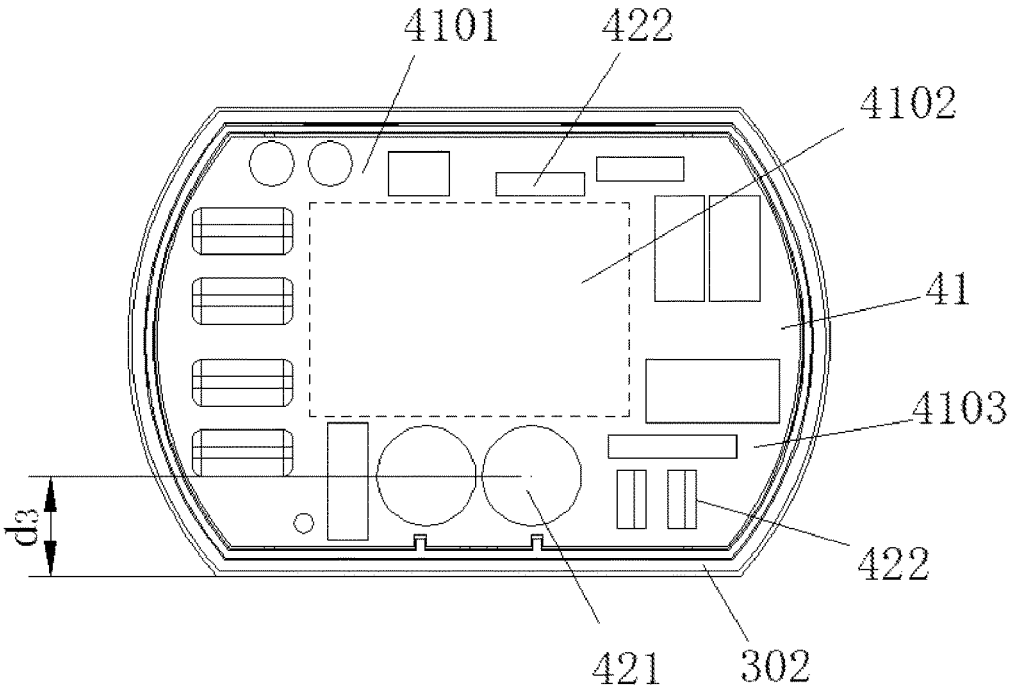
FIG. 44A illustrates a schematic diagram showing an array of electronic components laid out in a power supply of a lamp case according to an embodiment of the instant disclosure.
Figure 44B:
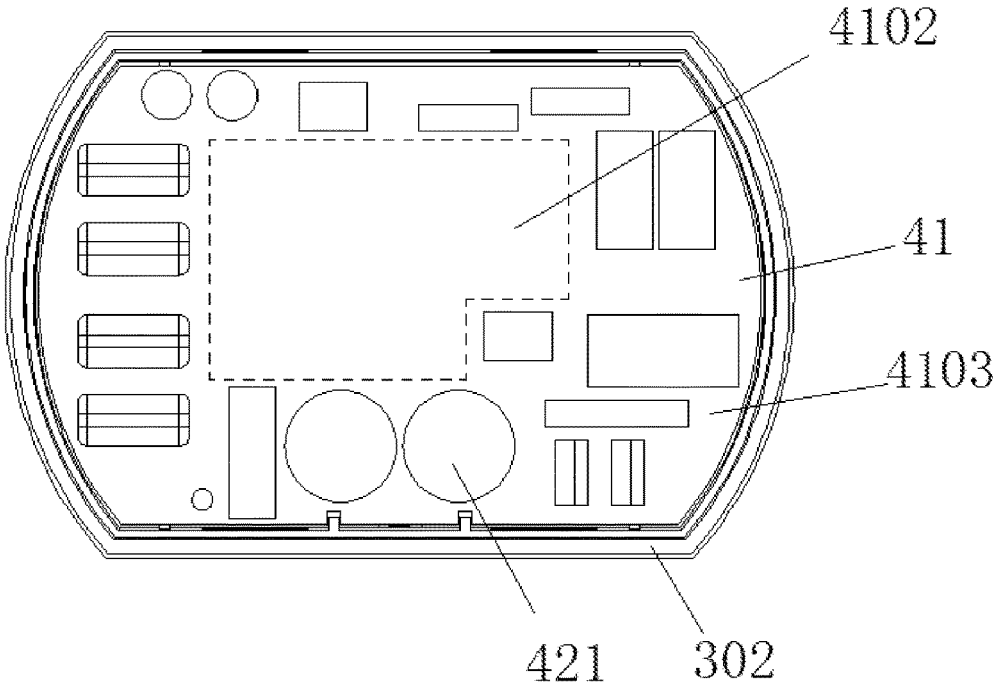
FIG. 44B illustrates a schematic diagram showing an array of electronic components laid out in a power supply of a lamp case according to some embodiments of the instant disclosure.

As shown in FIG. 44A and FIG. 44B, the first plane 4102 is composed of a circuit of electronic components closest to the center of the circuit board 41.

The area of the first plane 4102 accounts for at least 1/20 of the entire area of the first surface 4101, to lower the distributed capacity and accelerate the thermal dissipation. Due to the limitation of the internal space of the case, the area of the first plane 4102 accounts for less than 1/10 of the entire area of the first surface 4101.

Figure 44C:
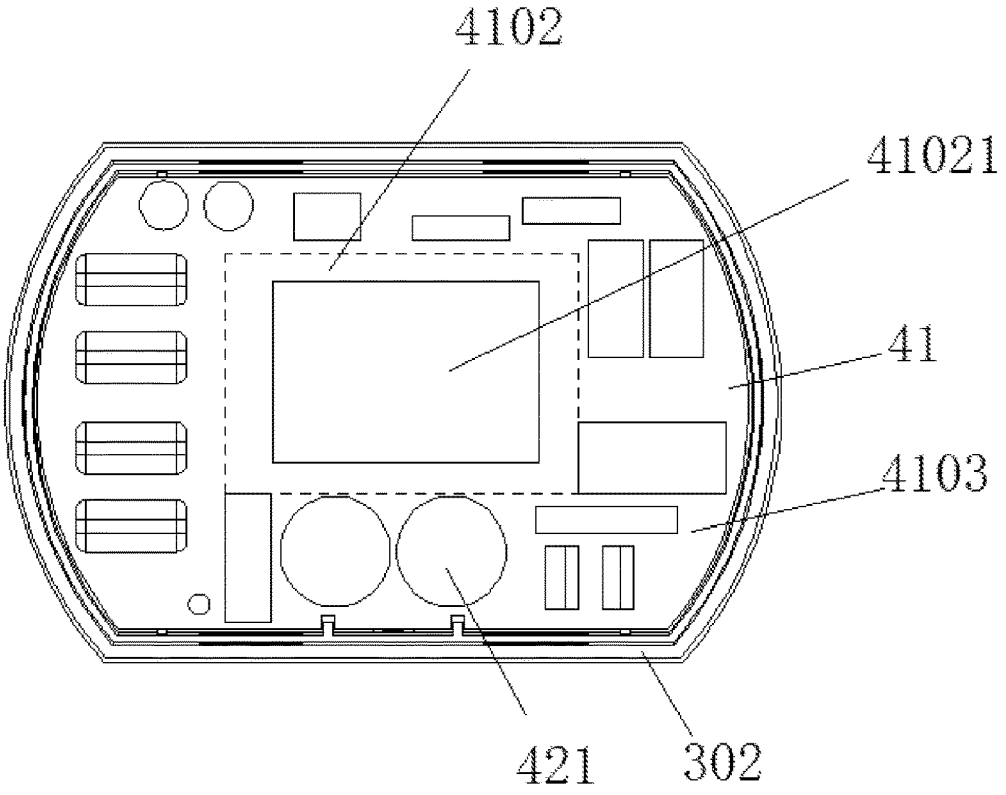
FIG. 44C illustrates a schematic diagram showing an array of electronic components laid out in a power supply of a lamp case according to some embodiments of the instant disclosure.

As shown in FIG. 44C, in some embodiments, the first plane 4102 has through holes 41021 disposed thereof, the thermal conduction material is coated to the first plane 4102, enabling the thermal conduction material to fully contact with the circuit board 41. The thermal conduction material passes through the circuit board 41 by through holes 41021, further accelerating the thermal dissipation, wherein the thermal conduction material penetrates the circuit board 41, reinforcing the fixation of the circuit board 41.

As shown in FIG. 1, FIG. 5, FIG. 10 and FIG. 44A, the case 3 has the conduction material 305 disposed therein, a part of the thermal conduction material 305 is coated to the corresponding area of the first plane 4102 (above the first plane 4102), forming a first thermal conduction portion, wherein a part of the thermal conduction material is coated to the area between the power supply 4 and the inner wall of the case 3 (the slits between the electronic components and the inner wall of the case 3), forming a second thermal conduction portion. The first thermal conduction portion and the second thermal conduction portion are partitioned by the electronic components, wherein the first thermal conduction portion and the second thermal conduction portion are provided with various thermal conduction paths. Heat generated from the operation of the electronic components of the outer second plane 4103 and the electronic components of the inner second plane 4103 is conducted in various paths, accelerating the thermal dissipation.

Figure 11:
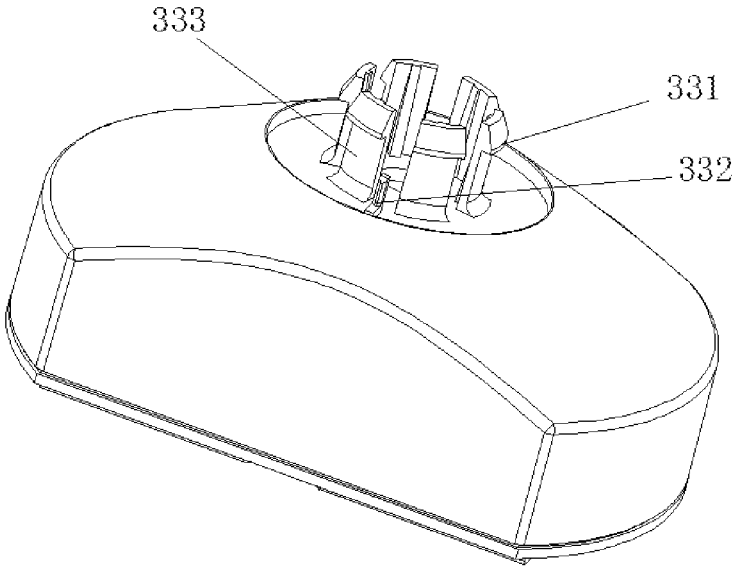
FIG. 11 illustrates a three-dimensional schematic diagram showing a structure of a second element according to an embodiment of the instant disclosure.
Figure 12:
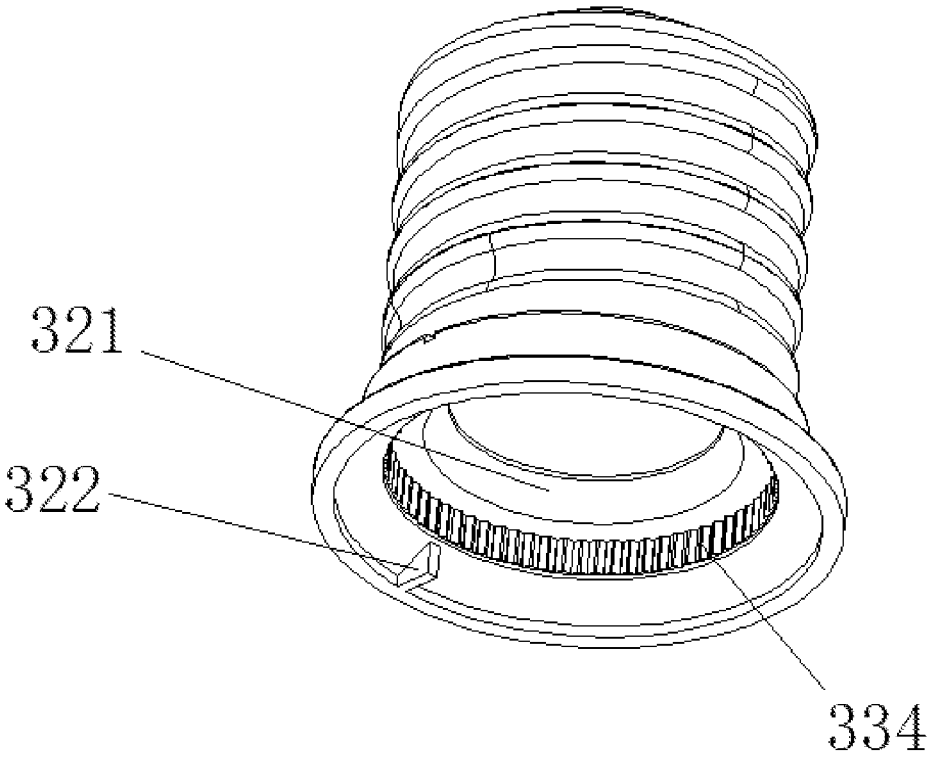
FIG. 12 illustrates a three-dimensional schematic diagram showing a structure of a first element according to an embodiment of the instant disclosure.

As shown in FIG. 10, FIG. 11, and FIG. 12, the case 3 comprises a first member 32 and a second member 33, and the lamp cap 71 is connected to be fixed to the first member 32. Specifically, the outer surface of the first member 32 has a structure matching with the internal thread 713 of the lamp cap 71 (e.g. the external thread of the outer surface of the first member 32). Therefore, the first member 32 and the second member 33 achieve a rotatable connection. When the lamp cap 71 is disposed in the lamp stand, the light emission directions of an LED lamp are adjusted by rotating the second member 33.

Specifically, the first member 32 has an annular concave portion 321, and the second member 33 has a convex portion 331. The convex portion 331 and the annular concave portion 321 coordinate with each other, wherein the convex portion 331 and the annular concave portion 321 are rotatable, achieving a rotatable connection of the first member 32 and the second member 33. In some embodiments, the first member 32 and the second member 33 achieves a rotatable connection by other structures of related arts, for example, the first member 32 is arranged as a convex portion and the second member 33 is arranged as an annular concave portion.

The first member 32 comprises a first baffle 322, and the second member 33 comprises a second baffle 332. The first baffle 322 and the second baffle 332 coordinate with each other. Specifically, the first member 32 and the second member 33 are rotated until abutted to the first baffle 322 and the second baffle 332, wherein the rotation of the first member 32 and the second member 33 are limited by the first baffle 322 and the second baffle 332 to prevent over rotation of the first member 32 and the second member 33 and the connection wire being pulled off.

In some embodiments, due to the arrangement of the first baffle 322 and the second baffle 332, the rotation angle of the first member 32 and the second member 33 is in a range of 0~355 degrees. In some embodiments, the rotation angle of the first member 32 and the second member 33 is in a range of 0~350 degrees. In some embodiments, the rotation angle of the first member 32 and the second member 33 is in a range of 0~340 degrees. The limitation of the rotation angle is arranged by the thickness in the circumferential direction of the first baffle 322 and the second baffle 332 (the angle occupied). In some embodiments, the first baffle 322 is a triangle, and the second baffle 332 is an L-shaped. It is perceptible the convex portions of the first baffle and the second baffle are in various shapes, as long as the first baffle 322 and the second baffle 332 stop the rotation of the first member 32 and the second member 33. In some embodiments, the first member 32 and the second member 33 achieves a rotatable connection by other structures of related arts, which is not further described in this paragraph.

The second member 33 comprises a plurality of pillars 333 disposed in a circumferential direction, and the adjacent pillars 333 are spaced from each other. The pillars 333 have the convex portion 331 formed on the top thereof, and the adjacent pillars 333 are spaced from each other, causing a deformation of the pillars 333 and enabling the pillars 333 to be inserted into the first member 32.

The first member 32 comprises a plurality of teeth 323 in a circumferential direction disposed thereof. The teeth 323 are disposed in a continuous manner or in a partitioned manner. The second member 33 has a damper portion 334 disposed thereof, wherein the damper portion 334 and the teeth 323 coordinate with each other. The damper portion 334 is formed on the second baffle 332 that is a part of the second baffle 332 is used to coordinate with the teeth 323, the other part is used to coordinate with the first baffle 322. By the coordination of the damper portion 334 and the teeth 323, the rotation quality of the first member 32 and the second member 33 is boosted. By the coordination of the damper portion 334 and the teeth 323, unnecessary release or even rotation without external forces is avoided.

The Third Portion III

Figure 9:
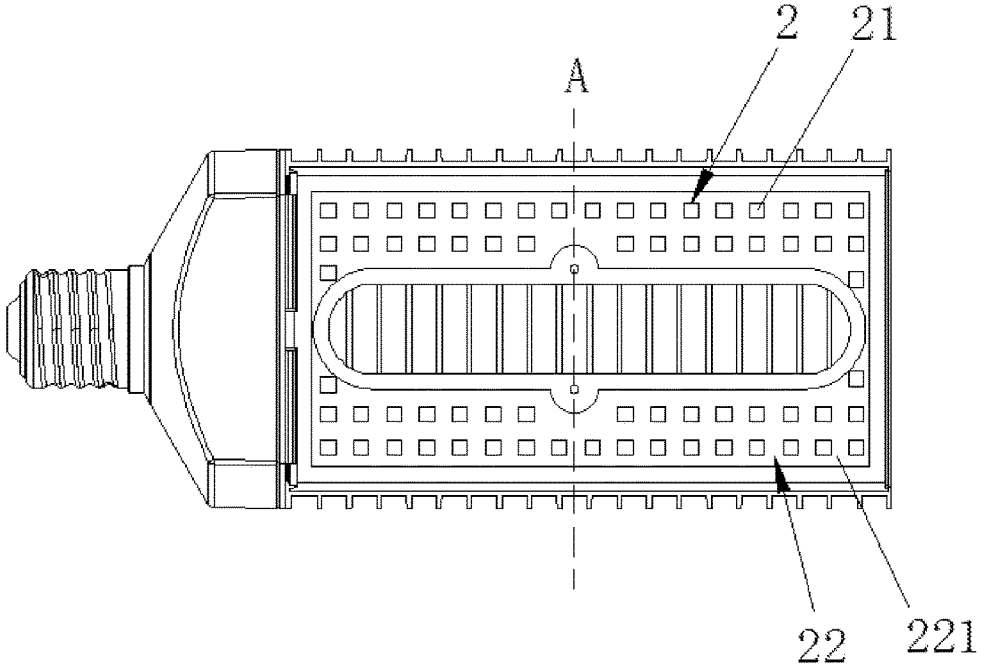
FIG. 9 illustrates a bottom schematic diagram showing FIG. 8 without a light output unit.

As shown in FIG. 1, FIG. 4 and FIG. 9, the third portion III has a heat exchange unit 1 and a light emission unit 2 disposed thereof. The heat exchange unit 1 and the light emission unit 2 are connected to form a thermal conduction path when the LED lighting device is in operating, heat generated from the light emission unit 2 is conducted to the heat exchange unit 1 in form of thermal conduction so that the thermal dissipation is executed by the heat exchange unit 1.

The heat exchange unit 1 is an integrated structure comprising a base 102 and cooling fins 101 connected to the base 102. The cooling fins 101 provide a thermal dissipation area to dissipate heat generated from the operation of the illuminator 21 (e.g. lamp beads of an LED lighting device), preventing overheating of the illuminator 21 (the temperature is over a normal range by operation, e.g. the temperature is over 120 degrees) and affecting the life of the illuminator 21.

The cooling fins 101 extends in a second direction Y, wherein the second direction Y is a width direction of an LED lighting device and is vertical to the first direction X. When the cooling fins 101 are disposed in the second direction Y, the length of the cooling fins 101 disposed in the second direction Y is shorter (compared to the length of the cooling fins 101 disposed in the first direction X). Therefore, two cooling fins 101 have a convection path configured there between, assuming air is convected forward in a width direction of an LED lighting device, the two cooling fins 101 have a shorter convection path, accelerating the thermal dissipation of the cooling fins 101. In some embodiments, the cooling fins 101 are horizontally disposed and arranged evenly in the first direction X.

The weight of the heat exchange unit 1 is arranged evenly or roughly evenly in the first direction X. In some embodiments, the ratio of either intercept of the heat exchange unit 1 to either intercept of the same length of the heat exchange unit is 1:0.8~1.2 (both the intercepts of the exchange unit 1 have the same or roughly the same quantity of the cooling fins 101).

The space between the cooling fins 101 is in a range of 8~30 mm. In some embodiments, the space between the cooling fins 101 is in a range of 8~15 mm, wherein the space is determined according to radiation and convection of thermal dissipation.

In order to arrange sufficient area for thermal dissipation of the LED lighting device and lower the effect the moment on the connection portion (e.g. lamp cap 71) in a condition that the LED lighting device is installed horizontally, in some embodiments, the heat exchange unit 1 is arranged in asymmetrical shapes. Any two of the cooling fins 101 in the first direction X, the cooling fin 101 closer to the lamp cap 71 has more thermal dissipation area (the height of the cooling fin 101 proximate the lamp cap 71 is greater, wherein the cooling fin has more area for thermal dissipation).

In some embodiments, the cooling fins 101 have a first piece disposed proximate the base 102 and a second piece disposed away from the base 102, in a height direction. The cross-sectional thickness of either position of the first piece is greater than the cross-sectional thickness of either position of the second piece. In some embodiments, the height of the cooling fins 101 is divided into two pieces of the same height, the first piece and the second piece. The lower portion of the cooling fins 101 mainly conduct heat generated from the operation of the light emission unit 2, and the upper portion of the cooling fins mainly radiate the heat to the air around. The cross-sectional thickness of the cooling fins 101 proximate the thermal dissipation substrate (the first piece) is larger, and the cross-sectional thickness of the cooling fins 101 away from the thermal dissipation substrate (the second piece) is smaller, enabling the first piece to conduct the heat generated from the operation of the light emission unit 2 to the cooling fins 101, alleviating the weight of the entire LED lighting device under the premise that thermal radiation is executed. In general, the arrangements of the above achieve well thermal dissipation and alleviate the weight of the entire LED lighting device.

Heat generated from the operation of the light emission unit 2 is conducted to the cooling fins 101, wherein heat of the cooling fins 101 is conducted from bottom to top (assuming an LED lighting device is installed horizontally). A part of heat of the cooling fins 101 in the process of the thermal conduction is conducted in form of radiation to the air around, that is the upper the position of the cooling fins 101, less heat is conducted by the cooling fins 101. Fourier's law is: $Q=-\lambda AdT/dx$; wherein $\lambda$ is the thermal conductivity, A is the cross-section area of thermal conduction, the unit is $m^2$, dT/dx is a temperature gradient in a direction of heat flux, the unit is K/m.

In some embodiments, assuming $\lambda$ is a determined value T (in a condition that the material of the cooling fins 101 is determined, $\lambda$ is a constant), the heat flux Q is determined by the cross-section area of thermal conduction and the temperature gradient in the direction of heat flux. In some embodiments, ignoring the variation of the temperature gradient, the heat flux Q is determined by the cross-section area of the thermal conduction. Heat of the cooling fins 101 is conducted in the process of thermal conduction in form of radiation, wherein the later the position of the cooling fins 101 in the direction of heat flux, the less heat of the cooling fins 101. The thickness of the cooling fins 101 is adjusted (assuming the width of the cooling fins 101 is a determined value, the deviation of the width of the cooling fins 101 in the height direction is less than 30%), under the premise that the thermal dissipation is executed, the moment of the lamp cap 71 is lowered.

Figure 3:
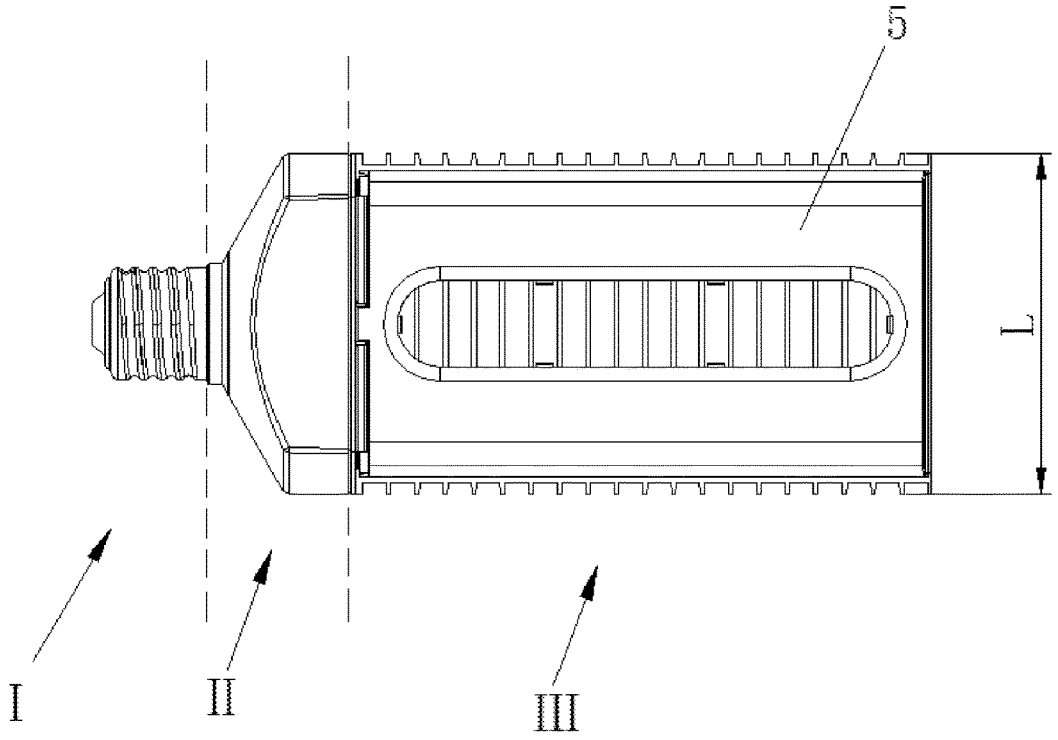
FIG. 3 illustrates a bottom schematic diagram in FIG. 1.

As FIG. 1 and FIG. 3, in some embodiments, a plurality of cooling fins 101 are disposed, to illustrate, the thickness of a set of cooling fins 101 is described herein, establish a coordinate system, the bottom of the cooling fins 101 in the thickness direction as an X axis, the cooling fins 101 in the height direction as a Y axis, wherein the thickness and the height of the cooling fins 101 satisfy the following formula: y=ax+K;

wherein y is the height of the cooling fins 101, a is a constant, wherein a is a negative number, x is the thickness of the cooling fins 101, K is a constant.

In a condition that a is a negative number, the value of the height of the cooling fins 101 increases, the value of the thickness of the cooling fins decreases. Heat is dissipated by the cooling fins 101 in form of radiation, the upper the position of the cooling fins 101, the smaller the thickness of the cooling fins 101. The demand of the thermal conduction is satisfied, the thickness of the cooling fins 101 is smaller in an upward direction, alleviating the weight of the cooling fins 101, lowering the moment of the lamp cap 71, providing a dexterous weight design.

In some embodiments, the value of a is between −40~−100, the value of K is between 80~150, the unit of x is millimeter, the unit of y is millimeter.

In some embodiments, the value of a is between −50~−90, the value of K is between 100~140.

In some embodiments, the cooling fins 101 are arranged similarly, the quantity of the cooling fins 101 is n, in general, the sum of the thickness of the cooling fins 101 (the sum of the thickness of all cooling fins 101) and the height of the cooling fins 101 satisfy the following formula:

$$sn=(y-K)n/a;$$

wherein y is the height of the cooling fins 101, a is a constant, wherein a is a negative number, x is the thickness of the cooling fins 101, x*n is the sum of the thickness of the cooling fins 101.

In some embodiments, the cross-section area of the cooling fins 101 equals to the thickness of the cooling fins 101 multiplied by the width of the cooling fins 101, assuming the width of the cooling fins 101 is a determined value L (the width of the cooling fins 101 herein is a determined value referring to the deviation of the width of the cooling fins 101 in a height direction is less than 30%), the thickness of the cooling fins 101 and the height of the cooling fins 101 satisfy the following formula: y=ax+K, scilicetx=(y−K)/a;

that is, the cross-section area of the cooling fins is Lx=(y−K)L/a;

wherein y is the height of the cooling fins 101, a is a constant, wherein a is a negative number, x is the thickness of the cooling fins 101, K is a constant.

In a condition that a is a negative number, the height y of the cooling fins 101 increases, the cross-section area of the cooling fins 101 decreases. Heat is dissipated by the cooling fins 101 in form of radiation, the upper the position of the cooling fins 101, the smaller the cross-section area of the cooling fins 101. In order to meet the demand of the thermal conduction, the cross-section area of the cooling fins 101 is smaller in an upward direction, which is also to alleviate the weight of the cooling fins 101, lower the moment of the lamp cap 71, and provide a dexterous weight design.

In some embodiments, the sum of the cross-section area of the cooling fins 101 (the sum of the cross-section area of all cooling fins 101) equals to the sum of the thickness of the cooling fins 101 multiplied by the width of the cooling fins 101, among all cooling fins 101, assuming the width of the cooling fins 101 is a determined value L (the width of the cooling fins 101 herein is a determined value referring to the deviation of the width of the cooling fins 101 in the height direction is less than 30%), the sum of the cross-section area of the cooling fins 101 satisfies the following formula: nLx=(y−K)nL/a;

wherein n is the quantity of the cooling fins 101.

In a condition that a is a negative number, the height y of the cooling fins 101 increases, the cross-section area of the cooling fins 101 decreases. Heat is dissipated by the cooling fins 101 in form of radiation, the upper the position of the cooling fins 101, the smaller the cross-section area of the cooling fins 101. Meeting the demand of the thermal conduction, the cross-section area of the cooling fins 101 is smaller in an upward direction, alleviating the weight of the cooling fins 101, lowering the moment of the lamp cap 71, and providing a dexterous weight design.

In the above embodiments, considering the thickness of the cooling fins 101, a chamfer or a fillet of an end portion of the cooling fins should be excluded.

In some embodiments, the ratio of the thermal dissipation area of the cooling fins 101 of an LED lighting device (the unit is $CM^2$) to the power of an LED lighting device (the unit is watt) is less than 28. In some embodiments, the weight limitation of the heat exchange unit 1 is 0.6 kg, 0.7 kg, 0.8 kg or 0.9 kg, wherein the thermal dissipation area of the cooling fins 101 is arranged, the thickness of the cooling fins 101 is arranged, etc.

In some embodiments, the thermal dissipation area of a single cooling fin 101 is similar to the side area of the cooling fin 101 plus the area of the thickness section of the cooling fin 101 (the top area of the cooling fin 101 is rather small, overall the top area of the cooling fin 101 can be neglected), the formula is as below:

$$S=S1+S2;S1=2hLn;$$

wherein h is the height of the cooling fin 101, L is the length of the cooling fin 101 (if the side portion of the cooling fin is an irregular shape, the length herein is referring to the average length of the cooling fin 101), S is the sum of the thermal dissipation area of a single cooling fin 101, S1 is the side area of the cooling fin 101, S2 is the area of the thickness section of the cooling fin 101, n is the quantity of the cooling fin 101.

The thickness section of the cooling fin 101 is a trapezoid. The area of the thickness section of the cooling fin 101 similarly equals to the bottom thickness of the cooling fin 101 plus the top thickness of the cooling fin 101 multiplied by the height of the cooling fin 101, combined with the formula of the thickness and the height of the cooling fin 101, y=ax+K, wherein it is perceptible that the bottom thickness y is value x of zero, the top thickness y is value x of h, wherein the thickness section of the cooling fin 101 satisfies the following formula:

$$S2=[-K/a+(h-K)/a]hn;$$

thus, S=2hLn+[−K/a+(h−K)/a]hn=2hLn+[(h−2K)/a]hn

In some embodiments, to ensure the radiation efficiency of the cooling fins 101 meets the demand of thermal dissipation of the LED lighting device and to limit the weight of the heat exchange unit 1 at the same time, the ratio of the thermal dissipation area S of the cooling fins 101 of the LED lighting device (the unit is $CM^2$) to the power P of the LED lighting device (the unit is watt) is less than 28, and more than 18, that is 18<S/P<28, scilicet 18<2hLn/P+[(h−2K)/a]hn/p<28, wherein in the ratio, the luminous efficiency of the LED lighting device reaches at least 125 lumens per watt.

In some embodiments, in order to limit the moment of the lamp cap 71, it is necessary to limit the weight of the cooling fins 101. In some embodiments, the weight of the cooling fins 101 is less than 0.4 kg, 0.5 kg, 0.6 kg, 0.7 kg, 0.8 kg or 0.9 kg, which is under the premise of the weight limitation, the thickness of the cooling fins 101 and the thermal dissipation area of the cooling fins 101 satisfy the above formula should be ensured.

Figure 13:
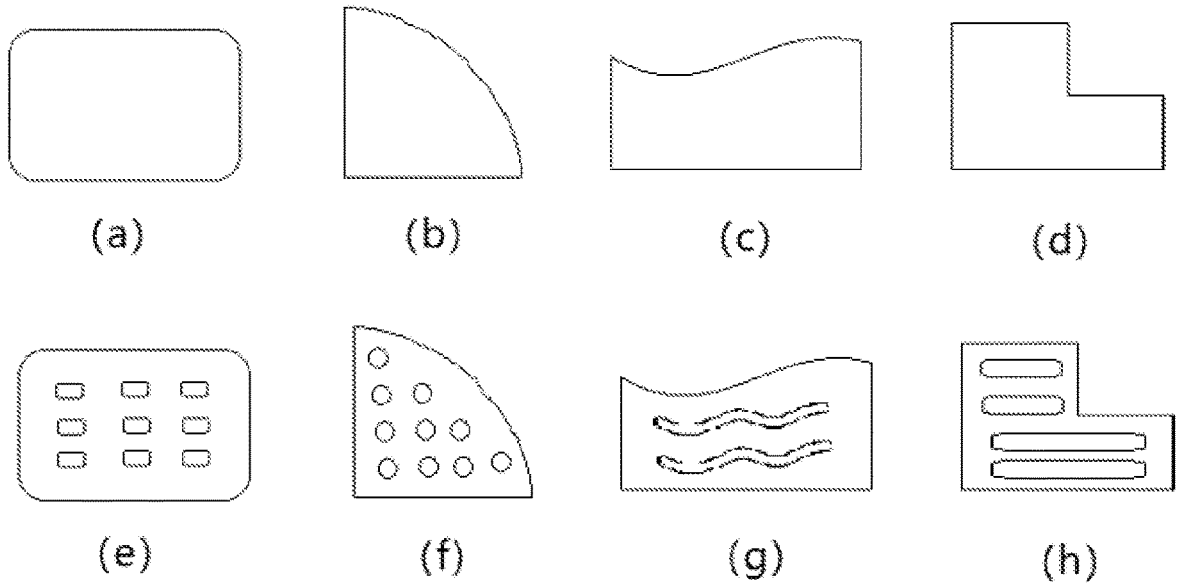
FIG. 13 illustrates a schematic diagram showing various shapes of cooling fins according to some embodiments of the instant disclosure.
Figure 19:
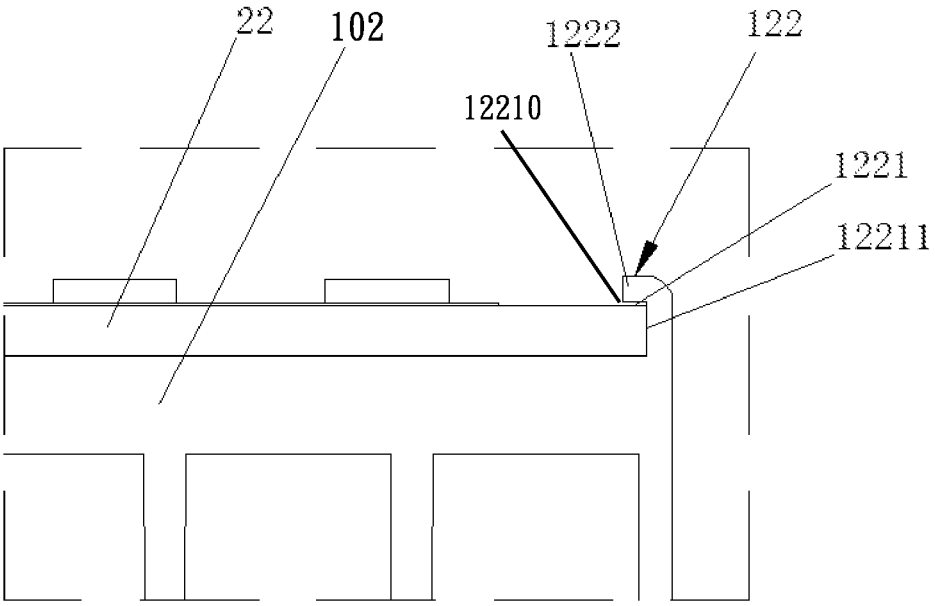
FIG. 19 illustrates a zoom-in diagram showing area C in FIG. 17.

As shown in FIG. 13, in some embodiments, the shapes of the cooling fins 101 is arranged as a square, a sector, an arc a curve, etc. one of the above shapes or multiple of the above shapes combined. The cooling fins 101 is a convex shape high in the middle, low on both sides, or low in the middle, high on both sides. At least one of the cooling fins 101 is a continuous integrated structure or a combination of a plurality of discontinuous cooling fins 101, the surface of at least one of cooling fins 101 has guide grooves or through holes disposed thereof, boosting the disturbance effect of heat flux, accelerating thermal dissipation. Please refer to FIG. 19. A schematic diagram illustrates the cooling fins are in various shapes, as shown in elements (a)-(d), and the cooling fins have through holes and guide grooves disposed thereof as shown in elements (e)-(h) in an embodiment of the instant disclosure.

In some embodiments, to increase the radiance or emissivity of the cooling fins 101 (to increase the emissivity of the surface of the cooling fins 101), the surface of the cooling fins 101 is arranged. For example, the cooling fins 101 has a thermal dissipation unit on the surface thereof to increase the emissivity of the surface of the cooling fins 101, wherein the thermal dissipation unit is paint or high emissivity coatings (HECs) (mainly silicon carbide (SiC), carbon nanotubes (CNTs), etc.) to increase thermal radiation and dissipate the heat of the cooling fins 101 quickly. The thermal dissipation unit is a porous alumina layer by anodized in an electrolyte forming a nano structure on the surface of the cooling fins, wherein a layer of alumina nano pore is formed on the surface of the cooling fins, without increasing the quantity of the cooling fins, the thermal dissipation of the heat spreader is boosted. The thermal dissipation unit is coated with graphene, a two-dimensional carbon nano material made of a hexagon beehive lattice formed by carbon atoms, having outstanding features of optics, electricity mechanics, wherein the thermal conductivity reaches 5300 W/m·k, excellent for thermal dissipation of an LED lighting device. In some embodiments, the surface of the cooling fins has a thermal dissipation unit, wherein the emissivity is greater than 0.7, increasing the thermal radiation of the surface of the cooling fins.

Figure 14:
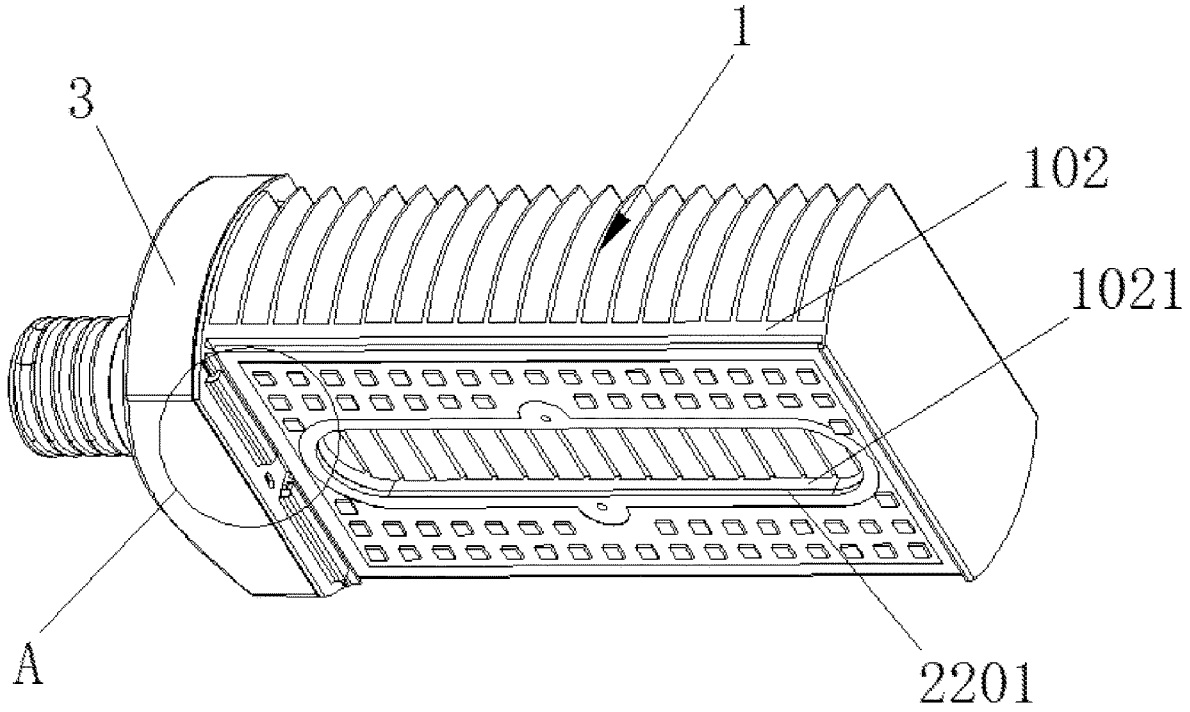
FIG. 14 illustrates a three-dimensional schematic diagram showing a structure of the LED lighting device without a light output unit in FIG. 1.
Figure 15:
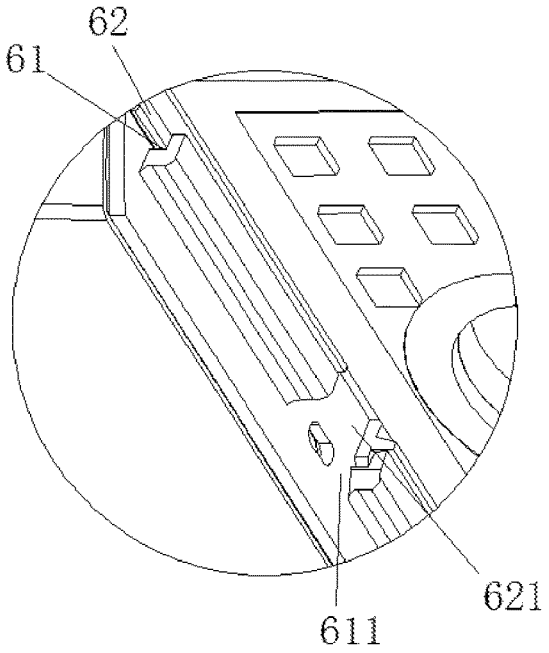
FIG. 15 illustrates a zoom-in diagram showing area A in FIG. 14.
Figure 16A:
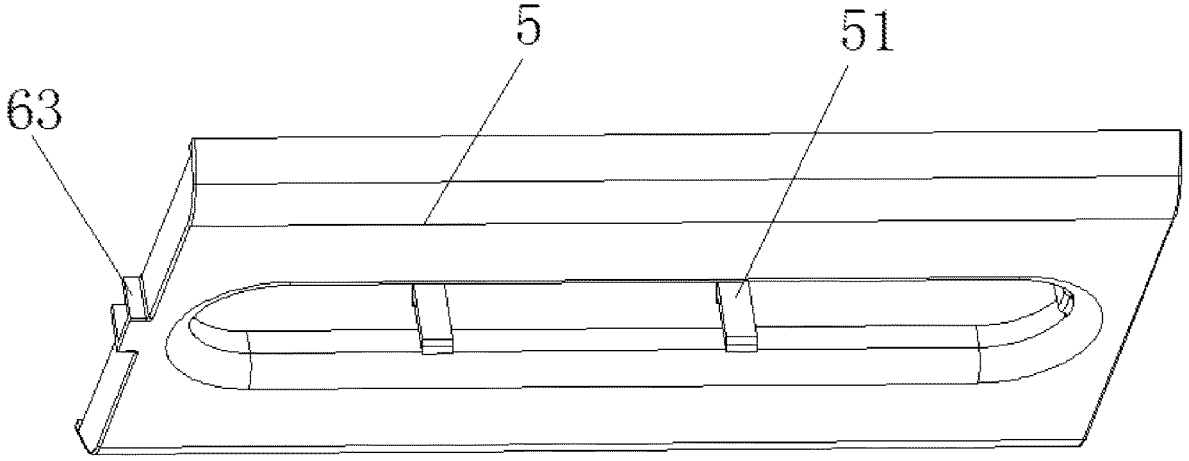
FIG. 16A illustrates a three-dimensional schematic diagram showing a structure of a light output unit in FIG. 1.
Figure 16B:
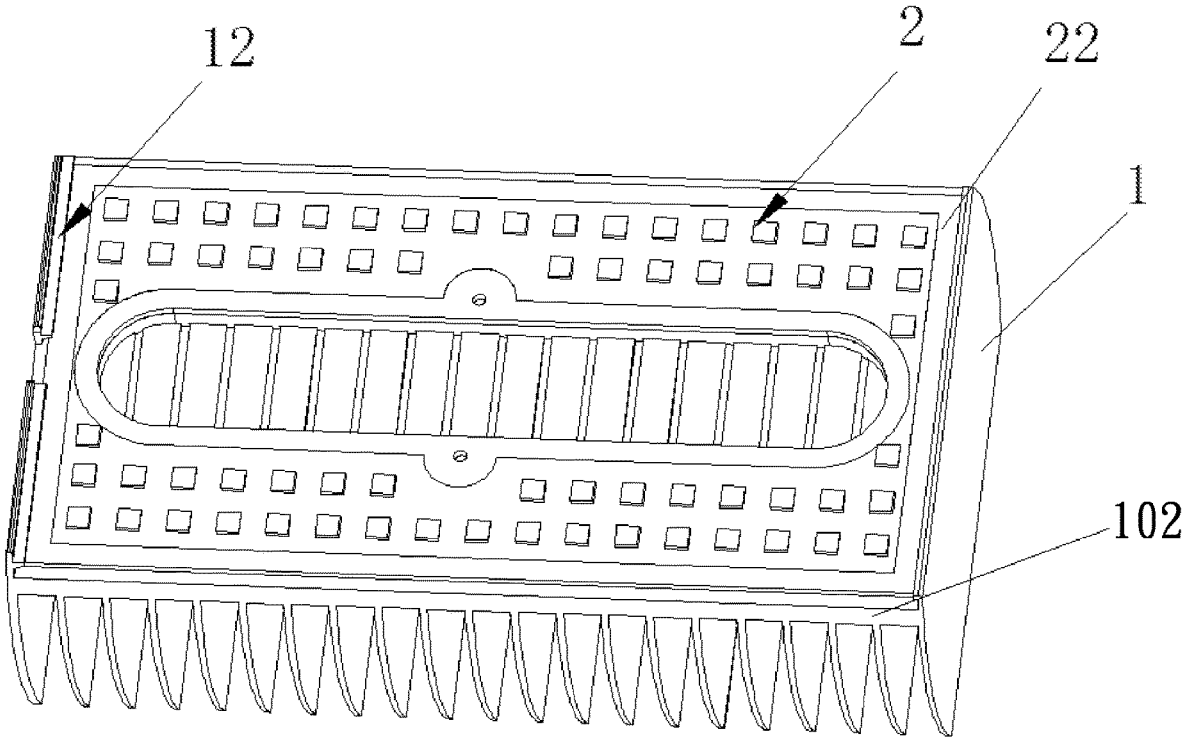
FIG. 16B illustrates a three-dimensional schematic diagram showing a structure of a heat exchange unit in FIG. 1.

As shown in FIG. 1, FIG. 4, and FIG. 14, in some embodiments, the substrate 22 and the base 102 of the heat exchange unit 1 are fixed for forming a thermal conduction path. To promote thermal dissipation, the substrate 22 has through holes 2201 disposed thereof, in operation of the LED lighting device, heat of both sides of the substrate 22 are conducted by the through holes 2201, accelerating thermal dissipation of the heat exchange unit 1 in form of convection. The base 102 of the heat exchange unit 1 has convection opening 1021 corresponding to the through holes 2201. In some embodiments, if the thermal dissipation satisfies the LED lighting device, it is not necessary for the substrate 22 to have the through holes 2201 disposed thereof.

As shown in FIG. 1, FIG. 4 and FIG. 5, in some embodiments, the illuminator 21 is disposed in the substrate 22 electrically connected to the power supply 4. In some embodiments, the illuminators 21 are connected in parallel, in series, or in series parallel. In some embodiments, the substrate 22 is an aluminum substrate, mainly made of aluminum, and the base 102 of the heat exchange unit 1 is made of aluminum material. In a condition that the substrate 22 and the heat exchange unit 1 are made of the same material, both have the same or roughly the same shrinkage, that is under long-term use of the LED lighting device, the substrate 22 and the heat exchange unit 1 don't show various shrinkages because of alternating hot and cold temperatures, preventing the illuminators 21 loosen in the substrate 22.

Figure 8:
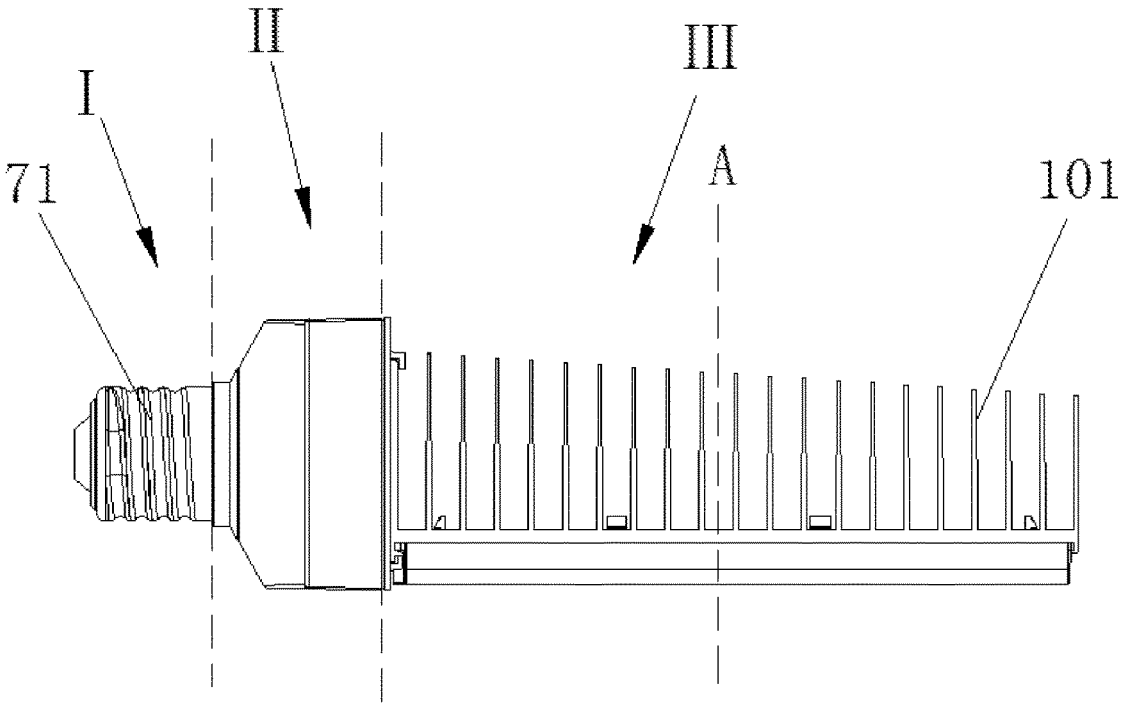
FIG. 8 illustrates a schematic diagram showing a structure of an LED lighting device according to an embodiment of the instant disclosure.

As shown in FIG. 8 and FIG. 9, in some embodiments, a plurality of illuminators 21 are disposed in the substrate 22. The third portion III is a plane A (the plane A is vertical to the axle of the lamp cap 71), divided into the first region and the second region (the length of the first region or the second region in a longitudinal direction of the LED lighting device accounts for more than 30% of the entire length of the third portion III, excluding some extreme circumstances, e.g. the first region is an area of an end of the third portion III without illuminators 21). The quantity of the illuminators 21 of the first region is $X_1$; the quantity of the illuminators 21 of the second region is $X_2$. The thermal dissipation area of the cooling fins 101 of the first region is $Y_1$; the thermal dissipation area of the cooling fins 101 of the second region is $Y_2$, wherein the thermal dissipation area of the cooling fins 101 and the quantity of the illuminators 21 satisfy the following formula: $X_1/X_2$: $Y_1/Y_2$=0.8~1.2

The ratio of the above formula is between 0.8~1.2, ensuring the illuminators 21 to be provided with corresponding sufficient thermal dissipation area for thermal dissipation, especially in a condition that the third portion III has difference in distribution of the illuminators 21 or distribution of thermal dissipation area, preventing the difference from being too large that the thermal dissipation of some illuminators 21 is influenced.

As shown in FIG. 8 and FIG. 9, in some embodiments, a plurality of illuminators 21 are disposed on the substrate 22. The third portion III is a plane A (the plane A is vertical to the axle of the lamp cap 71), divided into the first region and the second region (the length of the first region or the second region in a longitudinal direction of the LED lighting device accounts for more than 30% of the entire length of the third portion III, excluding some extreme circumstances, e.g. the first region is an area of an end of the third portion III without illuminators). The sum of luminous flux of the first region is $N_1$; the quantity of the illuminators 21 of the second region is $N_2$. The thermal dissipation area of the cooling fins 101 of the first region is $Y_1$; the thermal dissipation area of the cooling fins 101 of the second region is $Y_2$, wherein the thermal dissipation area of the cooling fins 101 and the quantity of the illuminators 21 satisfy the following formula:

$$N_1/N_2:Y_1/Y_2=0.8\sim1.2$$

The ratio of the above formula is between 0.8~1.2, ensuring a certain amount of luminous flux is emitted, the illuminators 21 are provided with corresponding sufficient thermal dissipation area for thermal dissipation, especially in a condition that the third portion III has difference in distribution of luminous flux of the first region and the second region or distribution of thermal dissipation area, preventing the difference is so big that the thermal dissipation of some illuminators 21 is influenced.

In some embodiments, the substrate 22 is a PCB (printed circuit board), an FPC (flexible circuit board) or an aluminum substrate, to illustrate, the substrate 22 has a control circuit, enabling the substrate 22 to control the illuminators 21 to achieve various functions of users' expectations.

As shown in FIG. 14, FIG. 15, FIG. 16A, FIG. 16B and FIG. 17, in some embodiments, the case 3 and the heat exchange unit 1 is connected by a fix unit 6. The fix unit 6 comprises a first member 61, a second member 62, and a position unit 63. The first member 61 disposed in the case 3 and the second member 62 disposed in the heat exchange unit 1 are in a slide connection. In some embodiments, the first member 61 having a chute is disposed in the heat exchange unit 1 and the second member 62 having a guide rail is disposed in the case 3.

The position unit 63 is used in coordination between the first member 61 and the second member 62 to fix the positions of the first member 61 and the second member 62. At this time, the heat exchange unit 1 and the case 2 are fixed. The first member 61 and the second member 62 have position grooves 611, 621 respectively disposed thereof, wherein the position unit 3 matches with the position grooves 611, 621, limiting the slide between the first member 61 and the second member 62. In some embodiments, the position 63 unit is disposed in the light output unit 5.

The light output unit 5 has a fastening device disposed thereon, in some embodiments, the fastening device is a snap-fit 51. The light output unit 5 is interlocked in the heat exchange unit 1 to fix the light output unit 5. In some embodiments, the light output unit 5 is connected by a latch, a thread, etc., to fix in the heat exchange unit 1.

In some embodiments, the light output unit 5 has an optical device disposed thereof, and the optical device has optical elements disposed thereof to provide either of adequate combinations of reflection, refraction and/or diffusion, e.g. reflective devices, diffusive devices, etc. In some embodiments, the optical device has optical elements disposed thereof to increase the transmission of luminous flux of the light output unit 5, e.g. anti-reflection films. In some embodiments, the optical device has optical elements disposed thereof to adjust optics, e.g. lens, reflective devices, etc.

Figure 17:
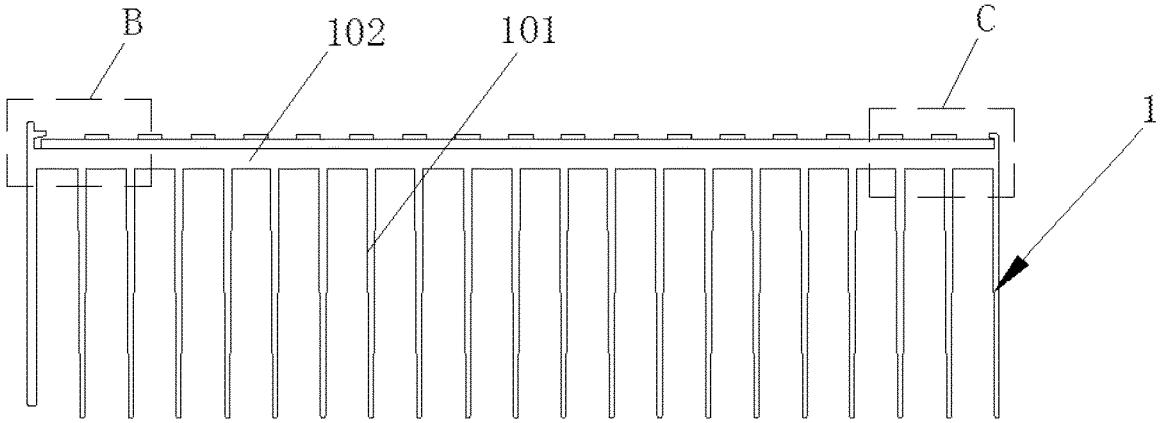
FIG. 17 illustrates a schematic diagram showing a coordination between a thermal mitigation unit and a light emission unit according to an embodiment of the instant disclosure.

As shown in FIG. 17, a schematic diagram illustrates the coordination of the cooling fins 101 and the illuminators 21. The illuminators 21 are disposed on a plane, the distance from either of the illuminators 21 to the adjacent cooling fins 101 (the cooling fins 101 are projected to the plane where the illuminators 21 are located, the distance between the cooling fins 101 and the illuminators 21) is greater than the distance from the illuminator 21 to either of the illuminators 21. From the perspective of thermal conduction path, the heat generated from the illuminators 21 is conducted more quickly to the adjacent cooling fins 101, lowering the influence of the heat generated from the illuminators 21 to other illuminators 21.

Figure 45:
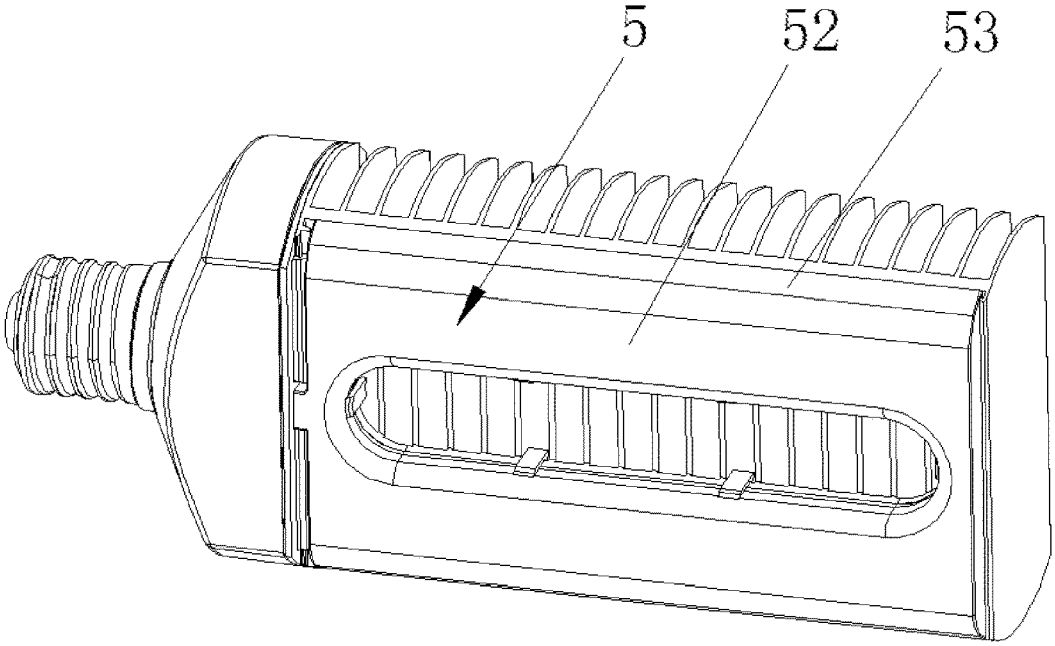
FIG. 45 illustrates a three-dimensional diagram showing a structure of an LED lighting device according to an embodiment of the instant disclosure.
Figure 46:
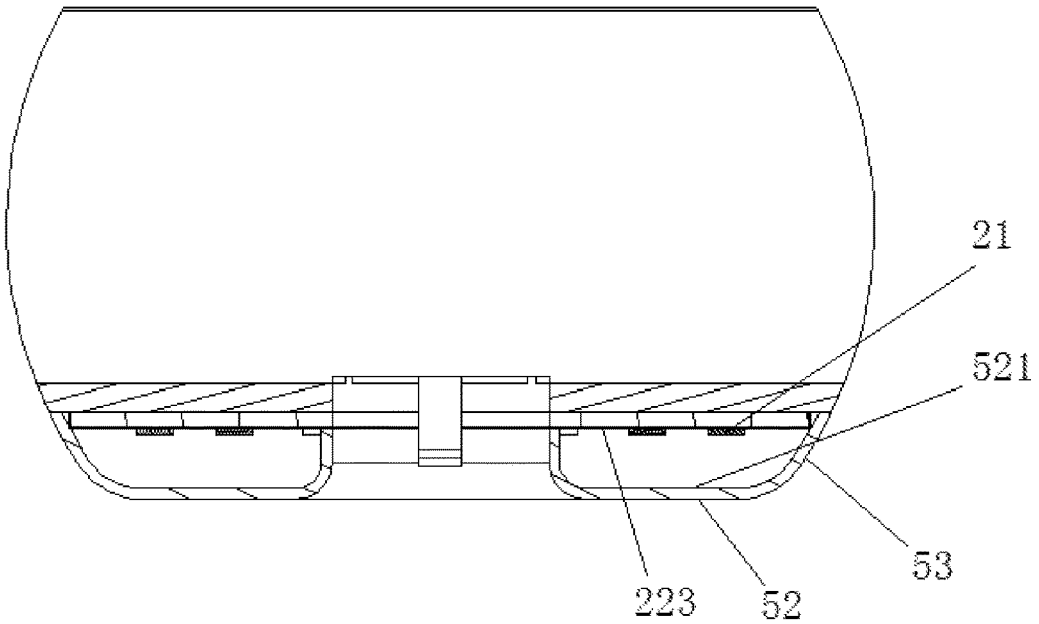
FIG. 46 illustrates a cross-section diagram I showing an LED lighting device according to an embodiment of the instant disclosure.

As shown in FIG. 45 and FIG. 46, in some embodiments, the light output unit 5 comprises a first light emission zone 52 and a second light emission zone 53. The first light emission zone 52 receives the light directly emitted from the operation of illuminator 21 (the light without reflection), and at least a part of the light emitted directly from the illuminator 21 is emitted from the first light emission zone 52. The second light emission zone 53 receives the light reflected, and at least a part of the light reflected is emitted from the second light emission zone 53.

In some embodiments, an LED lighting device has a reflective device disposed thereof, and at least a part of the light generated from the operation of the illuminator 21 is reflected once or multiple times by the reflective device and then is emitted from the second light emission zone 53. The sum of luminous flux of the second light emission zone 53 accounts for 0.01%~40% of the sum of luminous flux of the illuminators 21. In some embodiments, the sum of luminous flux of the second light emission zone 53 accounts for 1%~10% of the sum of luminous flux of the illuminators 21, to solve the problem of dazzling caused by partial glare, and achieving a more even light emission. In some embodiments, the average flux of the second light emission zone 53 accounts for at least more than 0.01% and less than 35% of the average flux of the first light emission zone 52. In some embodiments, the average flux of the second light emission zone 53 accounts for 1%~20% of the average flux of the first light emission zone 52.

In some embodiments, the reflective device comprises a first reflective surface 521 for reflecting at least a part of the light emitted directly from the illuminators 21. In some embodiments, the reflective device further comprises a second reflective surface 223 for receiving the light reflected from the first reflective surface 521 and reflecting at least a part of the light reflected from the first reflective surface 521 to the second light emission zone 53.

In some embodiments, the first reflective surface 521 is disposed in the inner surface of the first light emission zone 52. The first reflective surface 521 may be coated on the inner surface of the first light emission zone 52, enabling a part of the light to transmit and a part of the light to reflect. In some embodiments, the first reflective surface 521 is the inner surface of the first light emission zone 521, due to the material of the first light emission zone 52, the first reflective surface 521 has transmission and reflection functions. In the above embodiments, the ratio of the luminous flux reflected from the first reflective surface 521 to the luminous flux transmitted from the first reflective surface 521 is between 0.003~0.1. In a condition that due to the material of the first light emission unit 52, the first reflective surface has functions of transmission and reflection, the refractive index of the first light emission zone 52 is between 1.4~1.7, to reach a better transmission and reflection of the first reflective surface 521.

The second reflective surface 223 is disposed in the surface of the substrate 22 of the light emission unit 2. In some embodiments, the surface of the substrate 22 is coated to form the second reflective surface 223, and the second reflective surface 223 is made of material having reflective function, which is not further described in this paragraph.

In some embodiments, the sum of the transmittance of an LED lighting device (the ratio of the light transmitted from the light output unit 5 to the light emitted from the illuminators 21) is more than 90%. In some embodiments, the sum of the transmittance of an LED lighting device (the ratio of the light transmitted from the light output unit 5 to the light emitted from the illuminators 21) is more than 93%. In some embodiments, the luminous efficiency of an LED lighting device is more than 130 lumens per watt.

In some embodiments, in to order to increase the transmittance of an LED lighting device, the light output unit 5 has an anti-reflective coating disposed thereof, lowering the reflection from the light emission to the light output unit 5, increasing the transmittance, and enabling the luminous efficiency of an LED lighting device to reach at least 135 lumens per watt.

Figure 47:
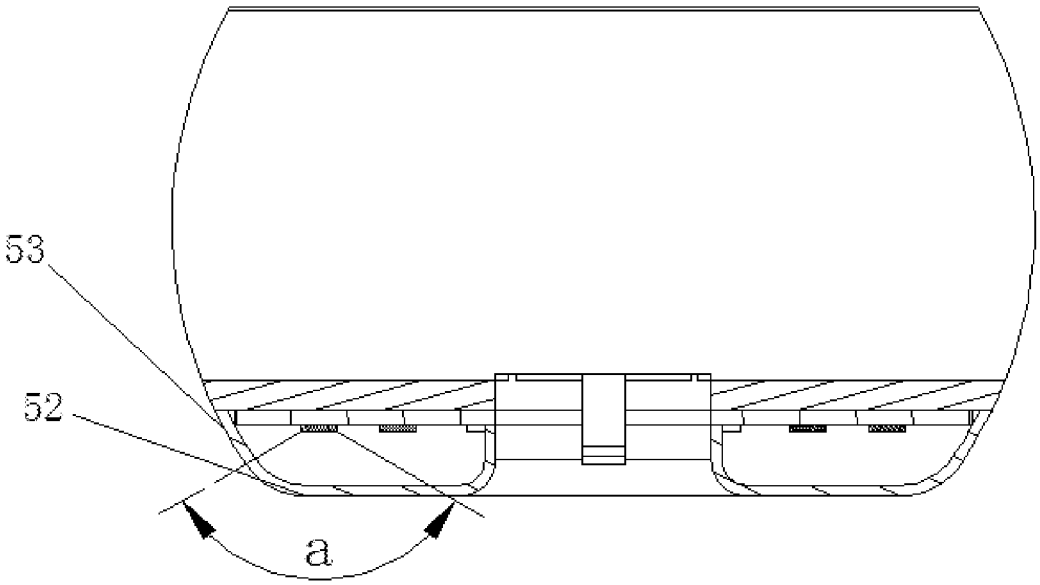
FIG. 47 illustrates a cross-section diagram II showing an LED lighting device according to an embodiment of the instant disclosure.

As shown in FIG. 47, the first light emission zone 52 and the second light emission zone 53 are divided as below, the light emission angle of the illuminator 21 is a, wherein the light emitted directly from the illuminator 21 projecting to an area of the light output unit 5 is referring to the first light emission zone 52, and the other areas of the light output unit 5 emitting light is referring to the second light emission zone 53.

Figure 48:
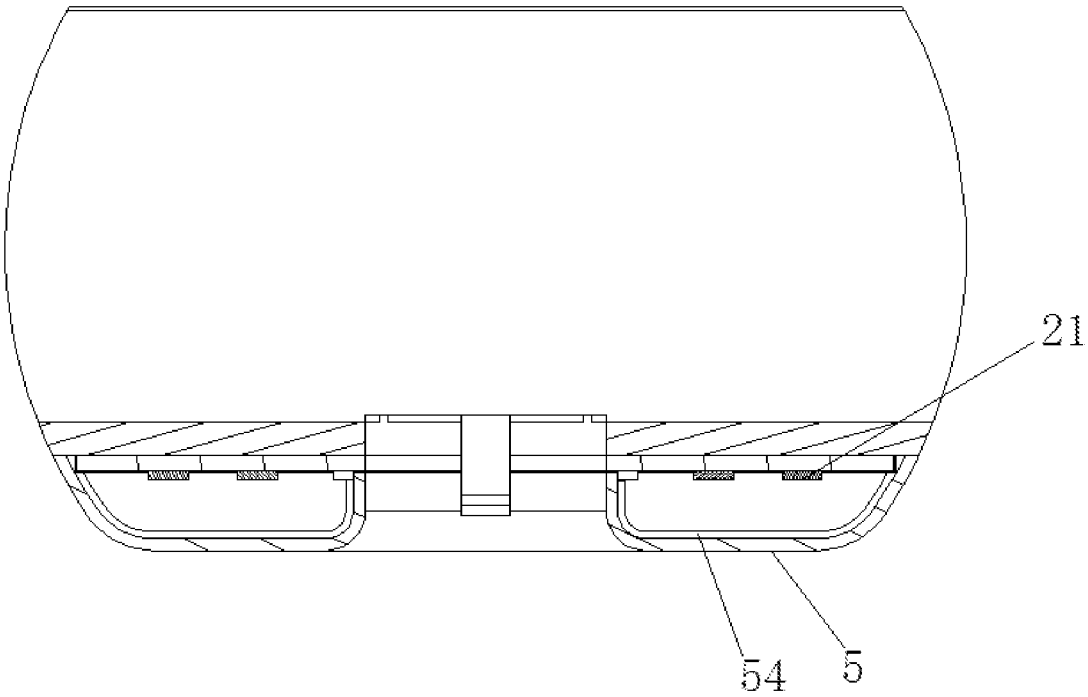
FIG. 48 illustrates a cross-section diagram III showing an LED lighting device according to an embodiment of the instant disclosure.

As shown in FIG. 48, in some embodiments, the light output unit 5 has an anti-reflection film 54 disposed in the inner surface thereof for enabling the transmittance of an LED lighting device to reach more than 95%. The light generated from the operation of the illuminators 21 transmits sequentially to the first medium (the air between the illuminators 21 and the light output unit 5), the anti-reflection film 54, and the light output unit 5. In some embodiments, the refractive index of the first medium is $n_1$, the refractive index of the light output unit 5 is $n_2$, and the refractive index of the anti-reflection film 54 is n, wherein the refractive index of the anti-reflection film 54 satisfies the following formula:

$$0.8\sqrt{n_1 * n_2} < n < 1.2\sqrt{n_1 * n_2}$$

In some embodiments, the thickness of the anti-reflection film 54 is d, wherein the width is d=(2k+1) L/4, wherein k is a natural number, L is the wavelength of the light of the anti-reflection film 54.

In some embodiments, the light output unit 5 is made of transmissive material, e.g. glass, plastic, etc. In some embodiments, the light output unit 5 is an integrated structure or a spliced structure.

In some embodiments, the light output unit 5 has through holes disposed thereof corresponding to the through holes 2201 of the substrate 22.

In some embodiments, the cross-section shape of the light output unit 5 is a wave, an arc or a straight line, and the cross-section shape of the light output unit 5 is a wave or an arc, enabling the light output unit 5 to reach a better luminous intensity.

Heat generated from the operation of the light emission unit 2 needs to be quickly conducted to the heat exchange unit 1, and the heat exchange unit 1 executes the thermal dissipation. When heat generated from the light emission unit 2 is conducted to the heat exchange unit 1, one of the factors affecting the conduction speed is the thermal resistance between the light emission unit 2 and the heat exchange unit 1.

In some embodiments, to lower the thermal resistance between the light emission unit 2 and the heat exchange unit 1, the contact area between the light emission unit 2 (the substrate 22 of the light emission unit 2) and the heat exchange unit 1. A thermal adhesive is disposed between the light emission unit 2 and the heat exchange unit 1. The thermal adhesive is thermal grease or other similar materials filled in the slit between the light emission unit 2 and the heat exchange unit 1, to increase the contact area between the light emission unit 2 and the heat exchange unit 1 and to lower the thermal resistance between the light emission unit 2 and the heat exchange unit 1. Usually, the thermal adhesive is coated on the light emission unit 2, then connected the light emission unit 2 to the heat exchange unit 1. In some embodiments, the thermal adhesive is coated on the heat exchange unit 1, then the heat exchange unit 1 is connected to the light emission unit 2.

As shown in FIG. 16B, FIG. 17, FIG. 18, and FIG. 19, in some embodiments, the heat exchange unit 1 has a position structure to fix the light emission unit 2. The heat exchange unit 1 has a positioning unit 12 disposed thereof, wherein the positioning unit 12 and the outer edge of the substrate 22 of the light emission unit 2 are fixed.

The heat exchange unit 1 comprises a base 102. The positioning unit 12 comprises a first positioning unit 121 and a second positioning unit 122. The first positioning unit 121 and the second positioning unit 122 are disposed in the base 102 in the longitudinal direction of the heat exchange unit 1, wherein the first positioning unit 121 and the second positioning unit 122 are disposed in the base 102 corresponding to the other side of the cooling fins 101. Furthermore, the first positioning unit 121 and the second positioning unit 122 separately engage with a first end 220*a* and a second end 220*b* of the substrate 22 in the longitudinal direction. The first end 220*a* is a fixed end connected to the case 3 and the second end 220*b* is a free end that is far away from the case 3.

The first positioning unit 121 comprises a first groove 1211, the second positioning unit 122 comprises a second groove 1221, and the opening 12110 of the first groove 1211 is oriented parallel to the opening 12210 of the second groove 1221. One end in a longitudinal direction of the substrate 22 is interlocked with the first groove 1211, and the other end in a longitudinal direction of the substrate 22 is interlocked with the second groove 1221.

Figure 23:
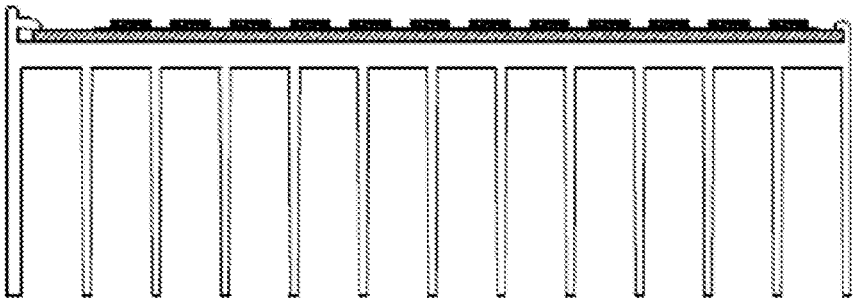

The first positioning unit 121 has a first wall 1212 disposed thereof, and the first groove 1211 is formed between the first wall 1212 and the base 102. The second positioning unit 122 has a second wall 1222 disposed thereof, and the second groove 1221 is formed between the second wall 1222 and the base 102. Both sides of the substrate 22 are interlocked with the first groove 1211 and the second groove 1221 respectively, applying forces to the first wall 1212 and the second wall 1222, enabling the first wall 1212 and the second wall 1222 to deform and compress the surface of the substrate 22 respectively, fixing the substrate 22 to the base 102 (FIG. 23 illustrates the first wall 1212 and the second wall 1222 deform and compress the surface of the substrate 22).

One side of the end portion of the substrate 22 is abutted to a bottom 12211 of the second groove 1221, to limit the position of the substrate 22, ensuring the consistency of the positions of the substrates 22 in various LED lighting devices. A slit is configured between the other side of the substrate 22 and the bottom 12111 of the first groove 1211. The slit prevents the substrate 22 compressed by the base 102 and deformed. Specifically, the substrate 22 and the base 102 have various shrinkages according to various materials that the substrate 22 and the base 102 are made of, after long-term alternating hot and cold temperatures, the substrate 22 in the longitudinal direction may be compressed by the base 102, causing the substrate 22 to bulge. The slit prevents such circumstance from happening.

The thickness of the first wall 1212 gradually decreases in the direction closed to the second wall 1222, enabling the outer portion of the first wall 1212 more easily to be compressed and deformed. Correspondingly, the second wall 1222 is deployed with the same arrangement, which is the width of the second wall 1222 decreases in the direction proximate the first wall 1212.

In some embodiments, both sides of the substrate 22 are inserted into the first groove 1211 and the second groove 1222 respectively in the lateral direction (not shown). At this time, the first groove 1211 and the second groove 1222 provide a structure similar to a chute or a guide rail, installed with the substrate 22. Thus, the installation of the substrate 22 is rather simple.

Please refer to FIG. 16B to FIG. 23. In some embodiments, to prevent the prior coating of the thermal adhesive on the back of the substrate 22 from overflowing in the process of installation, the substrate 22 is installed in various arrangements. Specifically, the substrate 22 is bonded from the above of the base 102 directly to the base 102, and both sides of the substrate 22 are inserted into the first groove 1211 and the second groove 1221 respectively.

Figure 18:
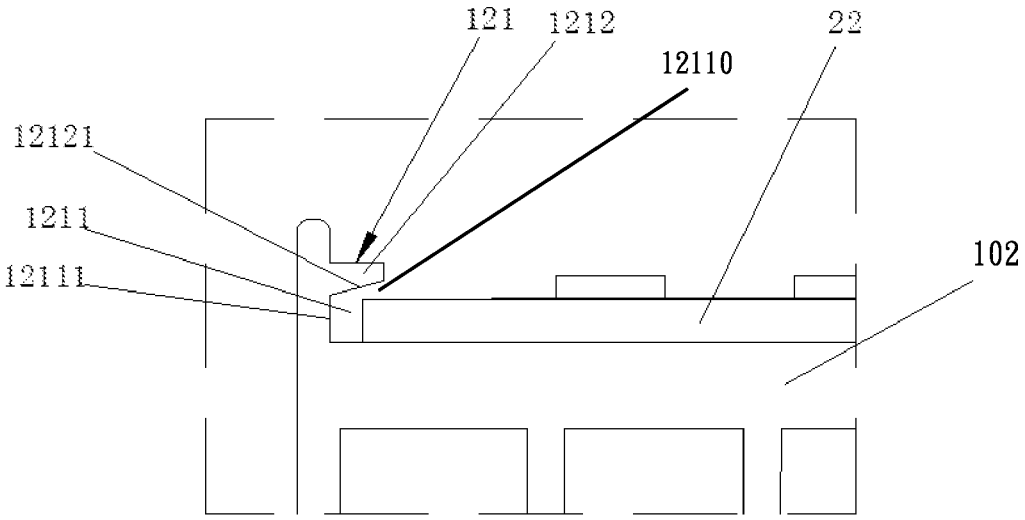
FIG. 18 illustrates a zoom-in diagram showing area B in FIG. 1.

As shown in FIG. 18, in some embodiments, the first wall 1212 is provided with a first mode (before the first wall 1212 is forced and deformed). In the first mode, the first wall 1212 has a bevel 12121 disposed in the inner surface thereof, the space between the bevel 12121 and the base 102 decreases in a direction to the second wall 1222, and the opening 12110 of the first groove 1211 is flared, thus facilitating the substrate 22 from the above of the base 102 to be directly inserted into the first groove 1211 in a bevel direction (the substrate 22 and the base 102 maintain a nip angle). In some embodiments, the length from the bottom 12111 of the first groove 1211 to the end of the second wall 1222 is greater than the length of the substrate 22. When one end of the substrate 22 is inserted into the first groove 1211 and abutted to the bottom 12111 of the first groove 1211, the substrate 22 is bonded downward to the base 102. The base 102 is moved horizontally, enabling one end of the base 102 to be abutted to the bottom 12211 of the second groove 1221. The end of the first wall 1212 and the end of the second wall 1222 are corresponding upward to the substrate 22 in a width direction, and the substrate 22 is compressed by the first wall 1212 and the second wall 1222.

Figure 20:
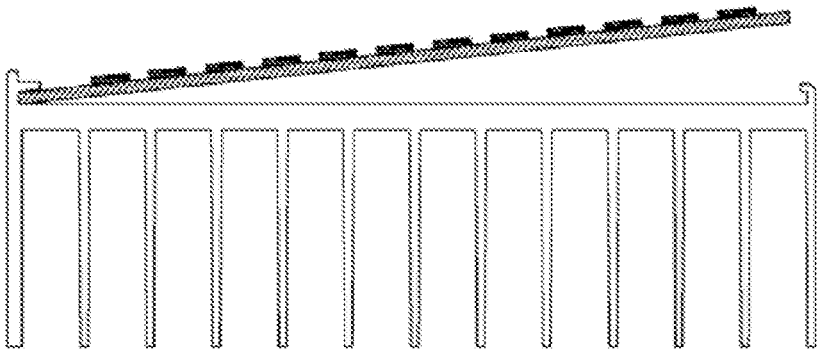
FIG. 20 to FIG. 23 illustrate installation schematic diagrams showing a substrate disposed in a heat exchange unit according to an embodiment of the instant disclosure.
Figure 21:
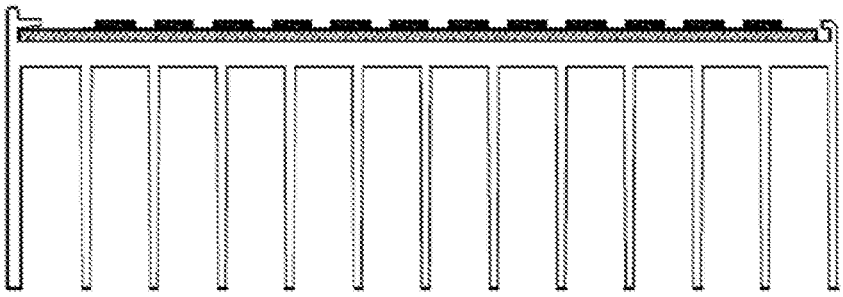
Figure 22:
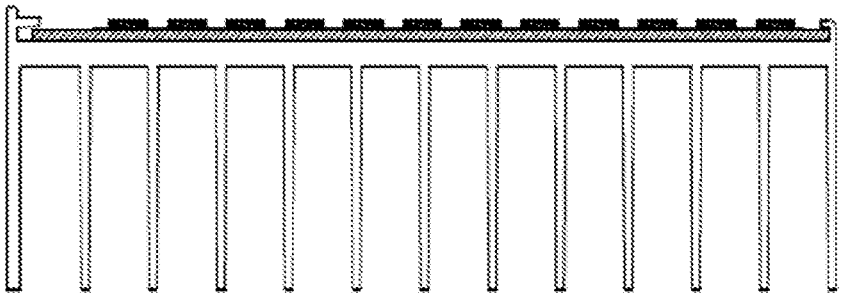

As shown in FIG. 16B to FIG. 23, in some embodiments, the installation method of the substrate 22 includes the following steps:

Configure a substrate 22 and coat a thermal adhesive on the surface of the substrate 22;

Configure a base 102;

Insert one end of the substrate 22 in a longitudinal direction into the first groove 1211 in a bevel direction (as shown in FIG. 20);

Bond the substrate 22 to the base 102 (as shown in FIG. 21);

Move the substrate 22 horizontally and abut one end of the substrate 22 to the bottom 12211 of the second groove 1221 (as shown in FIG. 22);

Apply forces to the first wall 1212 and the second wall 1222 to compress the first wall 1212 and the second wall 1222 respectively to the surface of the substrate 22 (as shown in FIG. 23).

Figure 24:
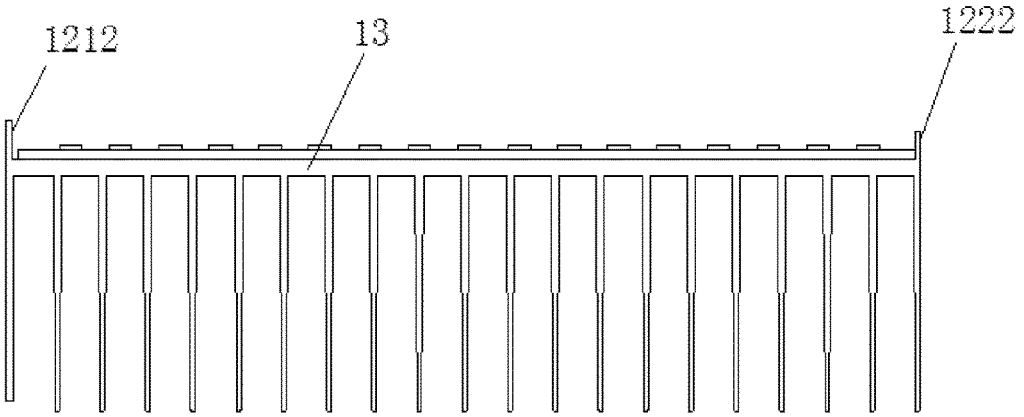
FIG. 24 illustrates a schematic diagram showing a coordination between a substrate and a heat exchange unit, wherein an unbent mode of a first wall and a second wall according to some embodiments of the instant disclosure.
Figure 25:
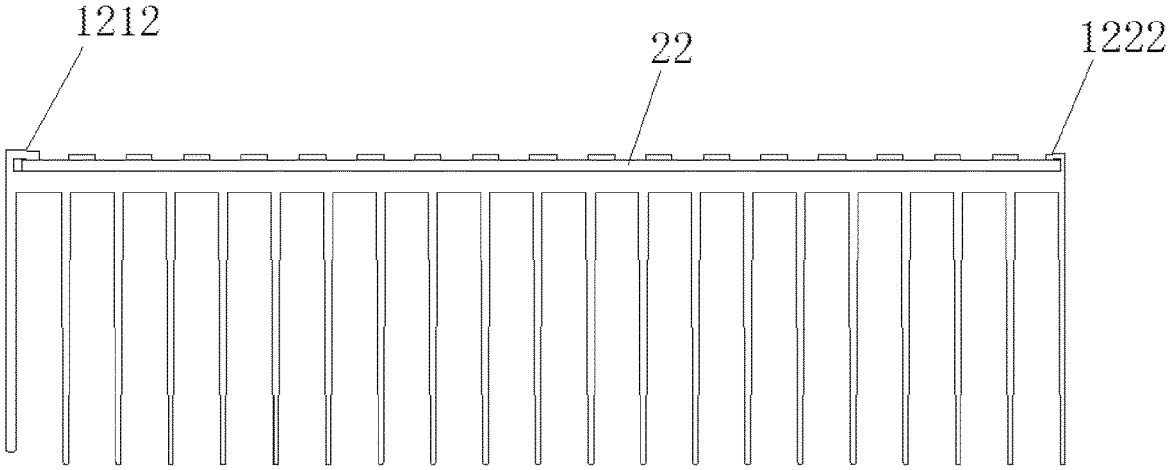
FIG. 25 illustrates a schematic diagram showing a coordination between a substrate and a heat exchange unit, wherein a first wall and a second wall are bent and a substrate is compressed tightly in FIG. 24.

As shown in FIG. 24 and FIG. 25, in some embodiments, the first wall 1212 and the second wall 1222 are provided with various modes. Specifically, before the first wall 1212 and the second wall 1222 are deformed, the first wall 1212 and the second wall 1222 are vertical to the surface of the base 102. The length between the first wall 1212 and the second wall 1222 is greater than or slightly greater than the length of the substrate 22 (specifically, the length between the first wall 1212 and the second wall 1222 and the length of the substrate 22 have a deviation in a range of 0 mm~3 mm), enabling the substrate 22 to be directly inserted from the above of the base 102 into the space between the first wall 1212 and the second wall 1222. As shown in FIG. 25, by bending the first wall 1212 and the second wall 1222, the first wall 1212 and the second wall 1222 are compressed to the substrate 22. In some embodiments, the installation method of the substrate 22 includes the following steps:

Configure a substrate 22 and coat a thermal adhesive on the surface of the substrate 22;

Configure a base 102, and dispose a first wall 1212 and a second wall 1222 on the base 102;

Bond the substrate 22 to the base 102 in a width direction of the substrate 22;

Apply forces to the first wall 1212 and the second wall 1222 to compress the first wall 1212 and the second wall 1222 respectively to the surface of the substrate 22.

Figure 26:
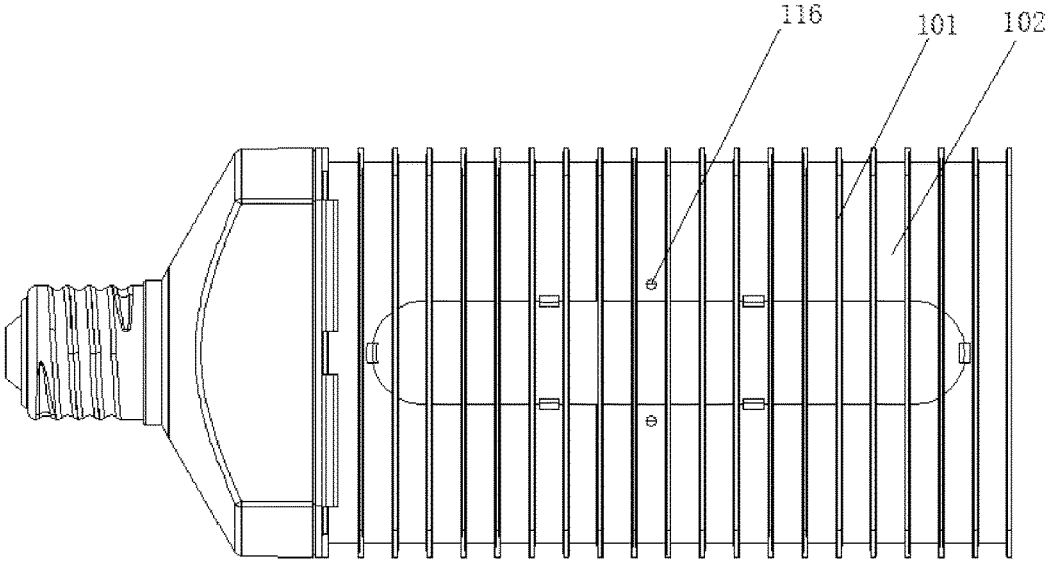
FIG. 26 illustrates a top schematic diagram showing a structure in FIG. 1.
Figure 27:
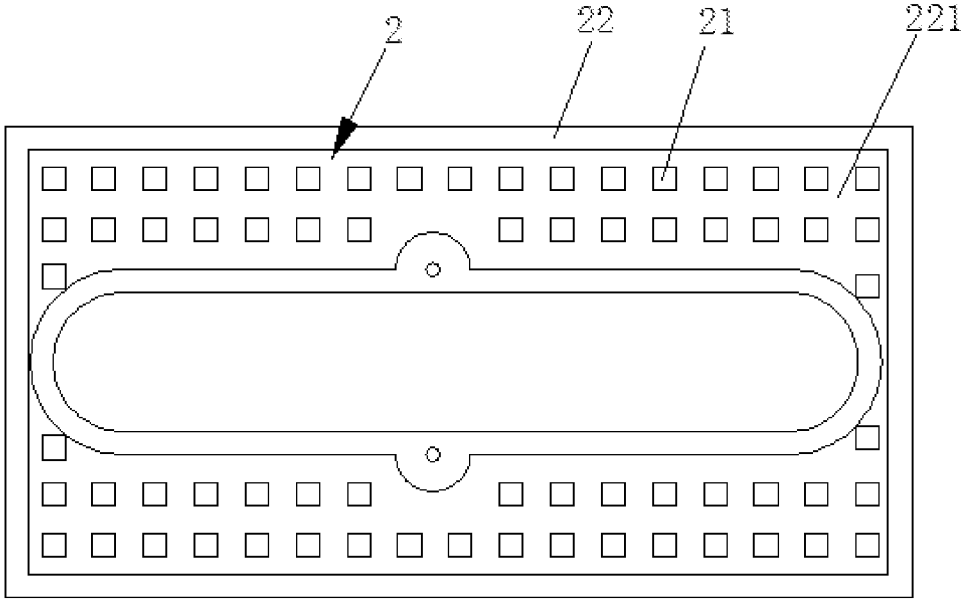
FIG. 27 illustrates a main schematic diagram showing a substrate in FIG. 1.

Please refer to FIG. 26 and FIG. 27. In some embodiments, the heat exchange unit 1 provides a fixation of the substrate 22 and the heat exchange unit 1, e.g. by bolts or rivets, and the substrate 22 and the heat exchange unit 1 are connected and fixed. Specifically, the base 102 between the cooling fins 101 has apertures 116 disposed thereof to provide a connection. At this time, the substrate 22 perforates with holes corresponding to the apertures 116, which is not further described in this paragraph.

In order to prevent the overflow of the thermal adhesive when the substrate 22 and the base 102 are bonded to each other, the position of the thermal adhesive is correspondingly arranged. Specifically, please refer to FIG. 16B to FIG. 19, and FIG. 27 to FIG. 28. In some embodiments, the thermal adhesive 23 is coated on the substrate 22 corresponding to the other face of the illuminators 21, the thermal adhesive 23 and the edge of the substrate 22 are spaced. Therefore, when the substrate 22 and the base 102 are bonded to each other, the thermal adhesive 23 is provided with a space for flowing outward, and the overflow of the thermal adhesive 23 is avoided.

In some embodiments, the substrate 22 is bonded to the base 102, after the thermal adhesive 23 and the edge of the substrate 22 are spaced, the space is in a range of 0 mm~10 mm. In some embodiments, the overflow has the following influences: the thermal adhesive 23 overflows from both sides of the substrate 22 in a width direction, affecting the aesthetics of the LED lighting device. Both sides of the substrate 22 in a longitudinal direction are interlocked with the first groove 1211 and the second groove 1221, even if the thermal adhesive 23 overflows, the overflow is blocked by the first groove 1211 and the second groove 1221. Considering the arrangement of the thermal adhesive 23, the substrate 22 and the base 102 are installed, the thermal adhesive 23 and the substrate 22 are spaced in a width direction of both sides of the substrate 22, wherein the space is in a range of 0 mm~10 mm, preferably the space is in a range of 0 mm~5 mm.

Figure 29:
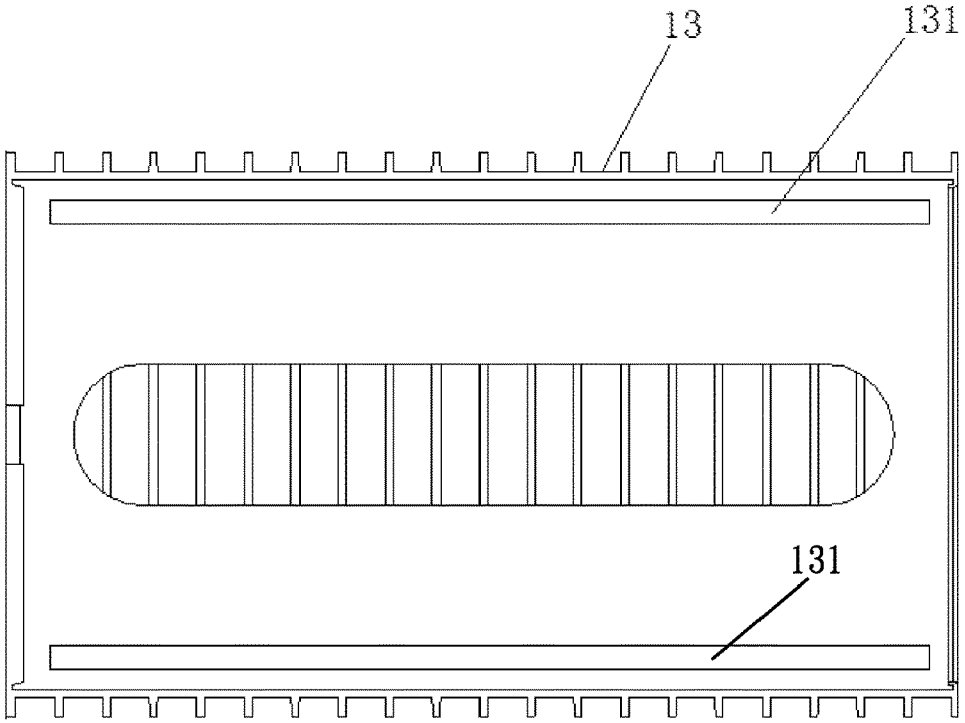
FIG. 29 illustrates a schematic diagram showing a heat exchange unit, wherein an overflow groove is disposed on a base according to some embodiments of the instant disclosure.
Figure 30:
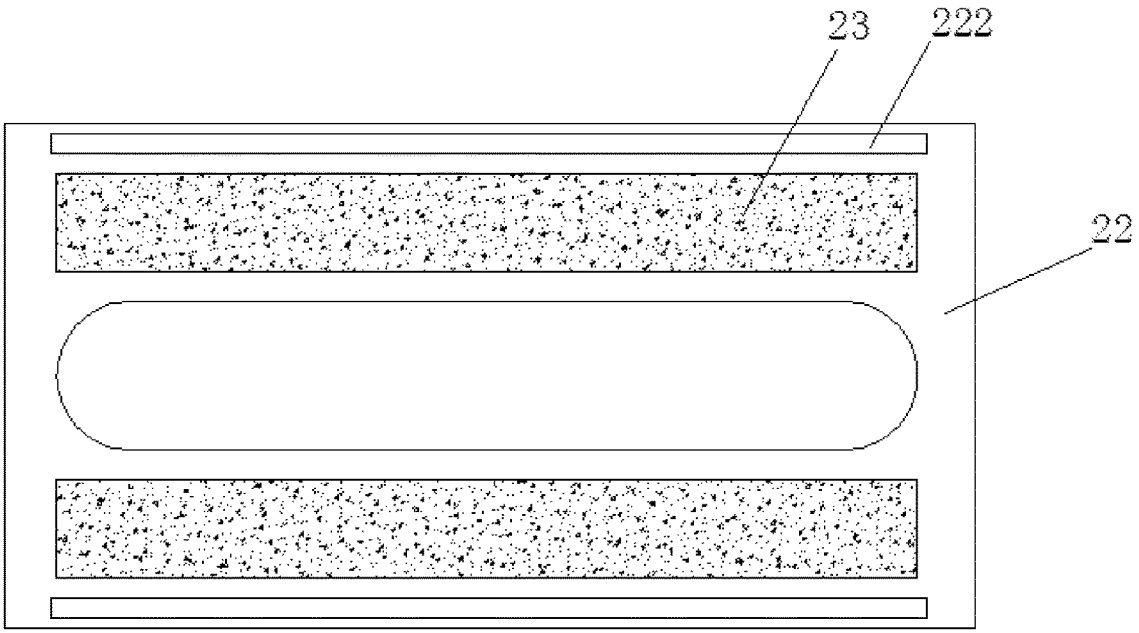
FIG. 30 illustrates a schematic diagram showing a substrate, wherein an overflow groove is disposed in a base according to some embodiments of the instant disclosure.

In order to prevent the overflow of the thermal adhesive, some elements for preventing the overflow of the thermal adhesive are arranged. Please refer to FIG. 28 and FIG. 29. In some embodiments, the base 102 has a first receiving groove 131 disposed thereof. When the substrate 22 is disposed on the base 102, the first receiving groove 131 is corresponding to the edge of the substrate 22, not exceeding the border of the outer end of the substrate 22. The cross-section shape of the first receiving groove 131 is a square, an arc, a triangle, etc., wherein the substrate 22 and the base 102 are installed, the thermal adhesive 23 flows to the first receiving groove 131, to prevent the overflow of the thermal adhesive 23. Please refer to FIG. 30. In some embodiments, the substrate 22 has similar elements for preventing the overflow of the thermal adhesive 23 disposed thereof. The substrate 22 has a second receiving groove 222 disposed thereof corresponding to the surface of the substrate 22, and the second receiving groove 222 is disposed on both sides of the substrate 22 in a width direction. Similarly, the cross-section shape of the second receiving groove 222 is a square, an arc, a triangle, etc. In some embodiments, both the first receiving groove 131 and the second receiving groove 222 are deployed.

Figure 28:
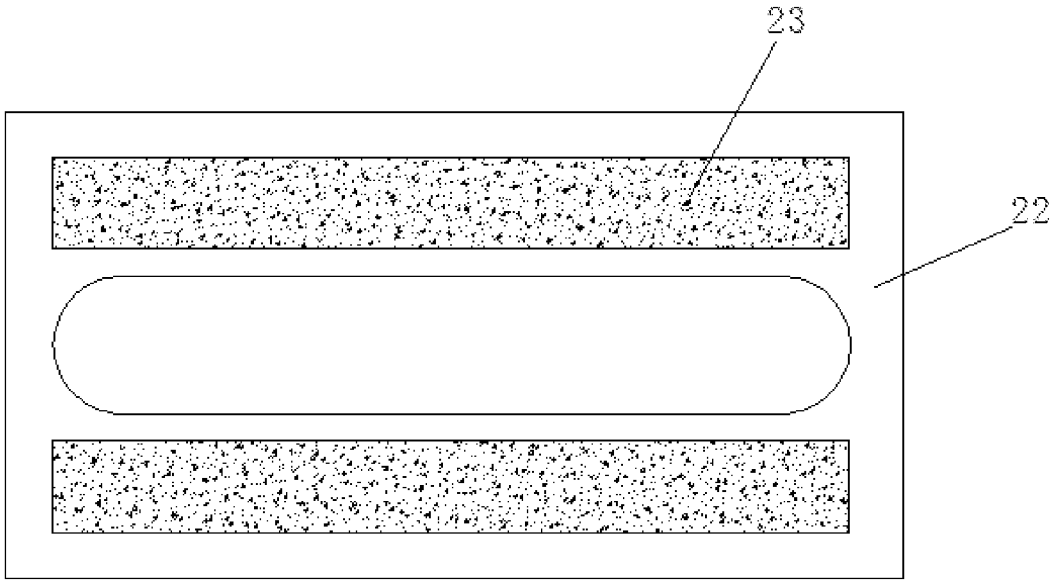
FIG. 28 illustrates a rear schematic diagram showing a state of coating/filling a thermal adhesive in FIG. 27.

As shown in FIG. 27 and FIG. 28, in some embodiments, when the light emission unit 2 operates, heat is mainly generated from the illuminators 21, the illuminators 21 are disposed in a setting zone 221 (the setting zone 221 comprises a connection wire electrically connected to the illuminators 21) for ensuring the contact area between the illuminators 21 of the substrate 22 and the base 102. The thermal adhesive 23 is coated on the substrate 22 corresponding to the other side of the illuminators 21, and the position of the thermal adhesive 23 is corresponding to the position of the setting zone 221 (in a condition that at least 70% of the position of the thermal adhesive 23 is corresponding to the position of the setting zone 221, it is considered the position of the thermal adhesive 23 is corresponding to the position of the setting zone 221).

In some embodiments, the heat exchange unit 1 is a split-type structure. Please refer to FIG. 31, FIG. 32, FIG. 33, FIG. 34 and FIG. 35. In some embodiments, the heat exchange unit 1 comprises a first heat spreader 11 and a second heat spreader 12. The structures of the heat spreader 11 and the heat spreader 12 are basically similar to the integrated structure of the heat exchange unit 1. The first heat spreader 11 and the second heat spreader 12 are arranged in a second direction Y, according to various positions of the first heat spreader 11 and the second heat spreader 12, the heat exchange unit 1 is provided with a close mode and an open mode, enabling the heat exchange unit 1 to switch between the close mode and the open mode. The heat exchange unit 1 is provided with a width A in the close mode, and the heat exchange unit 1 is provided with a width B in the open mode. The width A of the heat exchange unit 1 in the close mode is less the width B of the heat exchange unit 1 in the open mode. When the heat exchange unit 1 is in the close mode, the heat exchange unit 1 is smaller in size (or smaller in width), making package, delivery, and installation of the LED lighting device easy. From the perspective of installation, the LED lighting device is required to dispose lamps inside to operate, the heat exchange unit 1 is in the close mode, enabling the lamps to be screwed into the LED lighting device, preventing the heat exchange unit 1 from bumping into the lamps, causing damages of the lamps. When the heat exchange unit 1 is in the open mode, the heat exchange unit 1 have a larger area or space for thermal dissipation for accelerating the thermal dissipation of the LED lighting device. From the perspective of use, in installation of the LED lighting device, the heat exchange unit 1 is in the close mode, making the installation easy. After the installation is complete, the heat exchange unit 1 is in the open mode for accelerating the thermal dissipation of the LED lighting device. In some embodiments, a second direction Y is a width direction of the LED lamp in use mode. In other embodiments, the second direction Y are different directions, for example, the second direction Y and the substrate 22 are in a certain angle; for another example, the second direction Y is a circumferential direction.

Figure 31:
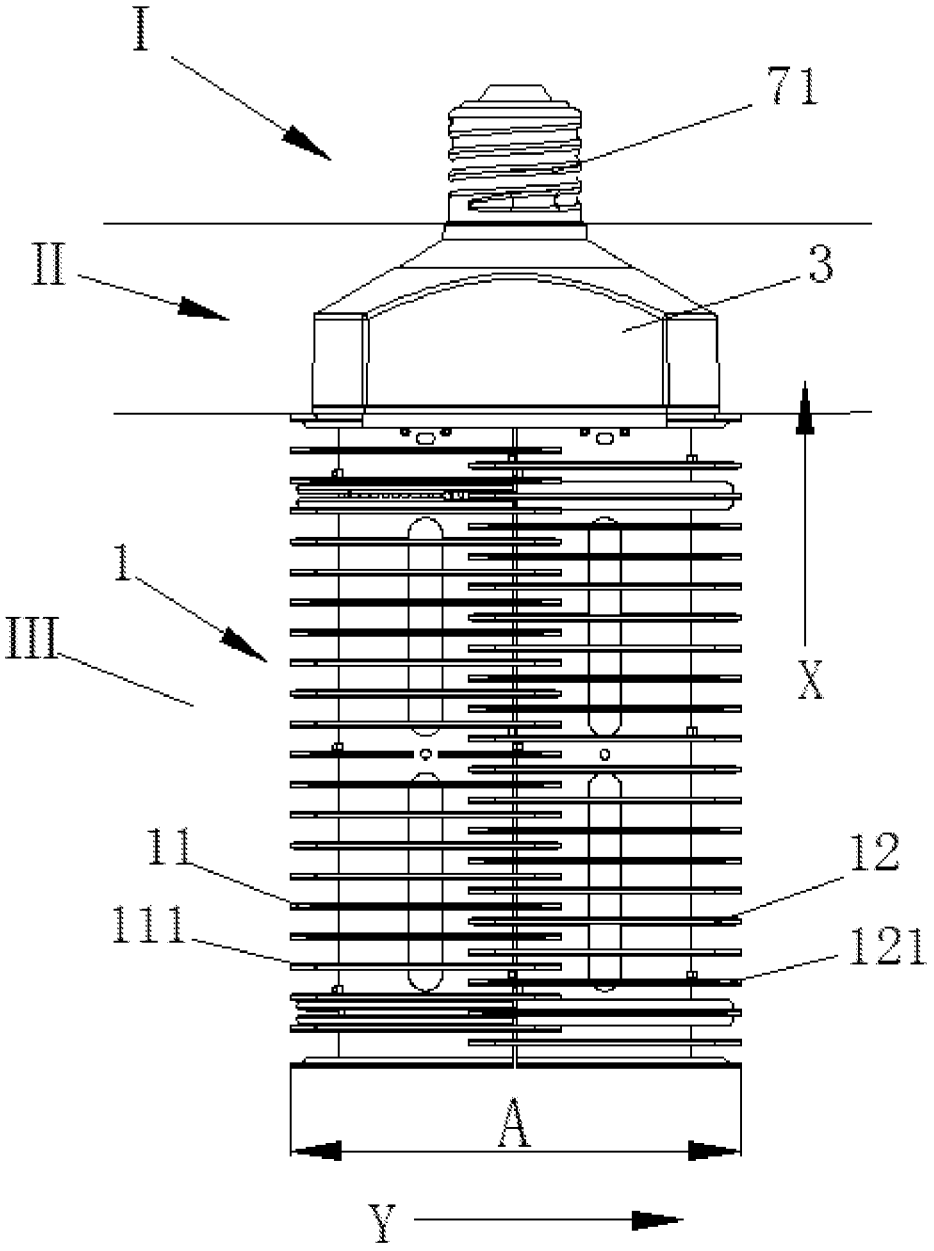
FIG. 31 illustrates a main schematic diagram showing a structure of an LED lighting device, wherein a heat exchange unit is in close mode according to some embodiments of the instant disclosure.
Figure 32:
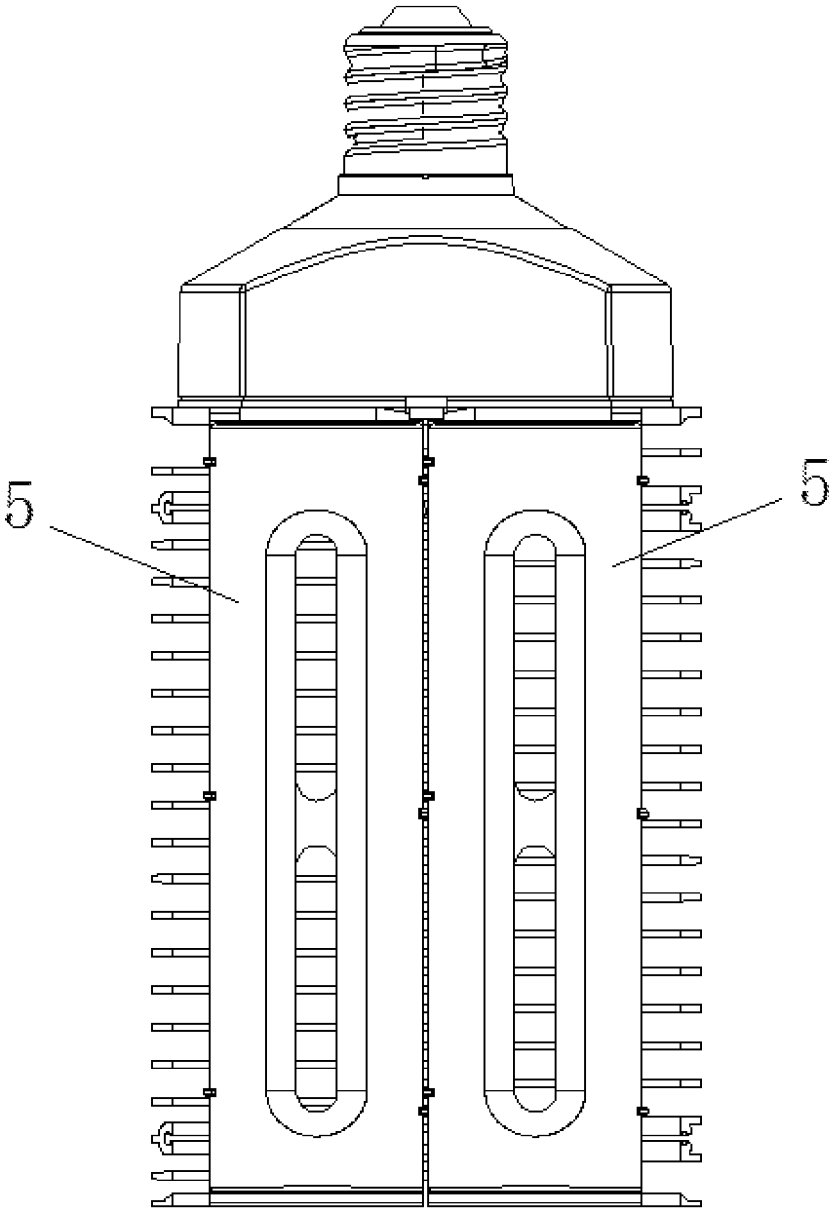
FIG. 32 illustrates a rear schematic diagram showing a structure in FIG. 31.
Figure 35:
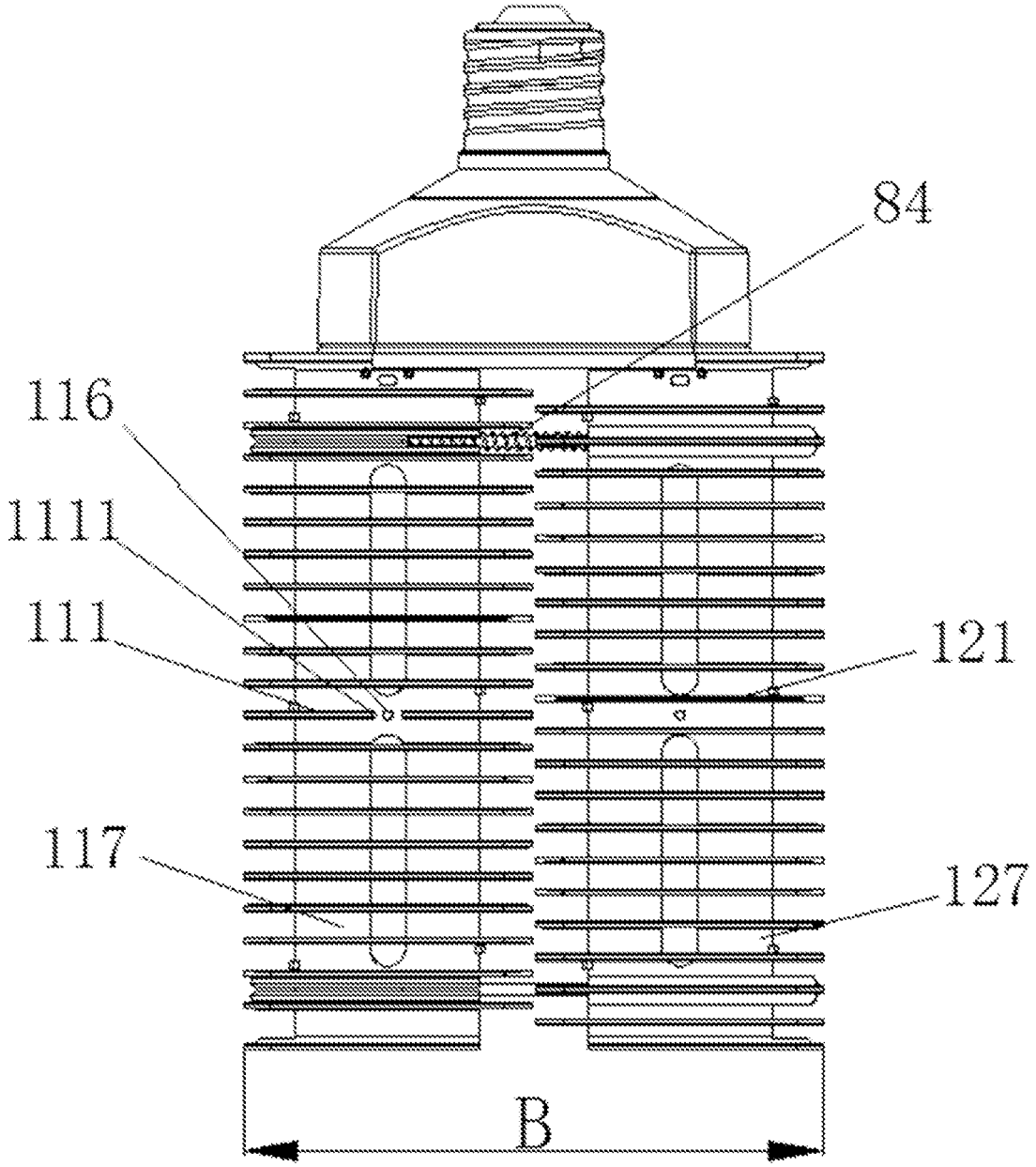
FIG. 35 illustrates a main schematic diagram showing a structure of an LED lighting device, wherein a heat exchange unit is in open mode in FIG. 31.
Figure 36:
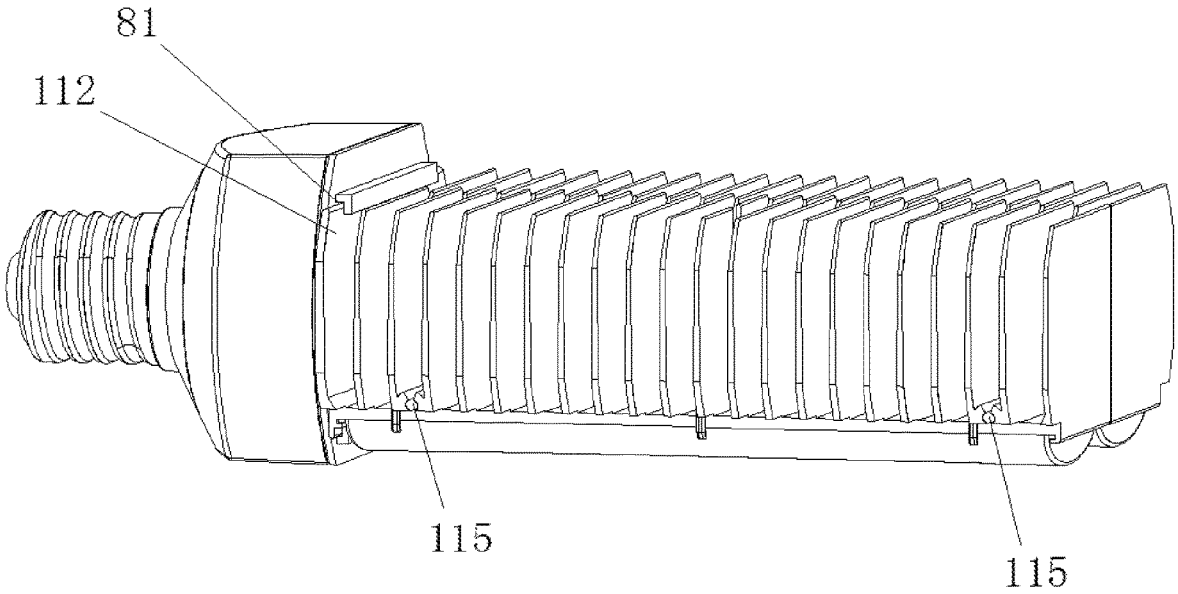
FIG. 36 illustrates a three-dimensional diagram I showing an LED lighting device in FIG. 31.
Figure 37:
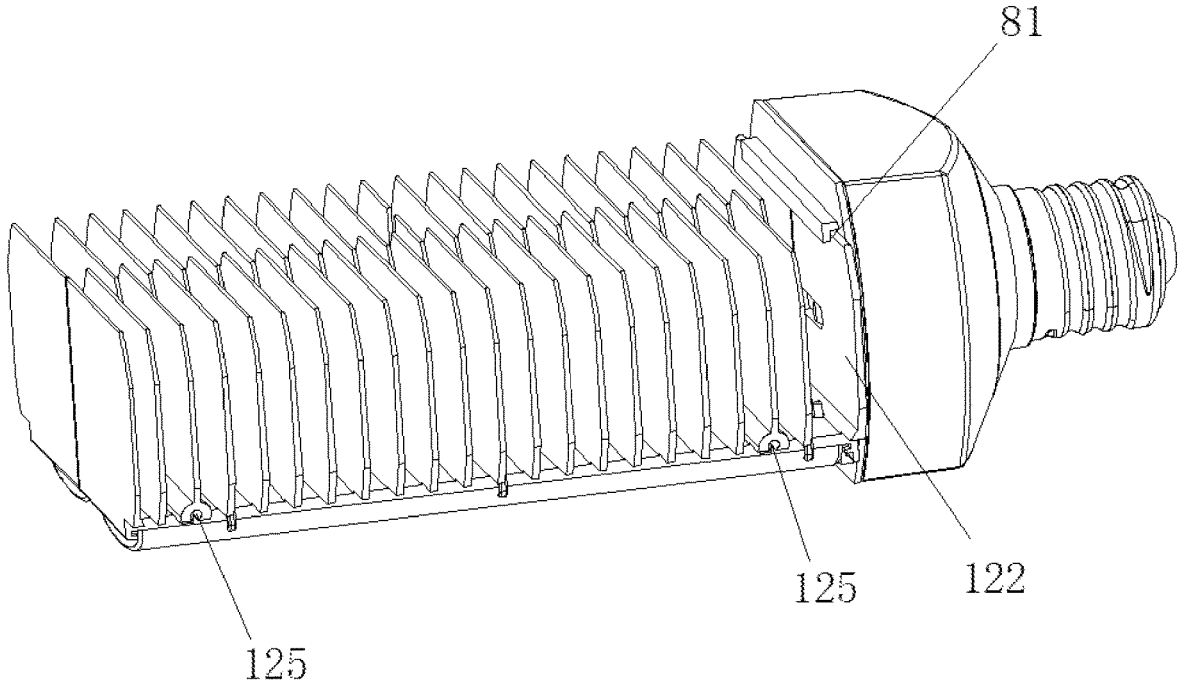
FIG. 37 illustrates a three-dimensional diagram II showing an LED lighting device in FIG. 31.
Figure 38:
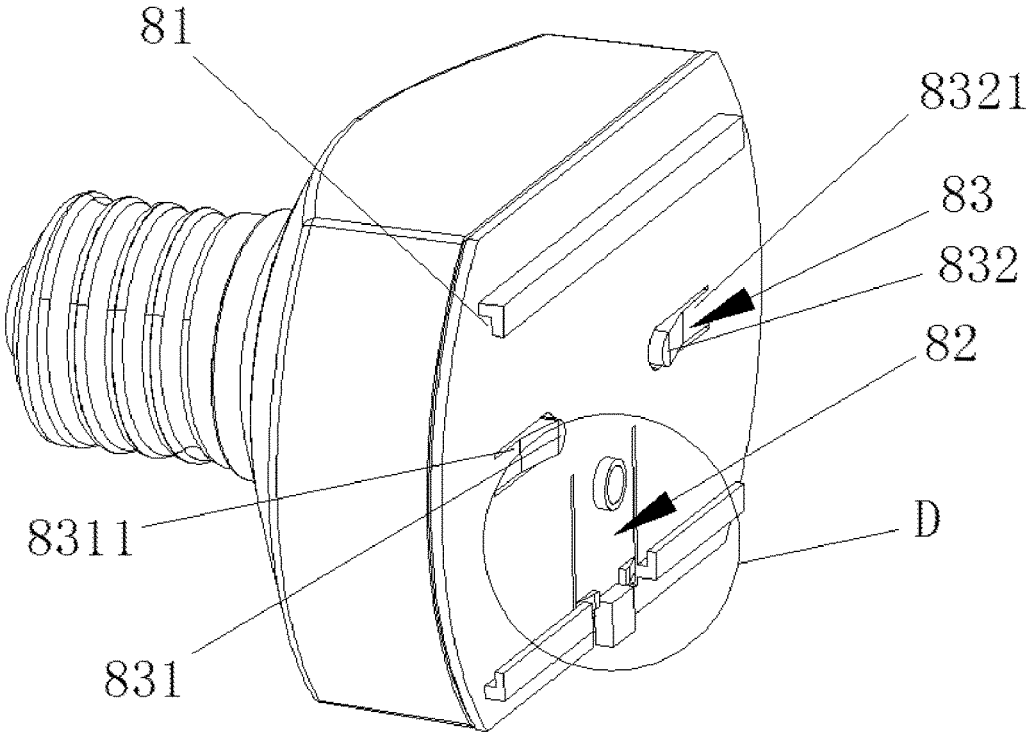
FIG. 38 illustrates a schematic diagram showing an LED lighting device without elements of a third portion in FIG. 31.
Figure 39:
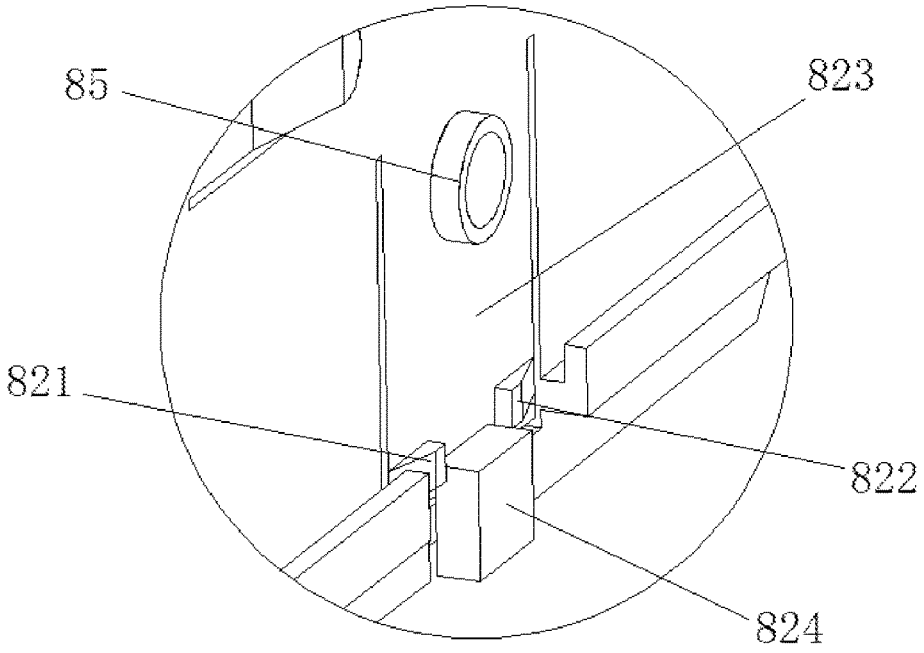
FIG. 39 illustrates a zoom-in diagram showing an area D in FIG. 38.
Figure 40:
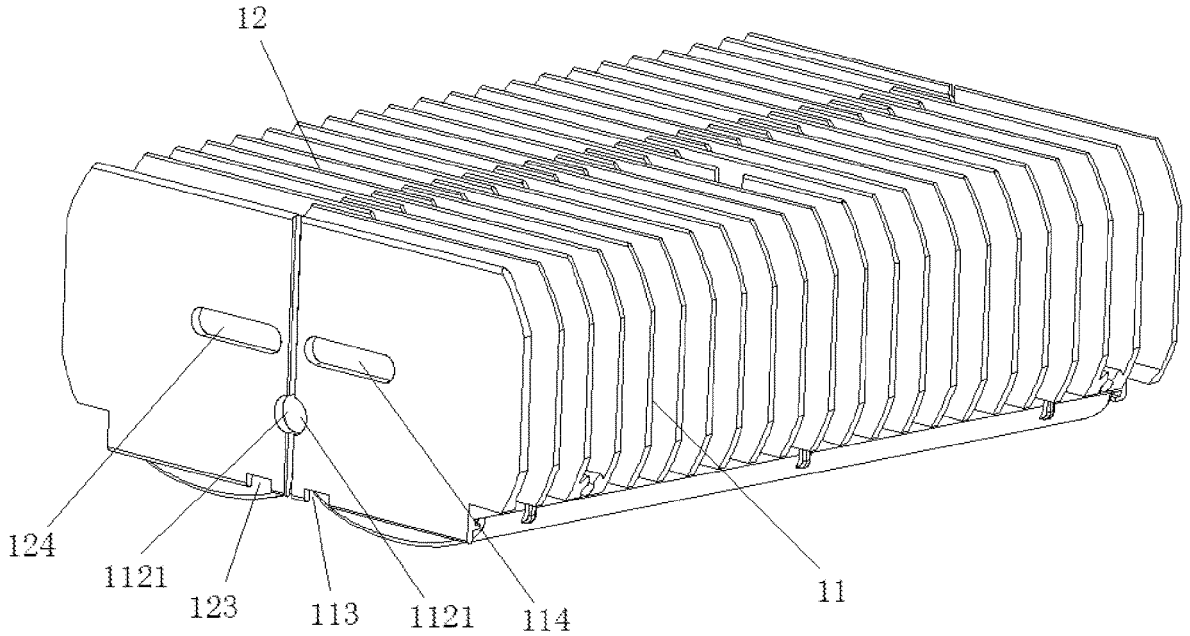
FIG. 40 illustrates a schematic diagram showing an LED lighting device without elements of a first portion and a second portion in FIG. 31.
Figure 41:
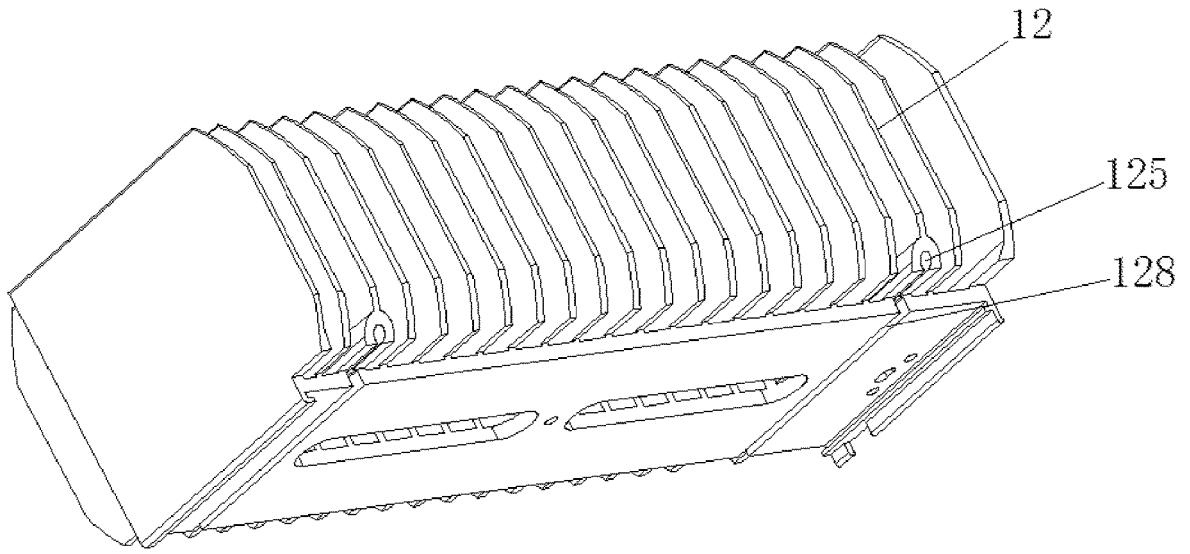
FIG. 41 illustrates a three-dimensional diagram showing a structure of a first thermal dissipation element of an LED lighting device in FIG. 31.

Please refer to FIG. 31 and FIG. 35. In some embodiments, the ratio of the width B of the heat exchange unit 1 in the open mode to the width A of the heat exchange unit 1 in the close mode is more than 1.1 and less than 2. Preferably, the ratio of the width B of the heat exchange unit 1 in the open mode to the width A of the heat exchange unit 1 in the close mode is more than 1.2 and less than 1.8, enabling the heat exchange unit 1 to be provided with sufficient space for adjustment.

Please refer to FIG. 31, the first heat spreader 11 comprises a first cooling fins 111, and the second heat spreader 12 comprises a second cooling fins 121. In the close mode, the first cooling fins 111 and the second cooling fins 121 are at least partially overlapped in a first direction X. In the open mode, the first cooling fins 111 and the second cooling fins 121 are not overlapped in a first direction X or the overlapped portion of the first cooling fins 111 and the second cooling fins 121 in a first direction X in the open mode is smaller than the overlapped portion of the first cooling fins 111 and the second cooling fins 121 in a first direction X in the close mode. In some embodiments, the first cooling fins 111 and the second cooling fins 121 are spaced in a first direction X, no matter in the close mode or in the open mode, the first cooling fins 111 and the second cooling fins 121 don't contact each other to avoid a mutual heat interaction. In some embodiments, the first cooling fins 111 are oriented parallel or roughly parallel to the second cooling fins 121.

The space between the first cooling fins 111 is in a range of 8 mm~25 mm, preferably the space between the first cooling fins 111 is in a range of 8 mm~15 mm. The range of the space is determined according to radiation and convection in thermal dissipation. The space between the second cooling fins 121 is the same as the space between the first cooling fins 111, meeting the demand of thermal dissipation under the weight limitations, enabling the heat exchange unit 1 to switch between the close mode and the open mode, the first cooling fins 111 and the second cooling fins 121 don't conflict with each other. As long as the first cooling fins 111 and the second cooling fins 121 don't conflict with each other, it is acceptable that the space between the second cooling fins 121 is different from the space between the first cooling fins 111.

Please refer to FIG. 31 to FIG. 40. In order to achieve the close mode and the open mode of the heat exchange unit 1, the heat exchange unit 1 further comprises an adjustment unit 8 disposed on the surface of the case 3 corresponding to the heat exchange unit 1. The adjustment unit 8 and the case 3 are integrated or in other forms to be fixed on the case 3. The adjustment unit 8 comprises a guide rail 81, a first guide unit 82, a second guide unit 83 and an elastic member 84. The guide rail 81 extends in a second direction Y, and the first heat spreader 11 and the second heat spreader 12 have corresponding elements to match with the guide rail 81, enabling the first heat spreader 11 and the second heat spreader 12 to move along the guide rail 81 (the second direction Y) in an oriented manner. Specifically, the first heat spreader 11 has a first component 112 disposed thereof to match with the guide rail 81, and the second heat spreader 12 has a second component 122 disposed thereof to match with the guide rail 81. A plurality of the guide rails 81 are arranged to provide stability of connection. For example, the case 3 has a longer guide rail disposed at the end portion of the case 3 at one side in a width direction of the LED lighting device. The first component 112 of the heat spreader 11 and the second component 122 of the second heat spreader 12 share the same longer guide rail. The case 3 has two shorter guide rails disposed at the end portion of the case 3 at the other side in a width direction of the LED lighting device, and the two shorter guide rails match with the first component 112 of the first heat spreader 11 and the second component 122 of the second heat spreader 12 respectively. It is perceptible, the quantity of the guide rail is randomly arranged. To illustrate, the top and the bottom of the case 3 has two short guide rails disposed respectively to match with the first component 112 of the first heat spreader 11 and the second component 122 of the second heat spreader 12.

The first guide unit 82 and the second guide unit 83 are deployed to limit the slide of the first heat spreader 11 and the second heat spreader 12, that is the close mode and the open mode are achieved by the first guide unit 82 and the second guide unit 83. When the heat exchange unit 1 is in the close mode, the first guide unit 82 limits the positions of the first heat spreader 11 and the second heat spreader 12 to be fixed. When the heat exchange unit 1 is in the open mode, the second guide unit 83 limits the positions of the first heat spreader 11 and the second heat spreader 12, limiting the unfolded dimension of the first heat spreader 11 and the second heat spreader 12. When the heat exchange unit 1 is in the close mode, the elastic member 84 is disposed on the heat exchange unit 1, by the elastic potential energy, the elastic member 84 applies forces to the first heat spreader 11 and the second heat spreader 12. When the first guide unit 82 releases the limitations of the positions of the first heat spreader 11 and the second heat spreader 12, the first heat spreader 11 and the second heat spreader 12 are unfolded automatically, and the second guide unit 83 limits the unfolded dimension of the first heat spreader 11 and the second heat spreader 12.

The first guide unit 82 comprises a first lock portion 821, a second lock portion 822, a flexible arm 823, and a press portion 824. The first lock portion 821 and the second lock portion 822 are fixed to the flexible arm 823, and the flexible arm 823 is fixed to the case 3. The first heat spreader 11 has a first concave portion 113 for matching with the first lock portion 821, and the second heat spreader 12 has a second concave portion 123 for matching with the second lock portion 822. When the heat exchange unit 1 is in the close mode, the first lock portion 821 is interlocked with the first concave portion 113, and the second lock portion 822 is interlocked with the second concave portion 123. When the press portion 824 is depressed, the flexible arm 823 alters the positions of the first lock portion 821 and the second lock portion 822 by elastic deformation, enabling the first lock portion 821 and the second lock portion 822 to escape from the first concave portion 113 and the second concave portion 123. At this time, the first heat spreader 11 and the second heat spreader 12 are unfolded automatically by the elastic member 84.

The second guide unit 83 comprises a first guide portion 831 and a second guide portion 832 disposed on the case 3. The first heat spreader 11 has a first position hole 114 disposed thereof and the second heat spreader 12 has a second position hole 124 disposed thereof. The first guide portion 831 matches with the first position hole 114, and the second guide portion 832 matches with the second position hole 124, thus limiting the positions of the first heat spreader 11 and the second heat spreader 12 when the first heat spreader 11 and the second heat spreader 12 are unfolded. The first guide portion 831 and the second guide portion 832 without external forces are bulge on the end portion of the case 3. In some embodiments, the first guide portion 831 and the second guide portion 832 are disposed on the heat exchange unit 1, and the first position hole 114 and the second position hole 124 are disposed on the case 3.

The first guide portion 831 of the second guide unit 83 has a flexible arm 8311, and the second guide portion 832 of the second guide unit 83 has a flexible arm 8321. When the first heat spreader 11 and the second heat spreader 12 are disposed on the case 3, the first component 112 of the first heat spreader 11 and the second component 122 of the second heat spreader 12 are moved along the guide rail 81 from both sides of the case 3 to the central axis of the case 3. The flexible arm 8311 of the first guide portion 831 and the flexible arm 8312 of the second guide portion 832 are depressed and bounced back from the first position hole 114 of the first heat spreader 11 and the second position hole 124 of the second heat spreader 12, to achieve functions of limiting and fixing the positions of the first heat spreader 11 and the second heat spreader 12.

In some embodiments, non-elastic potential energy is adopted, wherein applying forces to the first heat spreader 11 and the second heat spreader 12 enables the heat exchange unit 1 to switch between the close mode and the open mode, e.g. apply external forces to the first heat spreader 11 and the second heat spreader 12.

Please refer to FIG. 36 to FIG. 40. A third guide unit 85 is disposed on the case 3, and the first component 112 is provided with a first position groove 1121 and the second component 122 is provided with a second position groove 1221. The first position groove 1121 and the second position groove 1221 are provided to match with the third guide unit 85. When the heat exchange unit 1 is in the close mode, the third guide unit 85 is abutted to the first position groove 1121 and the second position groove 1221 respectively, preventing the first heat spreader 11 and the second heat spreader 12 from moving toward to each other in the close mode.

Specifically, the flexible arm 823 has the third guide unit 85 disposed thereof. Optionally the third guide unit 85 is a convex structure. In some embodiments, the third guide unit 85 is cylindrical, and the first component 112 of the first heat spreader 11 is provided with a first position groove 1121 corresponding to the position where the third guide unit 85 is located, wherein the first position groove 1121 is arranged in a shape to match with the third guide unit 85. When the third guide unit 85 is cylindrical, the first position groove 1121 is a semicircular. Similarly, the second component 122 of the second spreader 12 is provided with a second position groove 1221 corresponding to the position where the third guide unit 85 is located, and the second position groove 1221 is arranged in a shape to match with the third guide unit 85. When the third guide unit 85 is cylindrical, the second position groove 1221 is semicircular. Based on the above arrangement, when the heat exchange unit 1 is in the close mode, the cylindrical convex portion of the third guide unit 85 is abutted to the first position groove 1121 and the second position groove 1221 respectively, preventing the first heat spreader 11 and the second heat spreader 12 from moving toward to each other in the close mode.

In some embodiments, the third guide unit 85 is either of the following convex shapes, e.g. an oval, a square, a diamond, a sphere, a polygon, etc. as long as the third guide unit satisfies the function of limiting positions, the quantity of the third guide unit 85 is arranged in one, two or plural.

In some embodiments, the third guide unit 85 is disposed on any adequate position on the case 3 other than the flexible arm 823. Preferably, the third guide unit 85 is disposed on the surface of the case corresponding to the central axis of the heat exchange unit 1.

In some embodiments, the third guide unit 85 has position members (not shown) disposed in an area between the first component 112 of the first heat spreader 11 and the second component 122 of the second heat spreader 12, preventing the first heat spreader 11 and the second heat spreader 12 from moving toward to each other in the close mode. For example, arrange a convex portion in an area between the first component 112 and the second component 122. When the heat exchange unit 1 is in the close mode, the convex portion of the first component 112 is abutted to the convex portion of the second component 122, preventing the first heat spreader 11 and the second heat spreader 12 from moving toward to each other in the close mode. The convex portion is in any shape as long as the convex portion satisfies the function of limiting positions, the quantity of the convex portion is arranged in one, two, or plural.

Please refer to FIG. 33 to FIG. 37. In some embodiments, to enhance the stability between the first heat spreader 11 and the second heat spreader 12 and to prevent the first heat spreader 11 and the second heat spreader 12 from sliding and beveling to each other, a guide element is arranged. Specifically, the first heat spreader 11 has guide holes 115 disposed thereof and the second heat spreader 12 has guide holes 125 disposed thereof. A position axle is inserted into the guide holes 115, 125 to enhance the stability between the first heat spreader 11 and the second heat spreader 12 and to prevent the first heat spreader 11 and the second heat spreader 12 from sliding and beveling to each other. In some embodiments, the guide holes 115, 125 are disposed in the first cooling fins 111 and the second cooling fins 121 proximate the end portion of the light emission unit 2. In some embodiments, the elastic member 84 is disposed in one of the guide holes, position elements on the position axle (e.g. a convex portion) enhance the elastic potential energy of the first heat spreader 11 and the second heat spreader 12. In some embodiments, either of the first heat spreader 11 and the second heat spreader 12 has a guide hole disposed thereof and the other heat spreader has a position axle disposed thereof corresponding to the guide hole. The position axle is inserted into the guide holes to enhance the stability between the first heat spreader 11 and the second heat spreader 12 and to prevent the first heat spreader 11 and the second heat spreader 12 from sliding and beveling to each other.

In some embodiments, each heat spreader has at least one of the guide holes 115, 125 disposed thereof. In some embodiments, the heat exchange unit 1 has a plurality of guide holes 115, 125 disposed in the longitudinal direction thereof, e.g. the heat exchange unit 1 has one guide hole disposed proximate an end of the case 3 thereof and the other guide hole disposed away from an end of the case 3 thereof.

Please refer to FIG. 32 to FIG. 35. In some embodiments, the first cooling fins 111 of the first heat spreader 11 has a space 1111 disposed thereof, on one hand, enabling apertures 116 to be disposed in the space 1111, on the other hand, increasing the convection in the space 1111. In some embodiments, at least one of the guide holes 115, 125 is disposed on each heat spreader. In some embodiments, a plurality of the guide holes 115, 125 are disposed in a longitudinal direction of the heat exchange unit 1, e.g. the heat exchange unit 1 has a guide hole proximate an end of the case 3 and a guide hole away from an end of the case 3. The arrangement of the apertures 116 is to fix the substrate 22, preventing the substrate 22 from bulging, narrowing the contact area between the substrate 22 and the heat exchange unit 1, slowing down the thermal conduction. Specifically, the arrangement of the apertures 116, bolts and rivets etc. are deployed to pass through the apertures 116, achieves the connection of the substrate 22 and the heat exchange unit 1. Due to the positions between the first cooling fins 111 and the second cooling fins 121, apertures 126 of the second cooling fins 121 are disposed between the second cooling fins 121, therefore, the apertures 116 are not necessary. In some embodiments, the arrangement of the apertures 116 is adjusted and the space is not necessary, the apertures 116 of the first heat spreader 11 and the apertures 126 of the second heat spreader 12 are in different positions in a first direction X.

Please refer to FIG. 32 to FIG. 35. In some embodiments, the heat exchange unit 1 has the first heat spreader 11 and the second heat spreader 12, and two sets of the light emission units 2 and two sets of the light output units 5 are disposed correspondingly in the LED lighting device. Specifically, the first heat spreader 11 comprises a first base 117 and the second heat spreader 12 comprises a second base 127. Two sets of the light emission units 2 are disposed on the first base 117 and the second base 127 respectively, and two sets of the light output units 5 are sleeved on the two sets of the light emission units 2 respectively.

Please refer to FIG. 32 to FIG. 41, either of the positions of the first base 117 and the second base 127 has a slot 128 disposed thereof corresponding to the apertures 115 or 125. As shown in FIG. 17, the slot 128 is disposed on the second base 127. When the position axle is inserted into the guide holes 115, 125, an external stamping equipment presses the position axle by the slot 128 to fix the position axle. Furthermore, the arrangement of the slot 128 makes the machining of the substrate 22 more easy.

Figure 33:
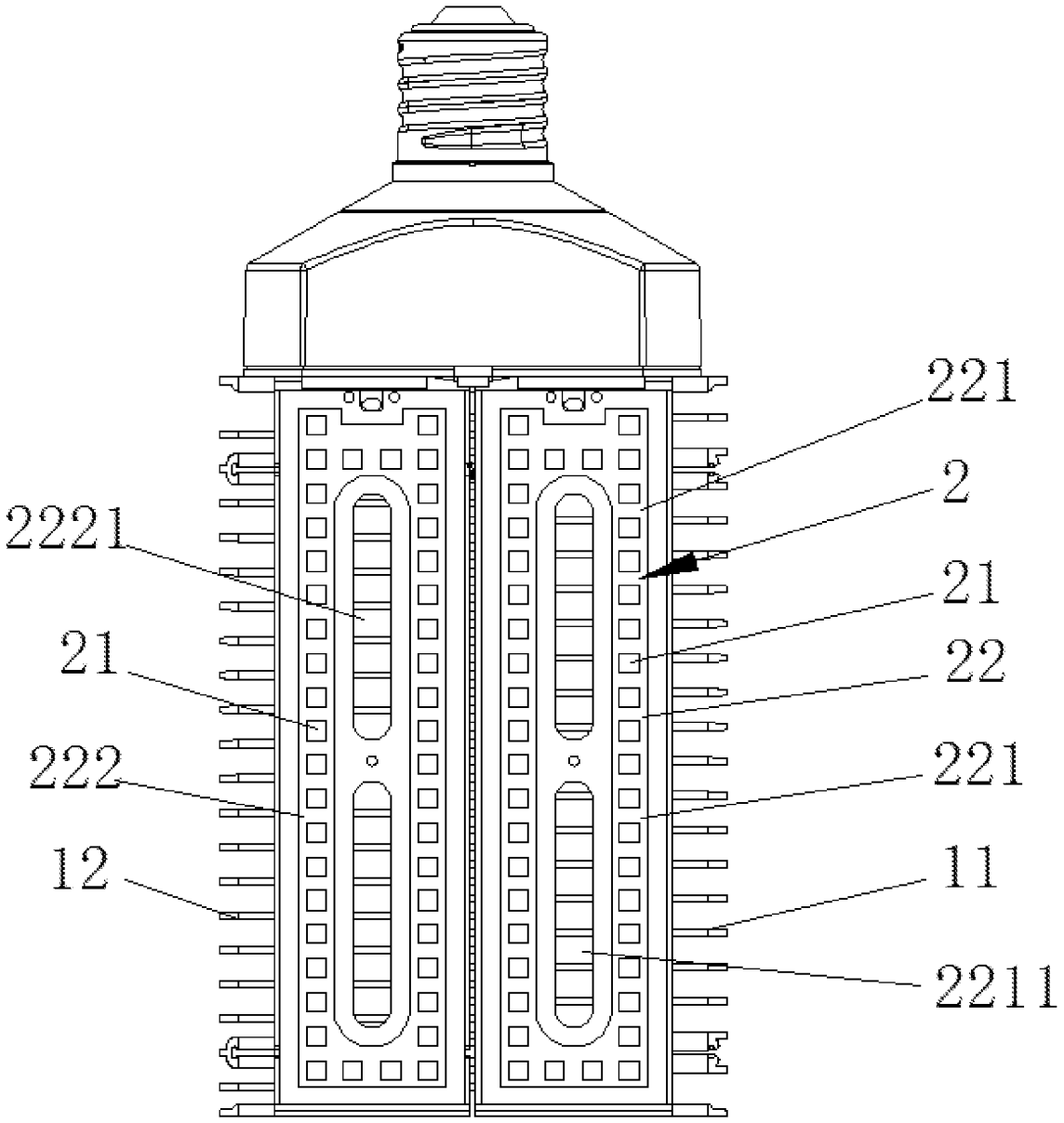
FIG. 33 illustrates a schematic diagram showing FIG. 32 without a light output unit.
Figure 34:
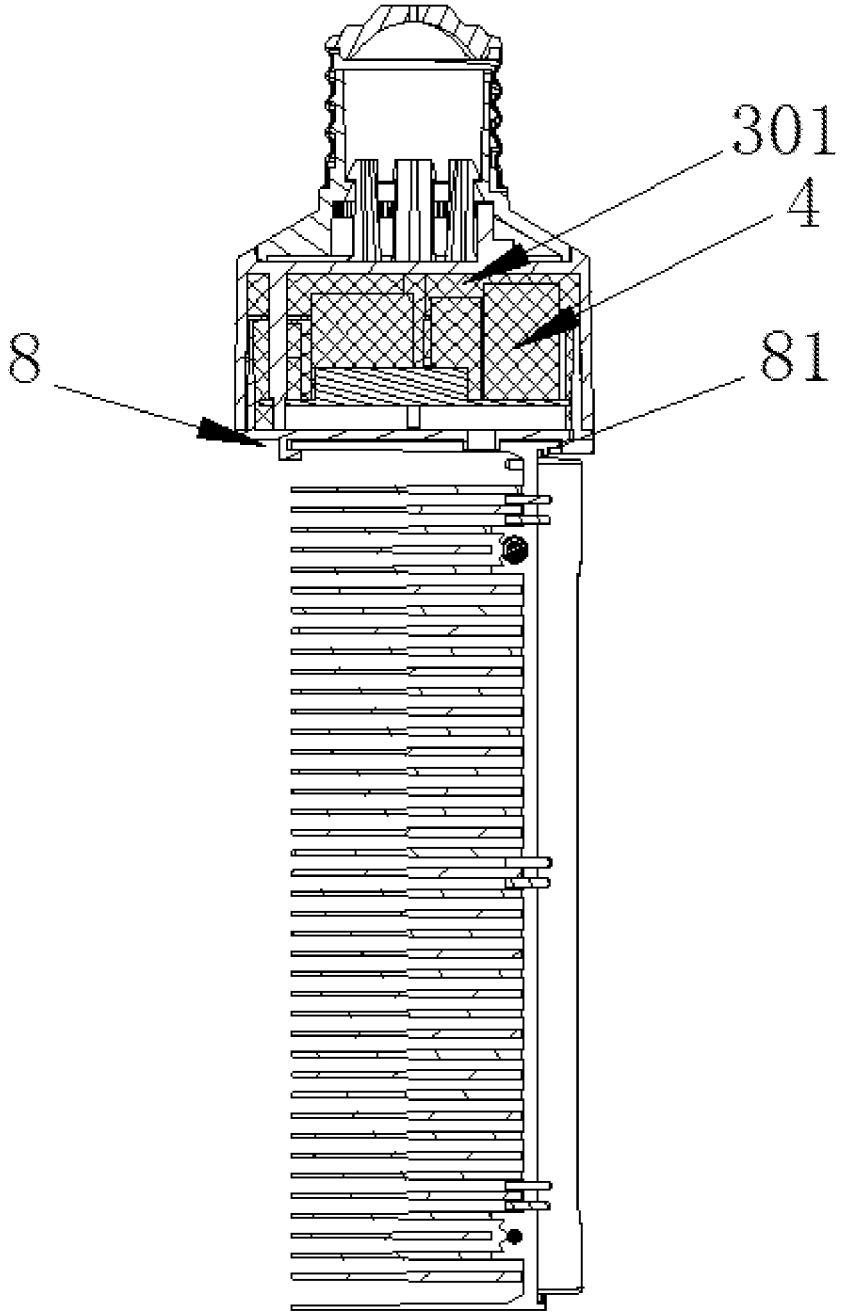
FIG. 34 illustrates a cross-section diagram showing a structure in FIG. 31.

Please refer to FIG. 33. In some embodiments, when the heat exchange unit 1 is in the open mode, the more the space between two sets of the light emission units 2 (in specific referring to the substrate 22 of two sets of the light emission units 2), the greater the light emission range of the LED lighting device.

Please refer to FIG. 33. In some embodiments, both sets of substrates 22 have orifices 2211 disposed thereof. When the LED lighting device is operated, heat is conducted by the orifices 2211 of the substrate 22, increasing the convection of the thermal dissipation of the heat exchange unit 1. The quantity of the orifices 2211 of each set of the substrates 22 is arranged in one or plural.

Figure 42:
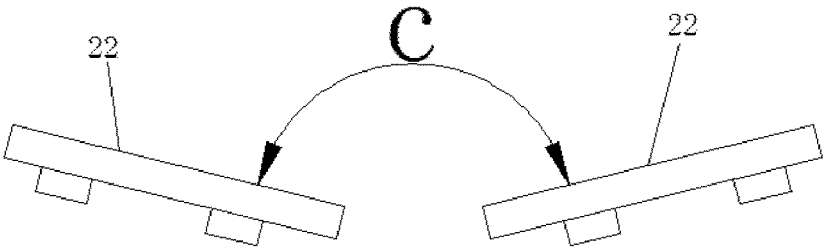
FIG. 42 illustrates a schematic diagram showing substrates according to some embodiments of the instant disclosure.

Please refer to FIG. 42. In some embodiments, A nip angle C is formed between two sets of the substrates 22 to adjust a light emission angle of the LED lighting device. Specifically, the light emission angle of the LED lighting device is enlarged according to the nip angle C between the two sets of the substrates 22. In some embodiments, the nip angle C between the two sets of the substrates 22 is between 120 degrees to 170 degrees, enlarging the light emission range of the LED lighting device. The arrangement of the angle C between the two sets of the substrates 22 ensures the luminance below the LED lighting device and the light emission angle of the entire LED lighting device to have an excellent performance.

Figure 43:
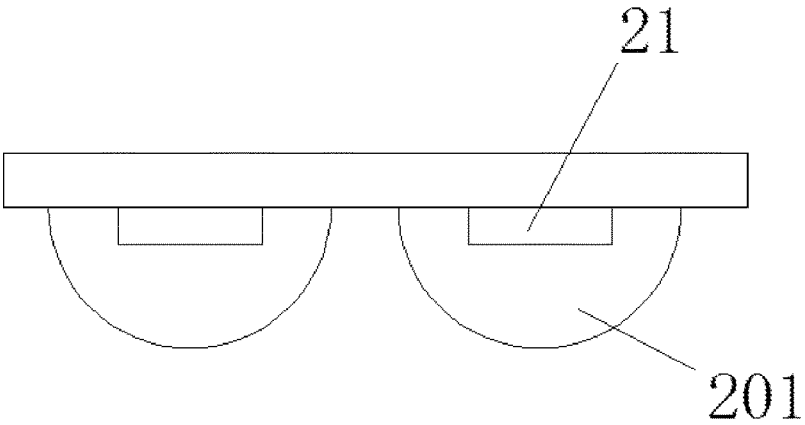
FIG. 43 illustrates a schematic diagram showing substrates according to some embodiments of the instant disclosure.

Please refer to FIG. 43. In some embodiments, to enlarge the light emission angle of the LED lighting device, a lens is disposed thereof. Specifically, the lens 201 is disposed on the illuminators 21 to enlarge the light emission angle of the LED lighting device. To illustrate, the lens 201 is disposed on a single illuminator 21. Specifically, lenses 3211 are disposed on a plurality of illuminators 21 that is a single lens 201 is corresponding to a plurality of illuminators 21 (not shown).

A light emission module 3200 and a heat exchange module 3100 are connected to form a thermal conduction path. When the LED lighting device is operated, heat generated from the light emission module 3200 is conducted to the heat exchange module 3100 in form of thermal conduction, and the heat exchange module 3100 executes thermal dissipation.

While the embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention. The disclosure of all articles and references, including patent applications and publications, is hereby incorporated by reference for all purposes. The omission of any aspect of the subject matter disclosed herein in the preceding claims is not intended to abandon the subject matter, nor should the inventor be considered to have considered the subject matter as part of the disclosed subject matter.

What is claimed is:

1. An LED lighting device, comprising:

a lamp cap;

a case connected to the lamp cap and forming a cavity;

a power supply disposed in the cavity;

a light emission unit electrically connected to the power supply; and a heat exchange unit, connected to the case, and comprising a base and cooling fins arranged parallel to each other and perpendicularly connected to only one side of the base;

wherein the heat exchange unit comprises a positioning unit, the light emission unit comprises an illuminator and a substrate, the illuminator is mounted on the substrate, and the substrate is parallelly connected on another side of the base, which is not disposed with the cooling fins;

wherein the positioning unit comprises a first positioning unit and a second positioning unit, the first positioning unit, the second positioning unit and the base are in an integrated structure, the first positioning unit and the second positioning unit are separately engaged with a first end and a second end of the substrate in a longitudinal direction of the substrate, the first end is a fixed end connected to the case, and the second end is a free end.

2. The LED lighting device of claim 1, wherein the first positioning unit comprises a first groove, the second positioning unit comprises a second groove, the first end of the substrate is locked into the first groove, and the second end of the substrate is locked into the second groove.

3. The LED lighting device of claim 2, wherein the first positioning unit has a first wall, and the first groove is formed between the first wall and the base; the second positioning unit has a second wall, and the second groove is formed between the second wall and the base.

4. The LED lighting device of claim 3, wherein the first wall and the second wall are separately in contact with a surface of the substrate.

5. The LED lighting device of claim 3, wherein the first groove is formed with an opening, and the opening is flared in shape.

6. The LED lighting device of claim 3, wherein a thickness of the first wall tapers in a direction toward the second wall.

7. The LED lighting device of claim 2, wherein a distance between a bottom of the first groove and a bottom of the second groove is greater than a length of the substrate.

8. The LED lighting device of claim 2, wherein one side of the first end of the substrate abuts against a bottom of the second groove.

9. The LED lighting device of claim 2, wherein a slit is configured between one side of the substrate and a bottom of the first groove.

10. The LED lighting device of claim 2, wherein a length from a bottom of the first groove to an end of the second wall is greater than a length of the substrate.

11. The LED lighting device of claim 1 further comprising thermal adhesive coated on the substrate, wherein the base has a receiving groove disposed thereof, and the receiving groove is arranged to correspond to an edge of the substrate without exceeding a border of an outer end of the substrate.

12. The LED lighting device of claim 1 further comprising thermal adhesive coated on the substrate, wherein the substrate has two receiving grooves corresponding to a surface of the base, and the receiving grooves are disposed on both opposite sides of the substrate in a length direction.

13. The LED lighting device of claim 1, wherein a through hole is disposed on the substrate, and the base of the heat exchange unit has a convection opening corresponding to the through hole.

14. The LED lighting device of claim 1, wherein the base is formed with apertures between adjacent two of the cooling fins, and the substrate is penetrated by holes corresponding to the apertures.

* * * * *